US011424525B2

(12) United States Patent
Ramzan et al.

(10) Patent No.: US 11,424,525 B2
(45) Date of Patent: Aug. 23, 2022

(54) DUPLEXERS AND RELATED DEVICES FOR 5G/6G AND SUBSEQUENT PROTOCOLS AND FOR MM-WAVE AND TERAHERTZ APPLICATIONS

(71) Applicant: Wi-LAN Research Inc., Vista, CA (US)

(72) Inventors: Muhammad Rashad Ramzan, Islamabad (PK); Muhammad Omar, Islamabad (PK); Kenneth Stanwood, Vista, CA (US)

(73) Assignee: WI-LAN RESEARCH INC., Vista, CA (US)

( * ) Notice: Subject to any disclaimer, the term of this patent is extended or adjusted under 35 U.S.C. 154(b) by 0 days.

(21) Appl. No.: 17/198,712

(22) Filed: Mar. 11, 2021

(65) Prior Publication Data

US 2022/0123453 A1 Apr. 21, 2022

Related U.S. Application Data

(60) Provisional application No. 63/093,771, filed on Oct. 19, 2020.

(51) Int. Cl.

| | |
|---|---|
| ***H01P 1/203*** | (2006.01) |
| ***H01P 7/08*** | (2006.01) |
| ***H01P 7/10*** | (2006.01) |

(52) U.S. Cl.

CPC ..... *H01P 7/082* (2013.01); *H01P 1/203* (2013.01); *H01P 1/20309* (2013.01); *H01P 1/20381* (2013.01); *H01P 7/10* (2013.01)

(58) Field of Classification Search

CPC ..... H01P 1/203; H01P 1/20309; H01P 1/20381; H01P 7/082; H01P 7/08; H01P 7/10; H01P 3/08; H01P 3/081

See application file for complete search history.

(56) References Cited

U.S. PATENT DOCUMENTS

| | | | |
|---|---|---|---|
| 4,574,288 | A | 3/1986 | Sillard et al. |
| 7,038,551 | B2 | 5/2006 | Kearns |

(Continued)

FOREIGN PATENT DOCUMENTS

| | | | |
|---|---|---|---|
| EA | 021016 | B1 | 3/2015 |
| EP | 0928064 | B1 | 6/2002 |

OTHER PUBLICATIONS

Chin, Woon Hau; Fan, Zhong; and Haines, Russell, "Emerging technologies and research challenges for 5G wireless networks." IEEE Wireless Communications, Apr. 2014: pp. 106-112.

(Continued)

*Primary Examiner* — Stephen E. Jones

(74) *Attorney, Agent, or Firm* — Philip E. Levy; Eckert Seamans Cherin & Mellott, LLC

(57) ABSTRACT

A ring resonator based T-shaped duplexer for use in communication systems, the T-shaped duplexer comprising a T-shaped microstrip duplexer body having a first rectangular-shaped body section and a second rectangular-shaped body section that extends from the first-rectangular shaped section in a perpendicular position relative to the first rectangular-shaped section, three connection ports including a first connection port disposed at an open end of the second rectangular-shaped body section, a second connection port disposed at one end of the first rectangular-shaped body section, and a third connection port disposed at another end of the first rectangular-shaped body section, and two bandpass filters, each bandpass filter comprising a ring resonator structure having a circular shape, an outer edge of the ring resonator structure being connected to the first rectangular-shaped body section of the T-shaped microstrip duplexer body, wherein each of the two bandpass filters creates an Electromagnetically Induced Transparency (EIT) window (Continued)

4800 within a frequency absorption region of the bandpass filter to allow a signal to pass at a pre-tuned frequency band.

20 Claims, 62 Drawing Sheets

(56) References Cited

U.S. PATENT DOCUMENTS

| | | | | |
|---|---|---|---|---|
| 9,203,373 | B2 | 12/2015 | Zuo et al. | |
| 10,186,743 | B2 | 1/2019 | Ramzan et al. | |
| 10,186,744 | B2 | 1/2019 | Ramzan et al. | |
| 2007/0139135 | A1 | 6/2007 | Ammar et al. | |
| 2011/0019259 | A1* | 1/2011 | Yen | G02F 1/0126 359/240 |
| 2018/0219531 | A1* | 8/2018 | Ramzan | H03H 11/16 |

OTHER PUBLICATIONS

Shukla, Sapna, et al. "Comparative Study of 1G, 2G, 3G and 4G " Journal of Engineering, Computers and Applied Sciences, vol. 2, No. 4 (Apr. 2013): pp. 55-63.

Gupta, Abhishek; Gupta, Dr. Anupam; and Gupta, Sarthak "5G:—the future mobile wireless technology by 2020", International Journal of Engineering Research & Technology, vol. 2, Issue 9, Sep. 2013, pp. 1245-1249.

Papadopoulos, Haralabos, et al. "Massive MIMO technologies and challenges towards 5G." IEICE Transactions on Communications, vol. E99-B, No. 3 (Mar. 2016), pp. 602-621.

Huo, Yiming, et al., "Enabling multi-functional 5G and beyond user equipment: A survey and tutorial." IEEE Access DOI 10.1109/ACCESS.2019.2936291, (2019), pp. 1-33.

Yang, Xi, et al. "Hardware-constrained millimeter-wave systems for 5G: Challenges, opportunities, and solutions", IEEE Communications Magazine 57.1, Jan. 2019, pp. 44-50.

Adnan, Noor Hidayah Muhamad; Rafiqul, Islam Md.; and Alam, AHM Zahirul; "Massive MIMO for fifth generation (5G): Opportunities and challenges", 2016 International Conference on Computer and Communication Engineering (ICCCE). IEEE, 2016, pp. 47-52.

Nadeem, Qurrat-Ul-Aim; Kammoun, Abla; Mérouane, Debbah; and Alouini, Mohamed-Slim; "Design of 5G full dimension massive MIMO systems", IEEE Transactions on Communications 66.2 (2017): pp. 726-740.

Nadeem, Qurrat-Ul-Aim; Kammoun, Abla; Merouane, Debbah; and Alouini, Mohamed-Slim; "Design of 5G full dimension massive MIMO systems", pp. 1-30.

Buzzi, Stefano, et al. "A survey of energy-efficient techniques for 5G networks and challenges ahead", IEEE Journal on Selected Areas in Communications 34.4 (2016), pp. 697-709.

Chinig A. "Review on technologies used to design RF diplexers", International Journal of Biosensors and Bioelectronics, vol. 4, Issue 1, 2018, pp. 23-25.

"What is Duplexer, How it is used, Advantages and Disadvantages", www.techplayon.com/duplexer-used-advantages-disadvantages/, May 28, 2021, pp. 1-5.

Psychogiou, Dimitra; Gómez-García, Roberto; and Peroulis, Dimitrios; "Tune-all RF planar duplexers with intrinsically switched channels." IEEE Microwave and Wireless Components Letters, vol. 27, No. 4, Apr. 2017, pp. 350-352.

Vidhya, K., and Jayanthy, T., "Design of microstrip hairpin band pass filter using defected ground structure and open stubs." 2011 International Conference on Information and Electronics Engineering, IPCSIT vol. 6, Singapore. 2011, pp. 268-272.

Chinig, A., et al. "Design of a microstrip diplexer and triplexer using open loop resonators", Journal of Microwaves, Optoelectronics and Electromagnetic Applications, vol. 15, No. 2, Jun. 2016, pp. 65-80.

Matsuda, T., et al. "High-frequency SAW duplexer with low-loss and steep cut-off characteristics", 2002 IEEE Ultrasonics Symposium, Proceedings vol. 1, pp. 71-76.

Marksteiner, S., et al. "A miniature BAW duplexer using flip-chip on LTCC." 2003 IEEE Ultrasonics Symposium, vol. 2, pp. 1794-1797.

Yang, Chang; and Gui, Ping; "On-chip 100GHz full-duplex circulator/duplexer design based on nonreciprocal transmission line", 2018 Texas Symposium on Wireless and Microwave Circuits and Systems (WMCS). IEEE, 2018, pp. 1-4.

Wang, Yunfan; Chen, Wenhua; and Li, Xingcun; "A 210-GHz Magnetless Nonreciprocal Isolator in 130-nm SiGe BiCMOS Based on Resistor-Free Unidirectional Ring Resonators", IEEE Microwave and Wireless Components Letters, vol. 30, No. 5, May 2020, pp. 524-527.

Haraz, Osama M., et al. "Millimeter-wave microstrip diplexer using elliptical open-loop ring resonators for next generation 5G wireless applications", Microwave and Optical Technology Letters, vol. 58, No. 1, Jan. 2016, pp. 106-110.

Shaman, H., et al. "Millimeter-wave microstrip diplexer using elliptical open-loop ring resonators for next generation 5G wireless applications", Proceedings of 2014 Mediterranean Microwave Symposium (MMS2014), IEEE, 2014, pp. 104.

Hong, Seungpyo; and Chang, Kai; "Stub-tuned microstrip bandpass filters for millimeter-wave diplexer design", IEEE Microwave and Wireless Components Letters, vol. 15, No. 9, Sep. 2005, pp. 582-584.

Stander, Tinus; "Inline Ka-band Transitional combline/evanescent-mode filter in conventional RF substrate using grounded vias", AFRICON 2015. IEEE, 2015, pp. 1-4.

Metz, Dave; "Duplexer Theory and Tuning", South East Iowa Technical Society (SEITS), https://www.utm.edu/staff/eeb/duplexer.pdf, pp. 1-7.

Cheema, Hammad M.; and Shamim, Atif; "The last barrier: on-chip antennas." IEEE Microwave Magazine, vol. 14, No. 1, Jan./Feb. 2013, pp. 79-91.

Lukin, M. D.; and Imamoglu, A.; "Controlling Photons Using Electromanetically Induced Transparency", Nature, vol. 413, pp. 273-276, Sep. 2001.

Amin, M.; Ramzan, R.; and Siddiqui, O.; "Slow Wave Applications of Electromagnetically Induced Transparency in Microstrip Resonator", Nature Scientific Reports, doi:10.1038/s41598-018-20771-w, Report No. 6129, Feb. 2018, pp. 1-13.

Boller, K-J.; Imamoglu, A.; and Harris, S.E.; "Observation of Electromagnetically Induced Transparency", Physical Review Letters, vol. 66, No. 20, May 1991, pp. 2593-2596.

Amin, M.; Ramzan, R.; and Siddiqui, O.; "Fano Resonance Based Ultra High-Contrast Electromagnetic Switch", American Institute of Physics (AIP), Applied Physics Letters 110, 181904, DOI: 10.1063/1.4982725, vol. 110, Issue: 18, May 2017, pp. 181904-1 to 181904-5.

Vanin, F. M.; Schmitt, D.; and Levy, R.; "Dimensional synthesis for wide-band waveguide filters and diplexers", IEEE Transactions on Microwave Theory and Techniques, vol. 52, No. 11, Nov. 2004, pp. 2488-2495.

Zhao, X.; Zhang, Z.; and Yan, S. "Tunable Fano Resonance in Asymmetric MIM Waveguide Structure", MDPI, Sensors (Basel), 17, 1494, 2017, pp. 1-8.

Pozar, David M.; Microwave Engineering, Fourth Edition, John Wiley & Sons, Inc., 2012.

Che, W.; Tang, Y. F.; Zhang, J.; & Chow, Y. L.; "Formulas of dielectric and total attenuations of a microstrip line", Radio Science, vol. 45, 2010, pp. 1-10.

* cited by examiner

600

900

1100

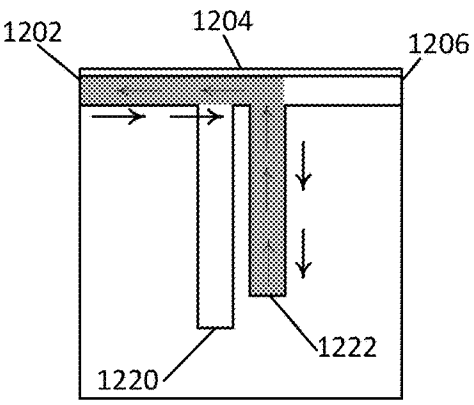
Resonance Below EIT
FIG. 12A
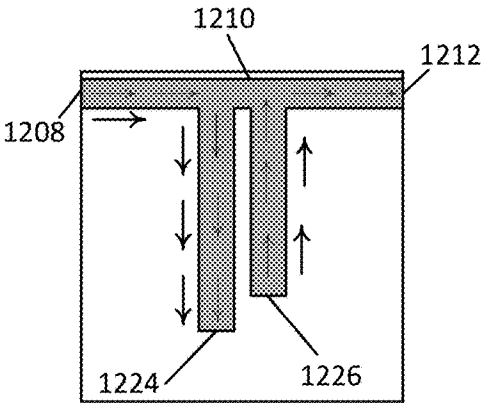
EIT Resonance
FIG. 12C
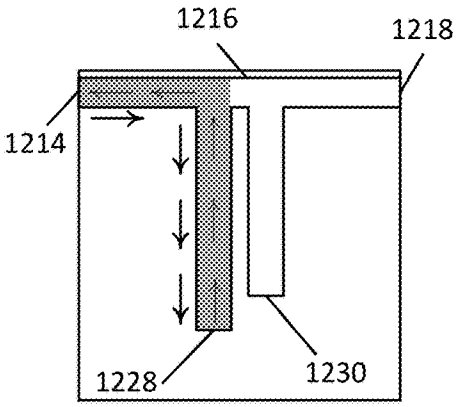
Resonance Above EIT
FIG. 12E
Resonance Below EIT
FIG. 12B
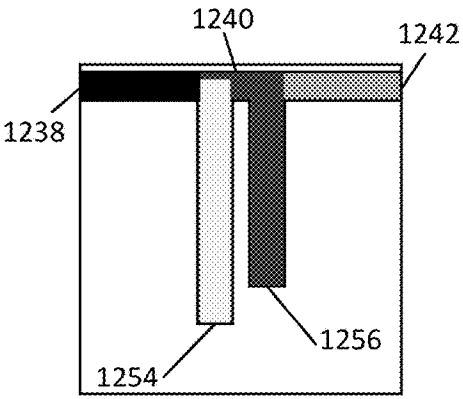
EIT Resonance
FIG. 12D
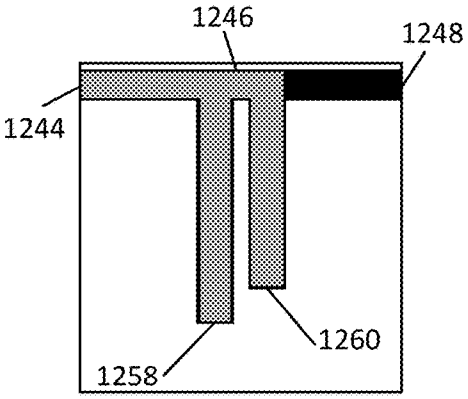
Resonance Above EIT
FIG. 12F Resonance Below Fano Resonance Below Fano Fano Resonance Fano Resonance Resonance Above Fano Resonance Above Fano

1500

1700

1800

1900

2800

$L_1 \times L_2 \geq L_3 \times L_4$

3400

3600

3900

4000

4100

4300

4400

4700

5000

5300

5500

5700

DUPLEXERS AND RELATED DEVICES FOR 5G/6G AND SUBSEQUENT PROTOCOLS AND FOR MM-WAVE AND TERAHERTZ APPLICATIONS

CROSS-REFERENCE TO RELATED APPLICATIONS

This application claims the benefit of priority to U.S. Provisional Patent Application No. 63/093,771, filed on Oct. 19, 2020 and entitled "Duplexer For 5G and 6G mm-Wave and THz Applications", which is incorporated herein by reference.

FIELD OF THE INVENTION

The inventions described herein relate to filters, duplexers, and related devices and systems for use in communication systems. Aspects of the inventions herein further relate to filters, duplexers, and related systems for use in 5G/6G and beyond communication protocols and systems, and mm-Wave and Terahertz (THz) communication systems.

BACKGROUND

The technology of mobile communications has continuously evolved and improved in terms of supporting collaboration applications over the last decade. 4G communication technology still continues to evolve in the form of LTE-Advanced and has now achieved a maximum bandwidth of approximately 1 Gbps. The next-generation 5G/6G technology has posed significant challenges to researchers in all relevant fields of wireless communication technology to improve the efficiency of the essential core technology components in such a manner that the technology can support high data rate communication applications and systems.

The challenges in emerging 5G/6G communication technologies are multifold and multidimensional. From high frequency, high data rates, and CMOS scaling to powerful and high-end DSP processing, out of the box thinking is required to generate innovation and improvements. 5G is a mobile communication system that supports multiple frequency bands and a multitude of modulation standards. 5G chipsets have several transverses and antenna. Active phased-array antennas (APAAs) used to form a Massive MIMO (MMIMO) system along with digital MIMO signal processing packed on the 3D System-on-Chip (SoC) solutions seem to be the most plausible and cost-effective technological implementations for 5G (and future 6G) systems. For user terminals to be mass-produced, small form factors and low power consumption of such user terminals are key technological challenges. To implement the MMIMOs array, there will be multiple subarrays, and multiple RF front ends per each subarray. Each RF front end is likely to contain some combination of components including the Power Amplifier (PA), Low Noise Amplifier (LNA), Switch, Phase Shifter (PS), Duplexers, and Variable Gain Amplifier (VGA) as shown in FIG. 1.

No single chip technology (or material) such as Si, GaAs or GaN, can provide the optimum workable solution with the anticipated specification for the above-mentioned RF components in 5G systems due to the required mm frequencies (28-56 GHz) and bandwidth in the GHz range. These frequencies will increase up to the range of 100 GHz to 1 THz (terahertz) and beyond for future 6G systems. If we consider the use of frequency duplexing in massive MIMO chips, two duplexing procedures are generally utilized: TDD (Time-Division Duplexing) and FDD (Frequency-Division Duplexing). The conceptual diagrams of both a frequency duplexer and a time switch (time duplexer) are shown in FIGS. 1 and 2.

In FDD, such as the system 100 shown in FIG. 1, the transmitter 112 and the receiver 114 operate simultaneously and share the same antenna 110. For this purpose, two separate frequency bands are used for transmission and reception. Therefore, it is essential to use a duplexer 108 comprising of two selective filters: one filter that is centered at the transmission band (Tx) and the other filter that is centered at the reception band (Rx) to discriminate between the Tx and Rx signals. The antenna 110 operates at both bands and the duplexer 108 allows simultaneous transmit and receive communication with maximum isolation between Tx and Rx bands. Sharing a single antenna (SISO) or set of multiple antenna (MIMO) in a transmit and receive path reduces the size, weight and area of the transceiver system 100.

In TDD systems such as shown in FIG. 2, multiple signals are allowed to be transmitted on a single frequency band. The Tx and Rx operate at different time slots and feed the PA 202 and the LNA 204, respectively, at different time instants. The emergence of beamforming MIMO systems has drawn an immense interest in a fully integrated SoC solution with a large number of on-chip antennas along with the associated Tx and Rx RF chains. FDD type architectures are more favorable for beamforming MIMO systems compared to TDD. Therefore, the duplexer, being an essential part of the RF chain, must be integrated on the single CMOS chip containing all of the other RF chain components. A Duplexer-on-Chip (DoC) along with an Antenna-on-Chip (AoC) may be a viable solution for the design and development of fully integrated, low-cost, power-efficient mm-wave future 5G/6G transceivers.

Generally, known duplexers consist of two passband filters that are tuned at different frequencies while providing good isolation between the ports of the filters. They are selective components used to isolate or combine signals having different central frequencies and are essential components of FDD communication systems including, but not limited to, mobile telephony, radio transmission, broadband wireless communications, and satellite communication systems. The duplexer is a 3-port filtering device that must provide good isolation between the transmitter and the receiver while maintaining a low insertion loss (by the duplexer itself). Duplexers typically consist of two-channel filters, and a common point is used to combine the two filters to form the multiport network as shown in the duplexer 304 of FIG. 3. Such a duplexer 304 provides a mechanism for a transmitter 310 and a receiver 312 to share a common antenna 302 simultaneously. The antenna 302 operates at both bands and the duplexer 304 allows simultaneous communication with maximum isolation between the Tx and Rx bands. In the frequency response graph of FIG. 4, duplexing gap 402 is the duplexer separation between transmit band 404 and receive band 406. There is no overlapping between bands 404 and 406 which means a good isolation is achieved by duplexer 304.

DUPLEXER STATE OF THE ART (PRIOR ART)

TABLE 1

Summary of various types of passive duplexers

| | Waveguides Duplexers | Dielectric Resonators Duplexers | Planar Duplexers | Quasi-Planar Duplexers | SIW Duplexers | HTS |
|---|---|---|---|---|---|---|
| Size | Large | Large | Small | Large | Moderate | Small |
| EM Simulation | 3D | 3D | 2D & 3D | 3D | 3D | 2D & 3D |
| Ease of Integration on a Single Chip | Difficult | Difficult | Excellent | Moderate | Moderate | Excellent |
| Quality factor | Very High | Very High | Low | High | High | Low |
| Power Handling | High | High | Low | High | Low | Low |

The two main classes of duplexers are active and passive. The active duplexers have a small on-chip area and also provide the necessary gain. However, since the transistors are fabricated on the substrate, the routing of a wideband mm-wave signal from the antenna to the substrate through tungsten (W) vias and the low transistor-to-transistor isolation in the substrate pose a significant technical challenge. Therefore, the active class of duplexers is generally not deemed suitable for mm-wave solutions due to low suppression of the undesired frequency band. In this active class of duplexers, the PA signal leaks through the substrate and drives the LNA in the non-linear region.

The passive class of duplexers provides better isolation since they do not suffer from the substrate coupling problem. Moreover, they typically do not have any biasing requirements and can be fabricated using the single or multiple metal layers available for interconnect in the CMOS technology. The passive class of duplexers can be implemented using a variety of different technologies as listed above in Table 1. These types of passive class duplexers have their own merits and demerits in terms of size, Q-factor, cost, insertion loss, isolation, ease of integration, and power handling capacity. All passive class duplexer types are not necessarily suitable for on-chip implementation due to the planar nature of the existing CMOS process, the small feature size, and the types of the metals used for on-chip interconnect.

Waveguide-based duplexers are suitable for high power applications; however, their large structure size renders them unsuitable for on-chip integration. Some non-traditional duplexer designs use power limiters, couplers, and phase shifters to achieve the duplexing action. For high power signals, the limiter blocks the signal and establishes the connection between transmitter, antenna and vice versa.

Microstrip based duplexer designs are simple, easy to fabricate and their ability to integrate with planar structures makes them potential candidates for on-chip duplexer design. These designs have shown good performance at low frequencies, but at mm-wave, they exhibit high radiation losses which render them a poor choice for 5G/6G applications. The emerging techniques to mitigate the radiation and substrate losses can make these designs an attractive choice for future 5G/6G applications. These planar duplexers are considered to be the most suitable type of duplexers for on-chip fabrication. A 3-port planar passive tunable duplexer was proposed by Psychogiou et al. and its structure was designed for low frequency bands. The tuneability was achieved with the help of capacitors. In 5G/6G systems, the selectivity of the duplexer filter is a major challenge. These state-of-the-art duplexers are mostly designed for sub 6 GHz frequency ranges and have marginal selectivity which limits their usage for mm-wave applications. Microstrip based hairpin line filters are known for their simple geometry and high out-band rejection. A hairpin line structure filter with a defected ground plane has been proposed and was designed for sub 6 GHz frequency ranges. The U-shaped open stub structures look like hairpins. The main advantage of the structure is that the bandwidth can be controlled by cascading the number of hairpins. The downside of this design is its high insertion loss.

Chinig et al. proposed an open loop microstrip based duplexer and triplexer. The low-quality factor of such microstrip technology is considered a bottleneck and, so far, several techniques have been proposed to mitigate this shortcoming. The microstrips were used as feed lines and duplexing and triplexing actions were achieved by cascading different bandpass filters, tuned at different frequencies. The design offers good isolation and low insertion loss which shows that these types of filters with open loops may have the potential for use in duplexers for mm-wave applications.

The passive Surface Acoustic Wave (SAW) filter duplexer was proposed by T. Matsuda, et al. The SAW filter duplexer has high losses, and it was mainly designed for low-frequency communication systems like the AMPS-CDMA system. A miniature bulk acoustic wave (BAW) duplexer for on-chip solutions has been proposed but its structure was bulky and it was also designed for low-frequency applications. A CMOS technology-based nonreciprocal wideband transmission line duplexer was proposed by Yang. An isolator at an extremely high frequency was proposed by Wang et al. which uses unidirectional split-ring resonators. An mm-wave microstrip duplexer using elliptical open-loop ring resonators for 5G applications was proposed by Haraz et al., wherein a set of two elliptical resonating filters were used to achieve the duplexing behavior. A stub-tuned microstrip bandpass filter for mm-Wave duplexer is proposed by Hong et al., in which a pair of parallel-coupled microstrip lines of 510 mils (12.9 mm) and 452 mils (11.4 mm) is used. This particular design is proposed for 5G applications; however, the large dimensions make them unsuitable for on-chip integration.

A new design for 5G using Ka-band evanescent-mode filter has been is proposed by Stander wherein specialized vias were used to achieve the filtering effect. The bandwidth of the filter was approximately 5 GHz which limits its application as a duplexer. Other solutions include hybrid rings, notches in cavities, and band-pass filters. U.S. Pat. No. 7,038,551 (B. Kearns) describes an antenna duplexer for mobile telecommunications in which the duplexer has two microstrip bandpass filters. Each bandpass filter is connected to the transmitter and receiver. To improve the isolation between receiver and transmitter, a matching circuit is inserted. A SAW filter is also described in Patent No. EP0928064 (Satoh, et al.) wherein the combs/finger-shaped filter has two reflectors at each side to further comprise metallized fingers. The advantage of such a SAW filter over the dielectric filter is a reduction in the surface area of the filter. A waveguide duplexer is described in US Patent Publication No. US20070139135A1 (Ammar, et al.). Such waveguide-based structures are good for high power handling capacity, but they are bulky and difficult to integrate with planar structures. A T-shaped microstrip duplexer for low frequencies 1-3 GHz is shown in the Patent EA021016B1 (Belyaev et al.) wherein the filtering effect at different frequencies is achieved by different lengths of the microstrip. The design is very simple, but the size of the filters is relatively large. Duplexer design using through-glass via technology is described in the U.S. Pat. No. 9,203,373 (Zuo) wherein the substrate has a number of through vias and set of traces that behave as an inductor. The size of all such duplexers is large and most of these duplexers are either designed for low frequencies or exhibit attenuation in their frequency response.

In summary, existing technology does not provide suitable designs for a small size, low power, and high isolation on-chip duplexer for a 5G/6G System. In mm-wave and THz MMIMO phased array systems, the expected number of antennas ranges from 4 to 512 on the single chip. The same number of duplexers are also needed on the same single CMOS chip. In existing nm CMOS technologies, if the CMOS chip size exceeds the order of size more than 30×30 $mm^2$, then the matching and reliability issues become dominant. As a result, the yield of the SoC will be reduced. Therefore, innovative and out of the box designs are required for 5G/6G duplexer technology.

SUMMARY OF THE INVENTION

In an aspect, a ring resonator based T-shaped duplexer is provided for use in communication systems, the T-shaped duplexer comprising a T-shaped microstrip duplexer body having a first rectangular-shaped body section and a second rectangular-shaped body section that extends from the first-rectangular shaped section in a perpendicular position relative to the first rectangular-shaped section, three connection ports including a first connection port disposed at an open end of the second rectangular-shaped body section, a second connection port disposed at one end of the first rectangular-shaped body section, and a third connection port disposed at another end of the first rectangular-shaped body section, and two bandpass filters, each bandpass filter comprising a ring resonator structure having a circular shape, an outer edge of the ring resonator structure being connected to the first rectangular-shaped body section of the T-shaped microstrip duplexer body, wherein each of the two bandpass filters creates an Electromagnetically Induced Transparency (EIT) window within a frequency absorption region of the bandpass filter to allow a signal to pass at a pre-tuned frequency band.

In another aspect, a ring resonator based bandpass filter device is provided for use in communication systems, the bandpass filter device comprising a microstrip structure having a rectangular shaped body and having a first port provided at one end of the rectangular shaped body and a second port provided at a second end of the rectangular shaped body, and a ring resonator structure having a circular shape, an outer edge of the ring resonator structure being connected to the rectangular shaped body of the microstrip structure, wherein the ring resonator structure creates an Electromagnetically Induced Transparency (EIT) window within a frequency absorption region of the bandpass filter device to allow a signal to pass at a pre-tuned frequency band.

In a further aspect, a stub resonator based T-shaped duplexer is provided for use in communication systems, the T-shaped duplexer comprising a T-shaped microstrip duplexer body having a first rectangular-shaped body section and a second rectangular-shaped body section that extends from the first-rectangular shaped section in a perpendicular position relative to the first rectangular-shaped section, three connection ports including a first connection port disposed at an open end of the second rectangular-shaped body section, a second connection port disposed at one end of the first rectangular-shaped body section, and a third connection port disposed at another end of the first rectangular-shaped body section, and two bandpass filters connected to the first rectangular-shaped body section of the T-shaped microstrip duplexer body, each bandpass filter comprising a rectangular microstrip structure, a first rectangular stub resonator structure extending from the rectangular microstrip structure in a perpendicular direction relative to the microstrip structure, and a second rectangular stub resonator structure extending from the rectangular microstrip structure in a perpendicular direction relative to the microstrip structure and being in a parallel position relative to the first rectangular stub resonator structure and being separated from the first rectangular stub resonator structure by a gap distance, wherein each of the two bandpass filters creates an Electromagnetically Induced Transparency (EIT) window within a frequency absorption region of the bandpass filter to allow a signal to pass at a pre-tuned frequency band.

In yet another aspect, a stub resonator based bandpass filter device is provided for use in communication systems, the bandpass filter device comprising a microstrip structure having a rectangular shaped body and having a first port provided at one end of the rectangular shaped body and a second port provided at a second end of the rectangular shaped body, a first stub resonator structure having a rectangular shape and extending from the rectangular shaped body of the microstrip structure in a perpendicular direction relative to the rectangular shaped body of the microstrip structure, and a second stub resonator structure having a rectangular shape and extending from the rectangular shaped body of the microstrip structure in a perpendicular direction relative to the rectangular shaped body of the microstrip structure, the second stub resonator structure being in a parallel position relative to the first stub resonator structure and being separated from the first stub resonator structure by a gap distance, wherein the first stub resonator structure and the second stub resonator structure act as resonators and in combination provide a coupled circuit response that creates an Electromagnetically Induced Transparency (EIT) window within a frequency absorption region of the bandpass filter device to allow a signal to pass at a pre-tuned frequency band.

The foregoing aspects, and other features and advantages of the invention, will be apparent from the following, more particular description of aspects of the invention, the accompanying drawings, and the claims.

BRIEF DESCRIPTION OF THE DRAWINGS

Details of one or more implementations of the subject matter of the invention are set forth in the accompanying drawings briefly described below and the related description set forth herein. Other objects, features, aspects, and advantages will become apparent from the description, the drawings, and the claims. Note that the relative dimensions of the drawings may not be drawn to scale. Like reference numbers and designations in the various drawings indicate like elements.

FIGS. 12A through 12F are functional diagrams depicting the current magnitude and the phase distributions on the EIT double-stub structure calculated using the transmission line analytical model at three spectral resonance points according to aspects of the invention;

DETAILED DESCRIPTION

Aspects of the present invention and their advantages may be understood by referring to the figures and the following description. The descriptions and features disclosed herein can be applied to various devices, systems, software, and methods in communication circuits and systems including for example in a communication system device such as a user equipment device, a base station device or a communication node device.

Figure 1:
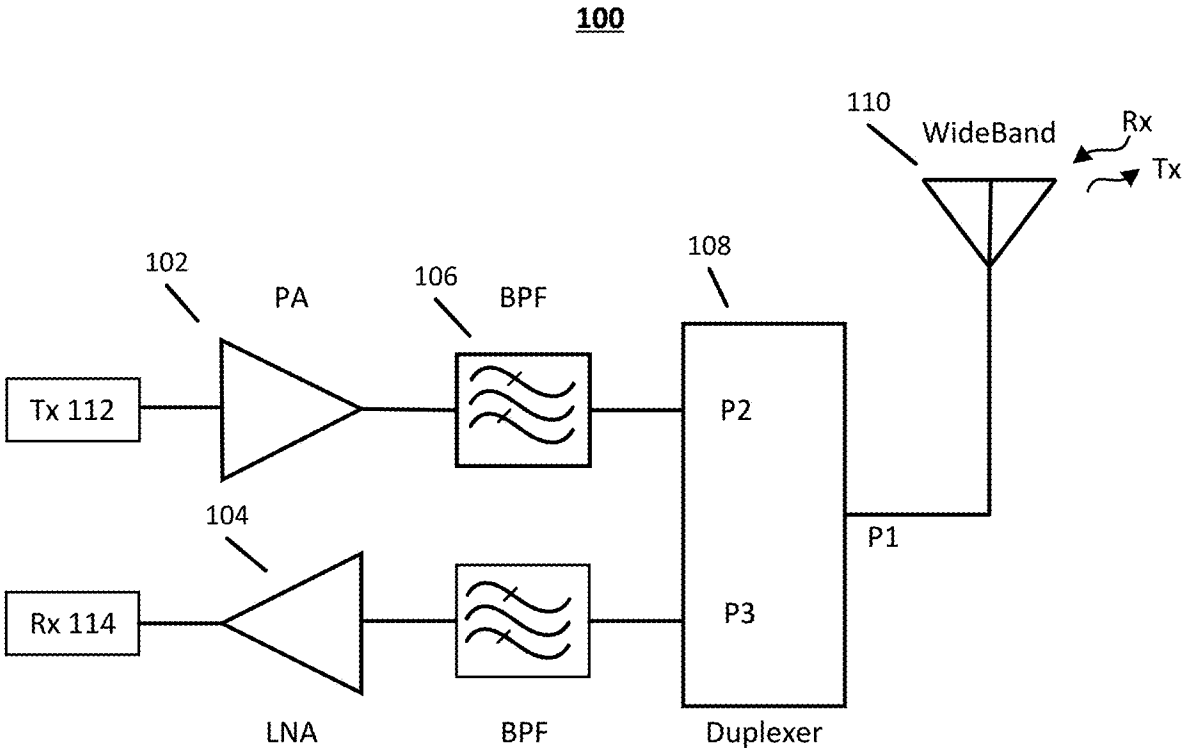
FIG. 1 (Prior Art)
FIG. 1 is a functional diagram depicting frequency division duplexing (FDD)
Figure 2:
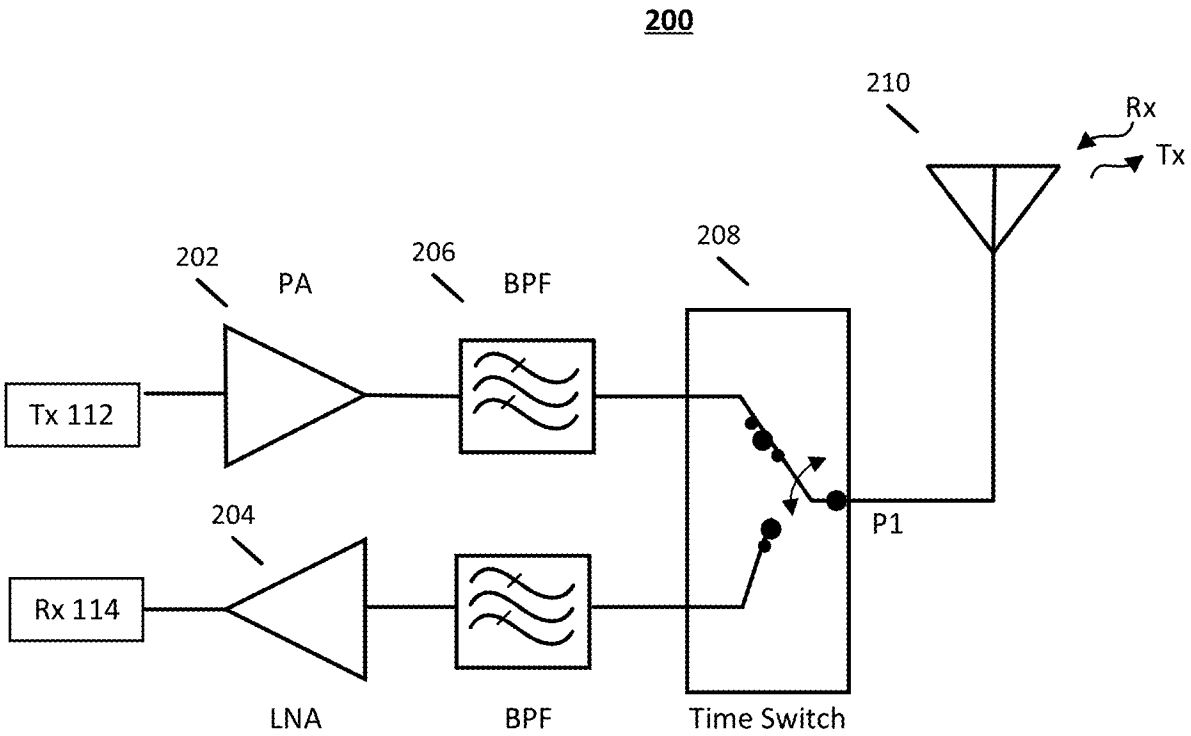
FIG. 2 (Prior Art)
FIG. 2 is a functional diagram depicting time division duplexing (TDD)
Figure 3:
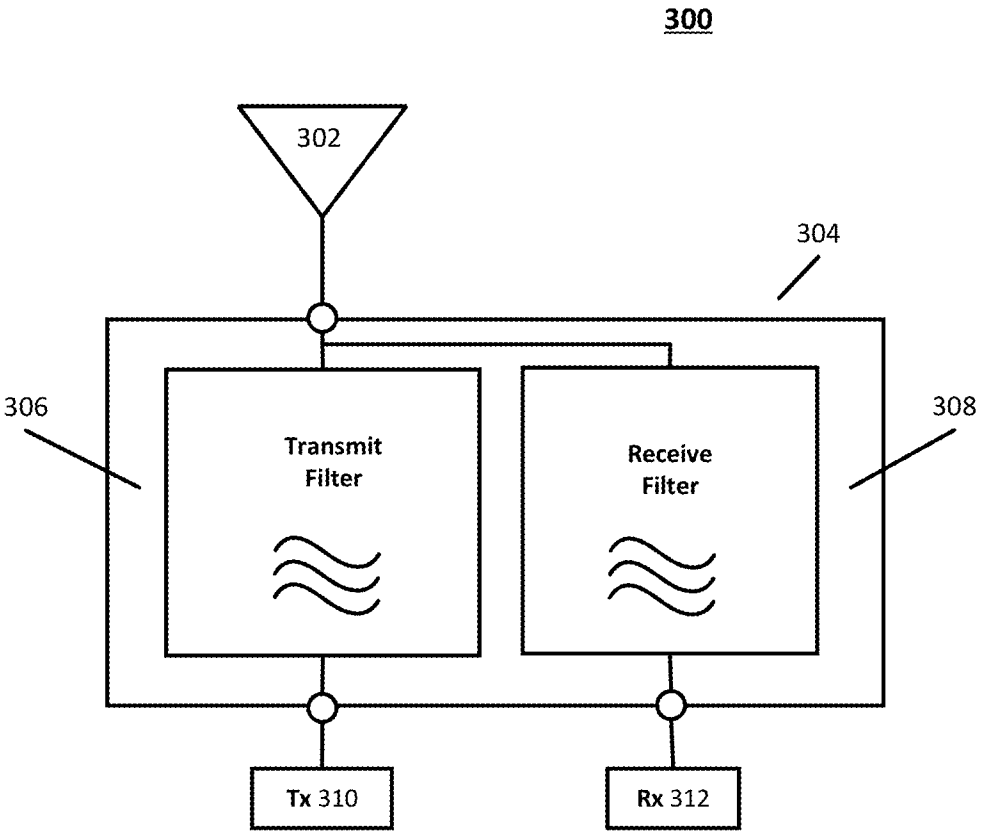
FIG. 3 (Prior Art)
FIG. 3 is a functional diagram depicting the working principle of a basic frequency division duplexer.
Figure 4:
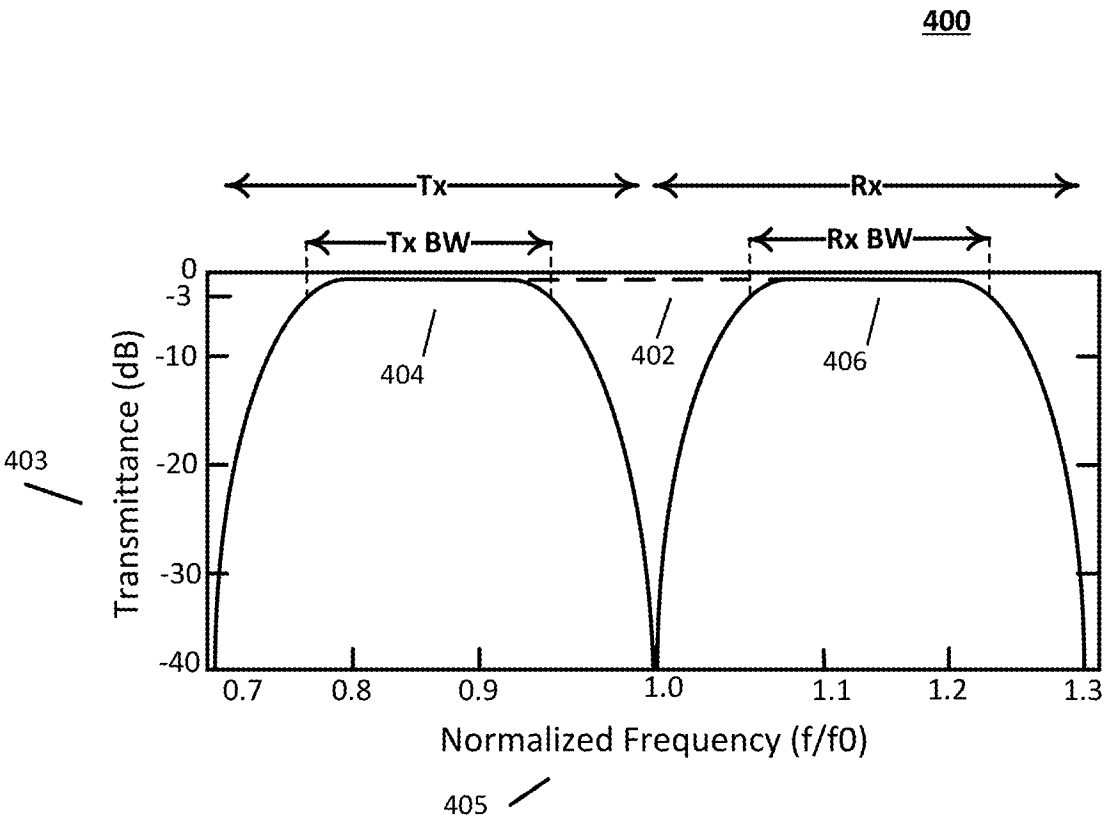
FIG. 4 (Prior Art)
FIG. 4 is a graph depicting the division of a large bandwidth signal into two smaller bands.
Figure 5B:
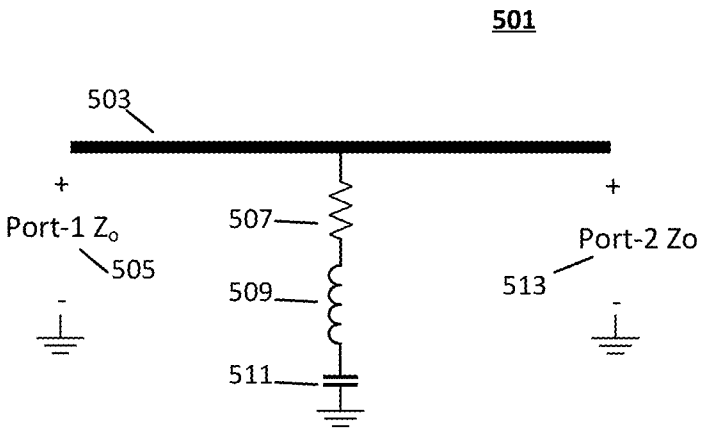
FIG. 5B is a functional diagram depicting an RLC series equivalent model according to aspects of the invention.
Figure 5A:
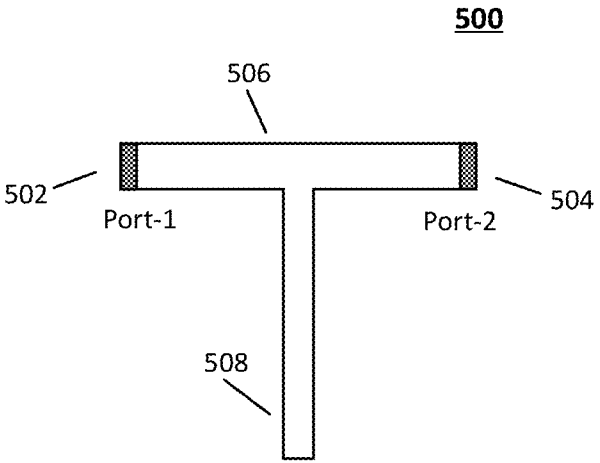
FIG. 5A is a functional diagram depicting an open-circuit single-stub microstrip line resonator according to aspects of the invention.
Figure 6:
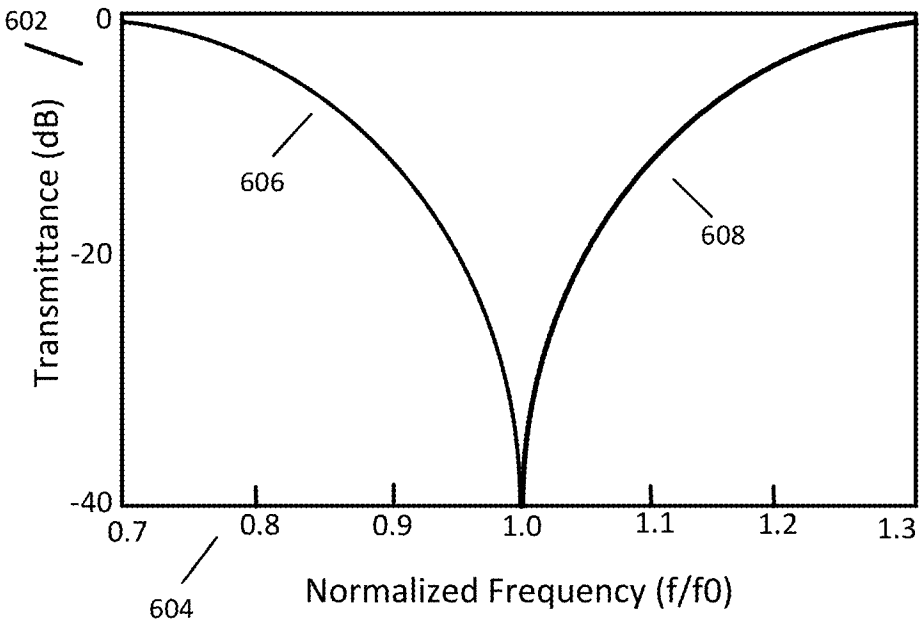
FIG. 6 is a graph depicting the transmittance of an open-circuit single-stub microstrip line resonator according to aspects of the invention.

Microstrip based filters are known for their planar structure and their ability to integrate with other components. The open-circuit microstrip stub 508 in the microstrip line 506 shown in FIG. 5A behaves like a resonator and resonates at a particular resonance frequency that depends on the dimensions and permittivity of the host material. The microstrip stub behaves like RLC series circuit connected between the ground and a microstrip line as shown in the schematic depiction of FIG. 5B. In FIG. 5A, the signal wave at port-1 502 gets absorbed at open circuit stub 508 and due to its strong absorption, a low amplitude signal is received at port-2 504. For other frequencies, the microstrip line 506 transmits as shown in the frequency response graph of FIG. 6 and a strong absorption 608 at the resonance frequency is observed. FIG. 5B shows an equivalent series RLC schematic implementation of the transmission line resonator that was depicted in FIG. 5A. Mathematically, the transmission response can be obtained by applying the microwave Kirchhoff's current equation (Equation 1 below) to the transmission line and stub combination of FIG. 5.

$$S_{21} = \frac{2Z_o}{2AZ_o + \frac{A^2Z_o^2}{B} + B - \frac{Z_o^2}{B}} \qquad \text{Equation 1}$$

The multiple stubs of λ/4 length placed in the near proximity of one another behave differently from their RLC response. Using this unique signature of coupling in the circuit response, a number of innovative designs may be utilized for duplexer technology to make duplexers suitable for 5G/6G mm-wave and Terahertz (THz) applications.

Figure 7B:
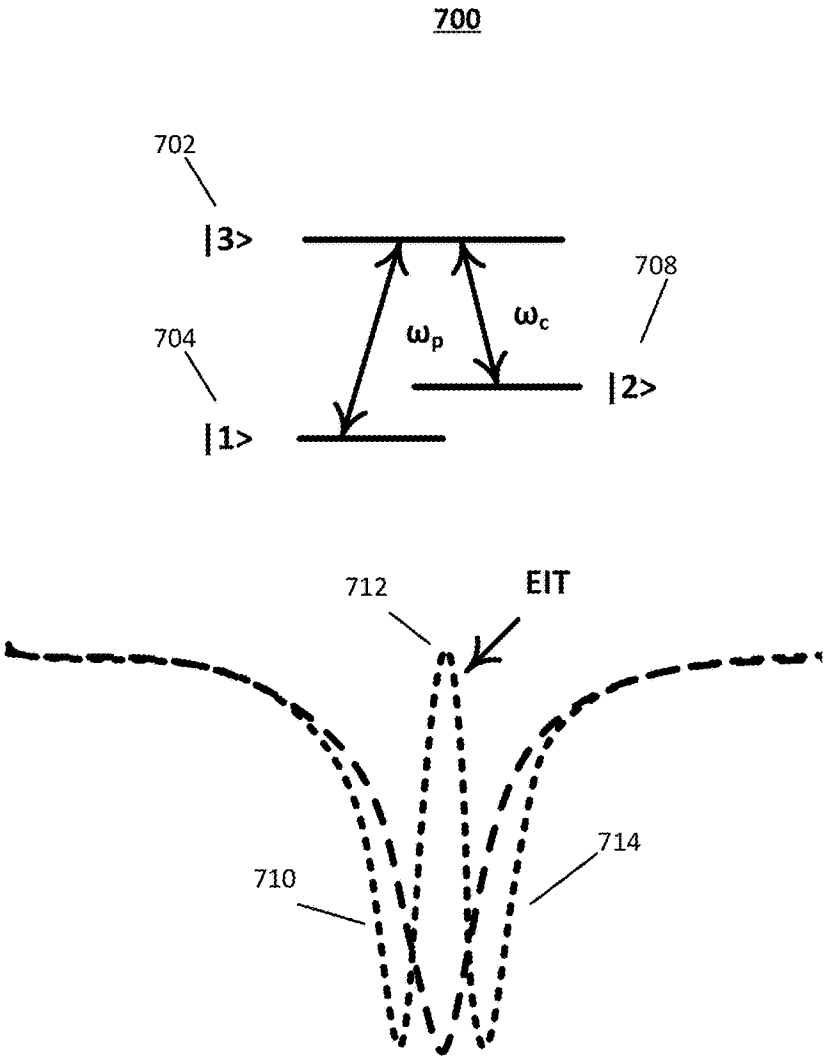
FIGS. 7A and 7B are functional diagrams depicting an the energy state diagram of an Electromagnetically Induced Transparency (EIT) response according to aspects of the invention.
Figure 7A:
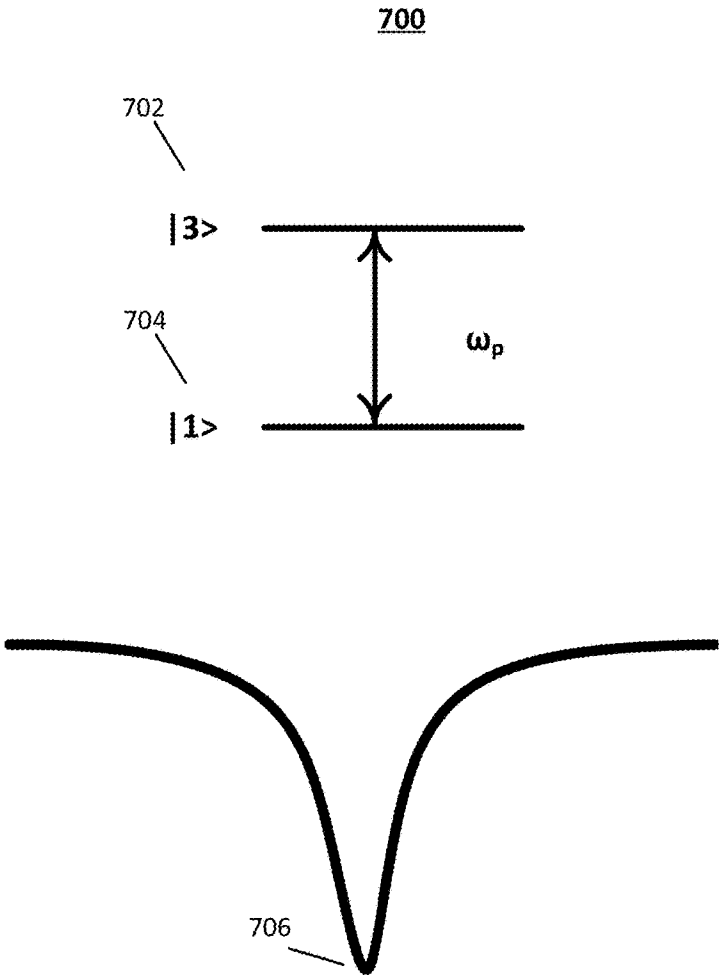

Making a transparency window in the absorption spectrum of the open-circuit stub can be used to design duplexers for 5G Systems. A transparency window within the Lorentz absorption region can be created because of an Electromagnetically Induced Transparency (EIT) response of the transmission line of the duplexer as shown in FIGS. 7A and 7B. The concept of EIT is a well-known quantum phenomenon. The resonators tuned at different frequencies can be used to make a bandpass filter. The class of resonance exhibited by such type of structures is called Electromagnetically Induced Transparency (EIT). As seen in FIG. 7A, a transparency window within the Lorentz absorption region 706 is provided and can also be produced as EIT region 712 as shown in FIG. 7B. The wave interference that leads to EIT requires at least a three-level atomic structure so that two transition pathways connecting the ground to the excited state are available. Consider the A-type atomic structure of FIG. 7B in which two allowed dipole transitions are given by 704 |1>→ 702 |3> and 708 |2>→ 702 |3>. When a probe laser is applied to the resonance of the state transition |1>→|3>, a familiar Lorentzian profile is observed that is marked by an absorption line around the atomic resonance as seen in FIG. 7B. However, if a strong control laser that couples state 708 |2> and 702 |3> is now applied in addition to the probe laser with both frequencies slightly detuned from the resonance line, a destructive quantum interference results in the atoms promoting to the excited state leading to the appearance of the transparency window 712.

Figure 8:
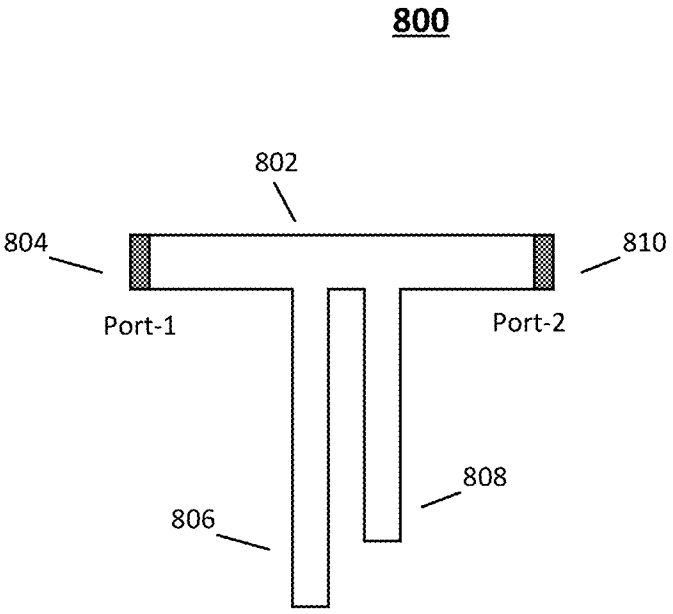
FIG. 8 is a functional diagram depicting a double-stub EIT-based microwave filter according to aspects of the invention.

A double stub bandpass microwave filter 800 is shown in FIG. 8. The stubs 806 and 808 extending from the microstrip 802 behaves as an LC filter and allows the signal to pass at a particular pre-tuned frequency band. The opposite ends of microstrip 802 includes Port 1 804 and Port 2 810, respectively.

Figure 9:
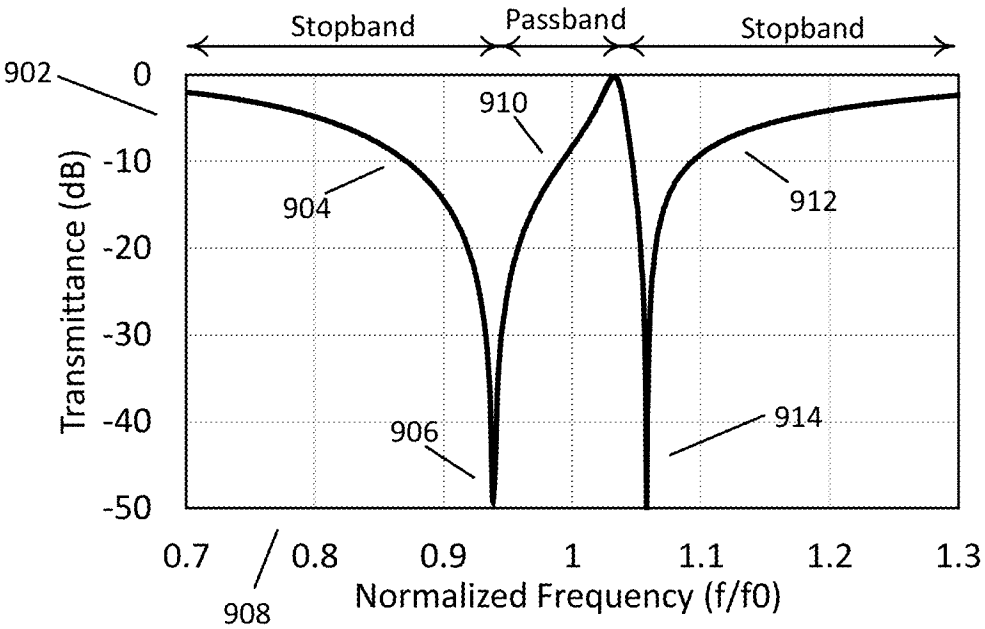
FIG. 9 is a graph depicting a microstrip-based bandpass filter frequency response of an EIT filter according to aspects of the invention.
Figure 10:
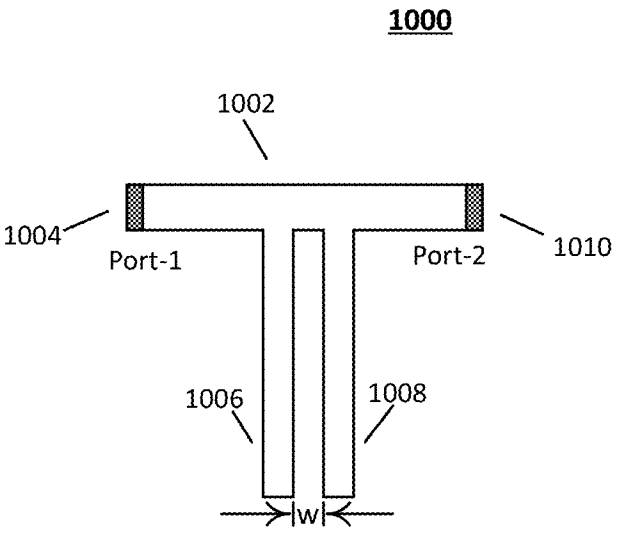
FIG. 10 is a functional diagram depicting a double-stub Fano-based microwave filter according to aspects of the invention.
Figure 11:
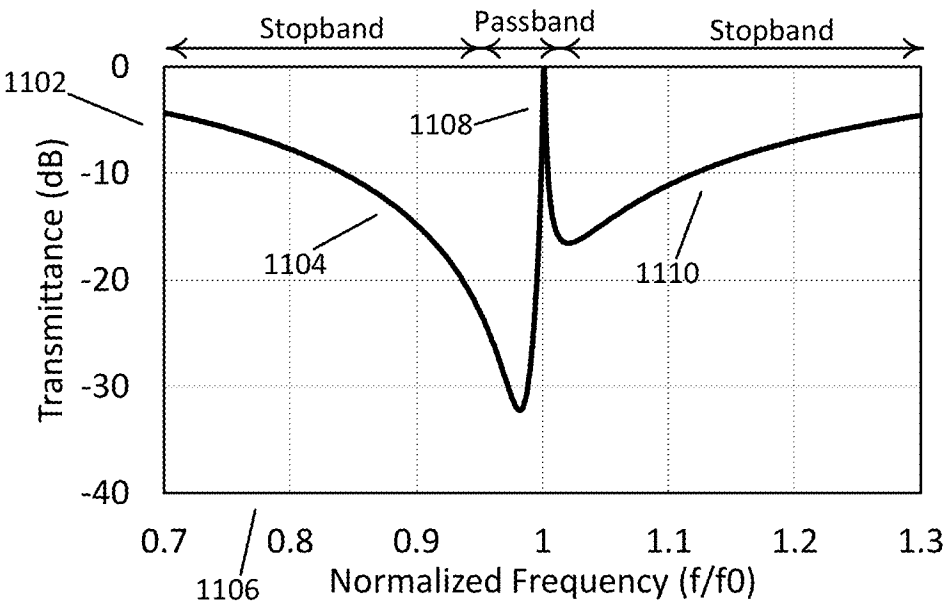
FIG. 11 is a graph depicting a microstrip-based bandpass filter frequency response of a Fano filter according to aspects of the invention.

A frequency response graph 900 for the filter of FIG. 8 is provided in FIG. 9 in which it can be seen that the filter stops the signal at stopbands 904 and 912 and allows the desired signal to pass at passband 910. Such type of filters can be fabricated using traditional CMOS technology. The out-of-band rejection of the EIT filter is poor and limits its use where the number of channels is large like in Massive-MIMO systems. For MIMO on-chip, a special type of EIT called Fano with an asymmetric profile can be used to obtain high selectivity. Such type of resonance is used in photonics and optical sensor design to achieve high selectivity. To achieve the Fano resonance, the double stub EIT filter of FIG. 8 is modified as filter 1000 in FIG. 10 in such a way that both stubs 1006 and 1008 have the same length and therefore resonate at the same frequency. Consequently, a high-quality factor (Q) response is produced. A frequency response graph 1100 for filter 1000 is shown in FIG. 11 in which it can be seen that a normalized Fano resonance with high quality factor (Q) of 700 is achieved. Such type of high Q filters can be used to design duplexers for massive MIMO applications for 5G/6G systems and beyond.

FIGS. 12A through 12F show the nodal currents at three spectral resonance points for a filter having different stub lengths. When stub lengths are different, they change the surface distributions of current. As seen in FIGS. 12A and 12B, when the length of conducting paths 1202, 1204, 1222 become a quarter wavelength, just like the series resonant circuit, the phase of the resonant branch remains equal to that of the input port, and the dominant current flows back to the input port thus creating a transmission dip. Similarly, as shown in FIGS. 12E and 12F when the length of the first stub 1228 is a quarter wavelength, a perfect resonance dip with zero transmission is observed because there is no alternate path other than the virtual short circuit at point 1214. All the currents return to the input through the conducting paths 1216, 1228 and the output 1218 is completely cut-off. FIGS. 12C and 12D shows that at resonance frequency, which is different for both stubs, the current takes the path 1208, 1224, 1212, and 1208, 1226, 1212. Due to EIT, the currents and voltages in the individual stubs lead or lag by quadrature phase; as a result, a phase difference of 180° is created. These two resonances, generated by the stubs of different length, produce an EIT response as shown in FIG. 9.

Figure 13A:
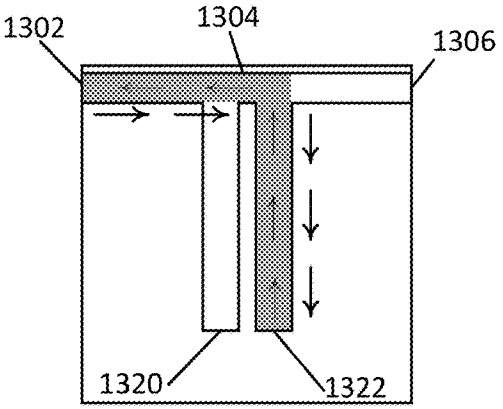
FIG. 13A through 13F are functional diagrams depicting the current magnitude and the phase distributions on the EIT double-stub structure calculated using the transmission line analytical model at three spectral resonance points according to aspects of the invention.
Figure 13B:
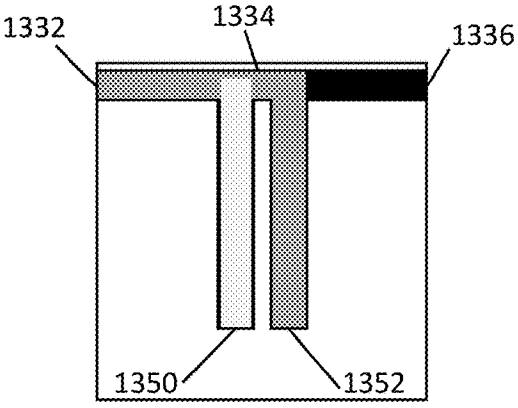
Figure 13C:
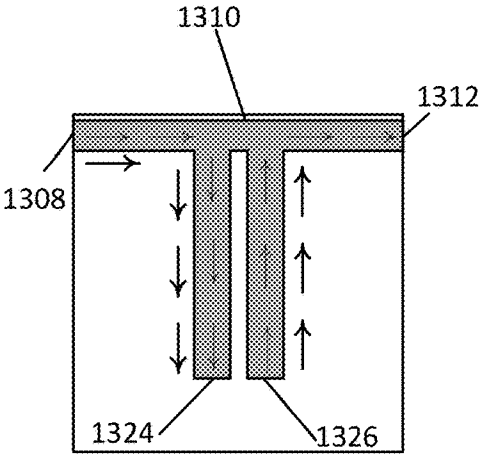
Figure 13D:
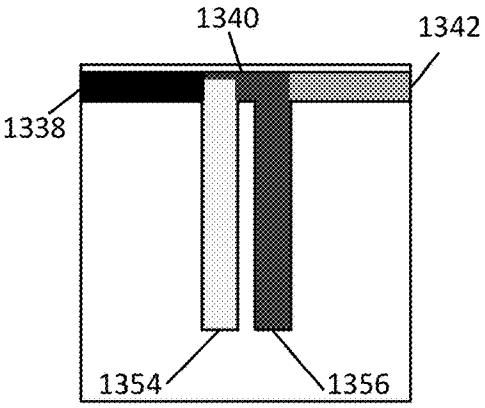
Figure 13E:
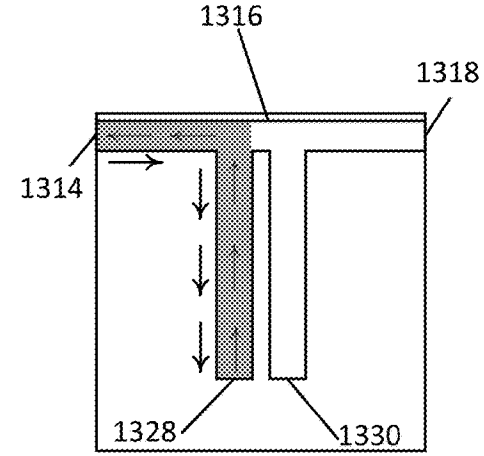
Figure 13F:
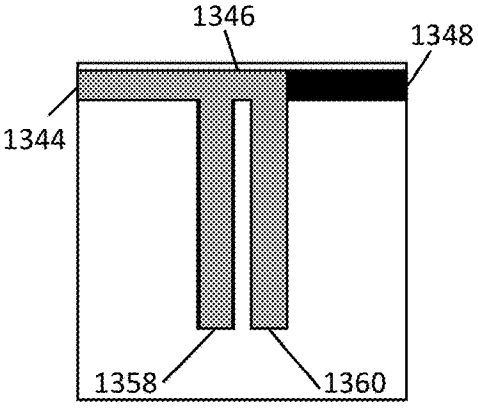

A second arrangement is to make the stub lengths of the filter equal in length and this results in a Fano based design as shown in FIGS. 13A to 13F. As seen in FIGS. 13A and 13B, in the case of Fano, when the length of conducting path 1302, 1304, 1322 becomes close to a quarter wave length, just like the series resonant circuit, the phase of the resonant branch remains equal to that of the input port, and the dominant current flows back to the input port creating a transmission dip. Similarly, as seen in FIGS. 13E and 13F, when the first stub 1314 attains the length of quarter wavelength, all the currents return to the input port through the conducting path 1314, 1328 and the output is completely cut-off. When both stubs interfere destructively to get the essential resonance leading to the electromagnetically induced transparency window, similar to EIT, the currents and voltages in the individual stubs lead or lag by quadrature phase; as a result, phase difference of 180° is created. These two close resonances, generated by the same length stubs, produce a fano response as shown in the frequency response graph 11 of FIG. 11.

To model EIT using the lumped components (discrete R, L and C components), it is important to understand that the EIT windows in a multiple-stub spectral response are the consequence of resonance detuning that results from relative spatial shifts of the open stub locations leading to strong interference effects. To represent the detuning effect, the stubs can be replaced by lumped components, as shown in FIG. 5B for the two-stub configuration. The transmittance spectra, such as shown in FIG. 9 can be fitted with the RLC resonator transmission response to subsequently extract the RLC lumped element values.

Figure 14:
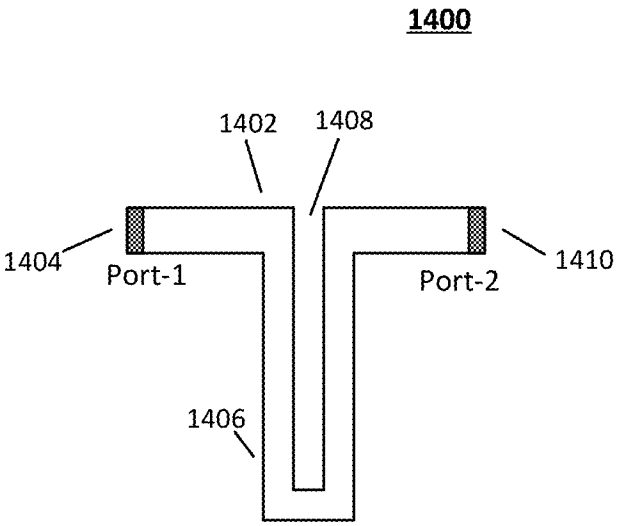
FIG. 14 is a functional diagram depicting a U-Shaped Lorentzian microstrip filter according to aspects of the invention.
Figure 15:
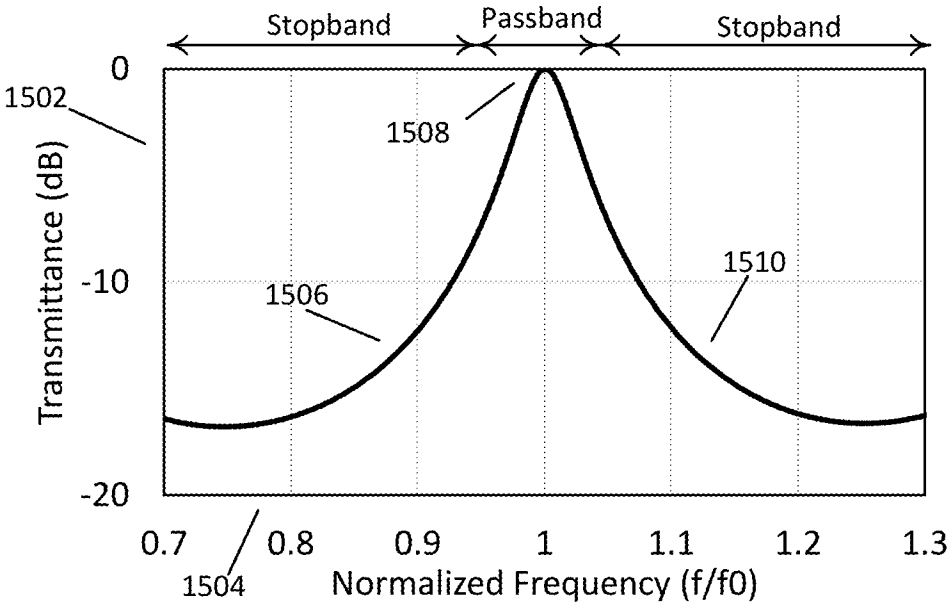
FIG. 15 is a graph depicting a U-Shape Lorentz microstrip filter normalized transmittance response according to aspects of the invention.

A third arrangement is also possible that results in a classical Lorentzian resonance as shown in filter 1400 of FIG. 14. Both ends of the microstrip stubs are joined at end 1406 in such a way that they make a U-shaped structure and as a result a gap 1408 is created in microstrip 1402. The phenomenon of resonance for such a filter 1400 changes from EIT to Lorentz as shown in the frequency response graph 1500 of FIG. 15. The response offers good stopbands 1506 and 1510. The peak 1508 is not as sharp as compared to 1108 of FIG. 11. The Q factor of Lorentz-based resonance is relatively small as compare to Fano resonance.

Figure 16:
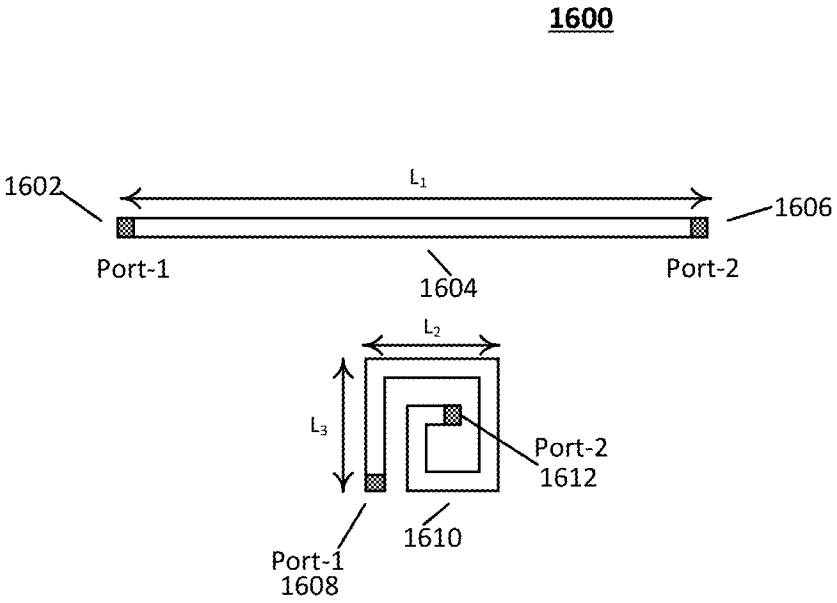
FIG. 16 is a functional diagram depicting a straight and a spiral arrangement of a microstrip line Lorentzian resonator according to aspects of the invention.

FIG. 16 shows a simple microstrip structure 1604 with a length Li. The advantage of a Lorentz structure over Fano and EIT structures is that it can be bent into a spiral shape 1610 as shown in FIG. 16. The spiral-shaped structure 1610 reduces the size of the resonator depending on the number of turns. For N number of turns, the size is reduced by approximately N/4.

Figure 17:
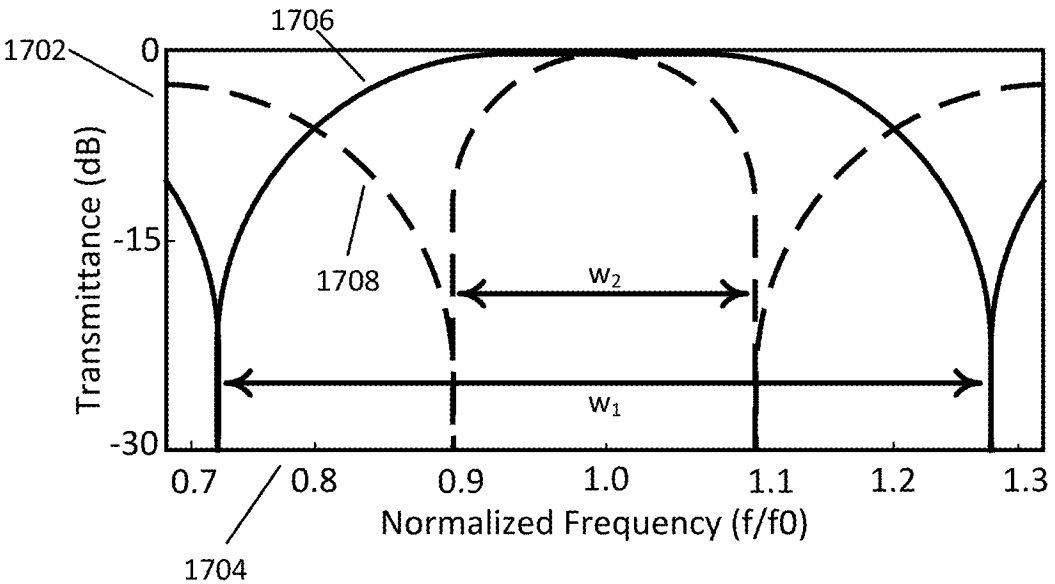
FIG. 17 is a graph depicting the increase in the bandwidth of an EIT filter according to aspects of the invention.
Figure 18:
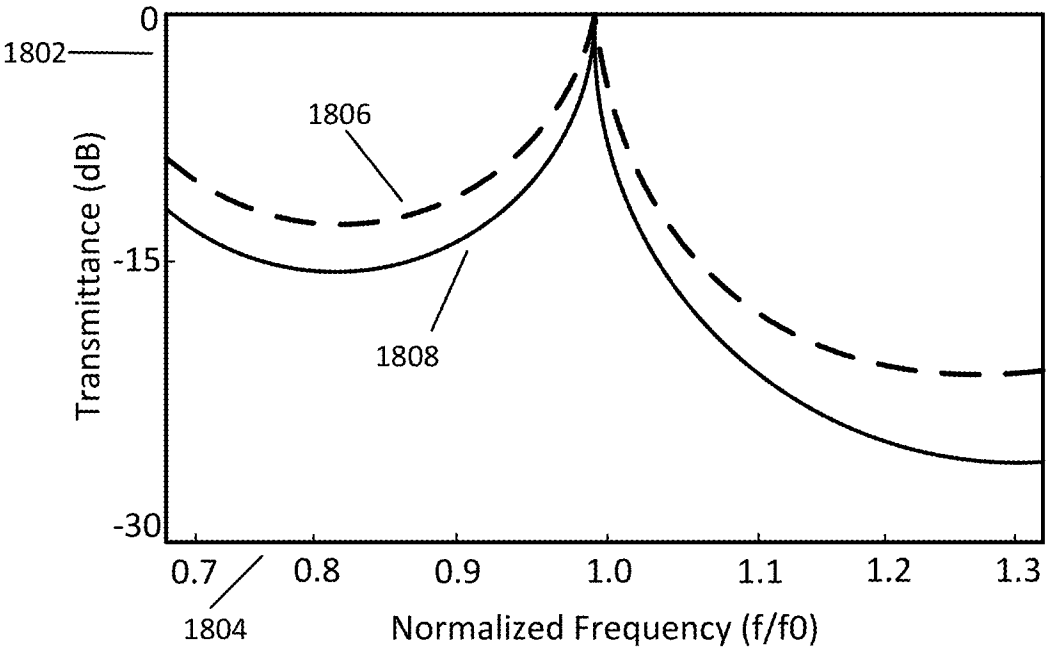
FIG. 18 is a graph depicting the increase in the bandwidth of a Fano filter according to aspects of the invention.
Figure 19:
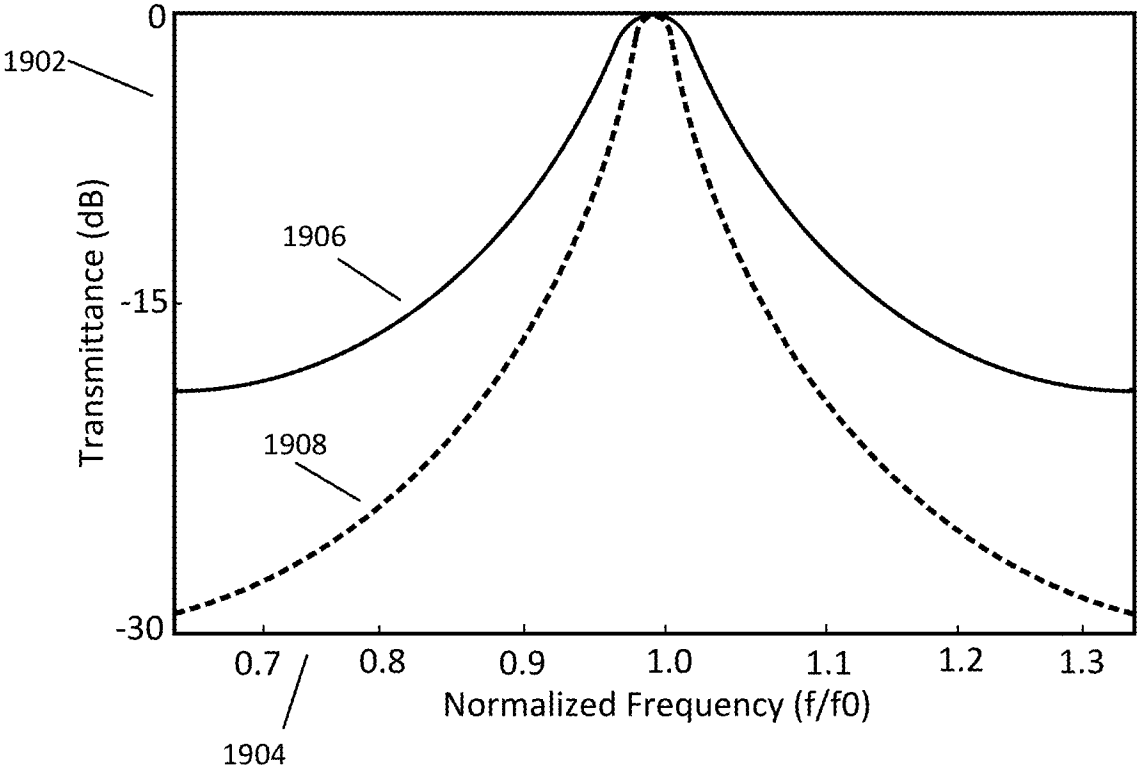
FIG. 19 is a graph depicting the variation in the bandwidth of a Lorentzian-type filter according to aspects of the invention.

To a certain limit, the quality factor of all three resonances (EIT, Fano and Lorentz) can be controlled by making minor changes in the geometry of the stubs, such as changes in length, width, or spacing between the stubs. EIT offers the maximum bandwidth. The bandwidth of an EIT filter can be controlled by changing the difference in the lengths of the open-circuit stubs, such as stubs 806 and 808 of FIG. 8. If the difference in the lengths is large, the absorption frequency of both stubs will be far from each other and hence response with larger bandwidth will be achieved as shown in the frequency response graph 1700 of FIG. 17. The bandwidth of the curve 1706 is much larger than the bandwidth of the curve 1708. This shows that the bandwidth can be controlled by just changing the length of the open stubs, such as stubs 806 and 808 of FIG. 8. Similarly, the bandwidth of the Fano-filters can be changed by changing the distance w between the stubs, such as stubs 1006 and 1008 of FIG. 10. The frequency response graph 1700 for such a filter is shown in FIG. 18 in which it can be seen that the bandwidth of 1808 is much smaller than the bandwidth of 1806 which means that the selectivity of Fano-based resonating filters is highly dependent on the distance w between the open stubs in the microstrip. This happens because of the increase in the intensity of the electric field originating from the stubs' side walls facing each other. These electric field lines become concentrated and the interaction becomes more pronounced with the decrease in the distance between the open-circuit stubs.

The bandwidth of the Lorentzian filters is also controllable, but contrary to the EIT and Fano filters, the bandwidth is controlled in the Lorentzian filters by the width of the microstrip line. A narrow microstrip line produces frequency curves with low-quality factor and a wide microstrip line gives resonance with a high Q. This happens because as the microstrip mimics an RLC series resonator and when the resistance is increased the Q-Factor decreases as given by Equation 2 below, $$Q = \frac{\omega_0 L}{R} \qquad \text{Equation 2}$$

Where the L is the inductance and R represent the resistance of the RLC equivalent of the microstrip. The resistance of narrow microstrip is higher than the resistance of the wide microstrip. The microstrip model gives a clear insight into the design parameters, $$Q = \frac{\pi}{2\alpha L}$$

where the attenuation coefficient, $\alpha$ is:

$$\alpha = \alpha_c + \alpha_d \qquad \text{Equation 3}$$

Here, $\alpha_c$ is the attenuation coefficient due to conductor losses and $\alpha_d$ is the attenuation coefficient due to dielectric losses. In summary, the bandwidth of all three filters types (EIT, Fano, and Lorentz) can be changed with changes in certain dimensions of the design structure. This attribute of these designs makes them suitable for different bands and bandwidths of mm-wave 5G/6G and THz applications.

All three filters discussed above can be potentially used to make planar high-frequency duplexers for 5G/6G applications and beyond. One duplexer arrangement is shown as a T-shape duplexer 2000 in FIG. 20 in which two bandpass filters BPFs 2020 and 2024 are used to achieve the duplexing action. Both filters 2020 and 2024 are tuned to resonate at different frequencies so that band selection and good isolation can be achieved. One port 2022 (Port-1) of the duplexer 2000 will be attached to the antenna and other ports 2012 (Port-2) and 2014 (Port-3) will be attached to the transmitter and the receiver, respectively. The general behavior of the T-shape duplexer 2000 is shown in the frequency response graph 2100 of FIG. 21. The high isolation between both BPFs 2020 and 2024 is a key requirement in achieving the duplexing action. The T-shape of the duplexer not only reduces the overall size but also helps to implement the duplexer on the single layer of a CMOS IC stack making it a planer structure. The duplexer divides the input signal 2026 into two signals, one at a high frequency 2006 and the other at a low frequency 2002 due to the BPF 2020 and 2024. The duplexer design is suitable for 5G/6G and THz applications as it can be easily manufactured using standard CMOS IC technology.

Figure 22C:
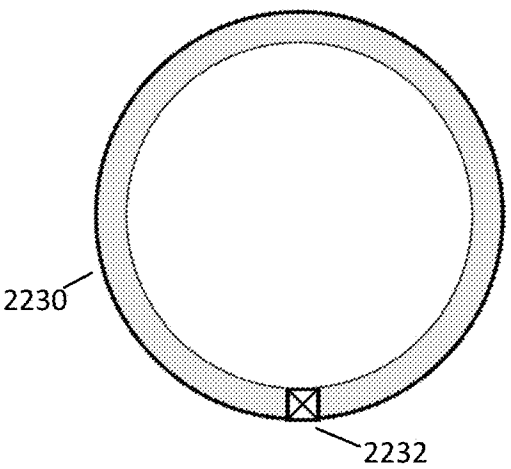
FIG. 22C is a functional diagram depicting a top view of an IC having a ring shaped Antenna on Chip (AoC) that that can be connected to a duplexer through multiple vias according to aspects of the invention.
Figure 22B:
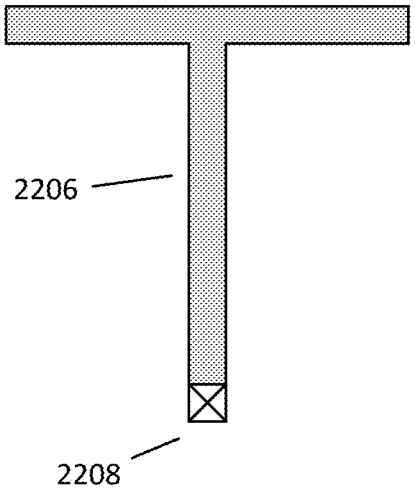
FIG. 22B is a functional diagram depicting a top view of an IC having a T-shaped Antenna on Chip (AoC) that that can be connected to a duplexer through multiple vias according to aspects of the invention.
Figure 22A:
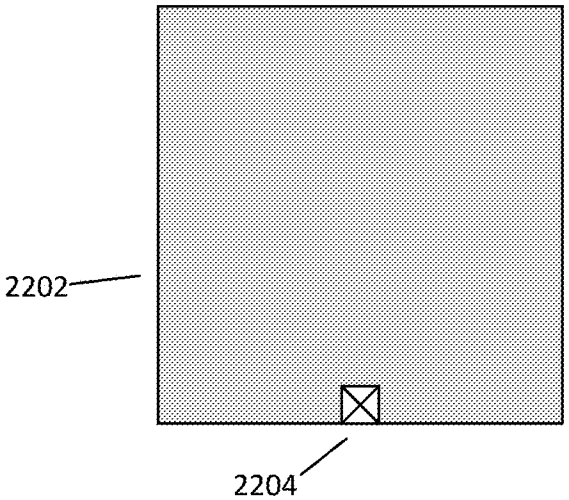
FIG. 22A is a functional diagram depicting a top view of an IC having a square shaped Antenna on Chip (AoC) that can be connected to a duplexer through multiple via according to aspects of the invention.
Figure 23:
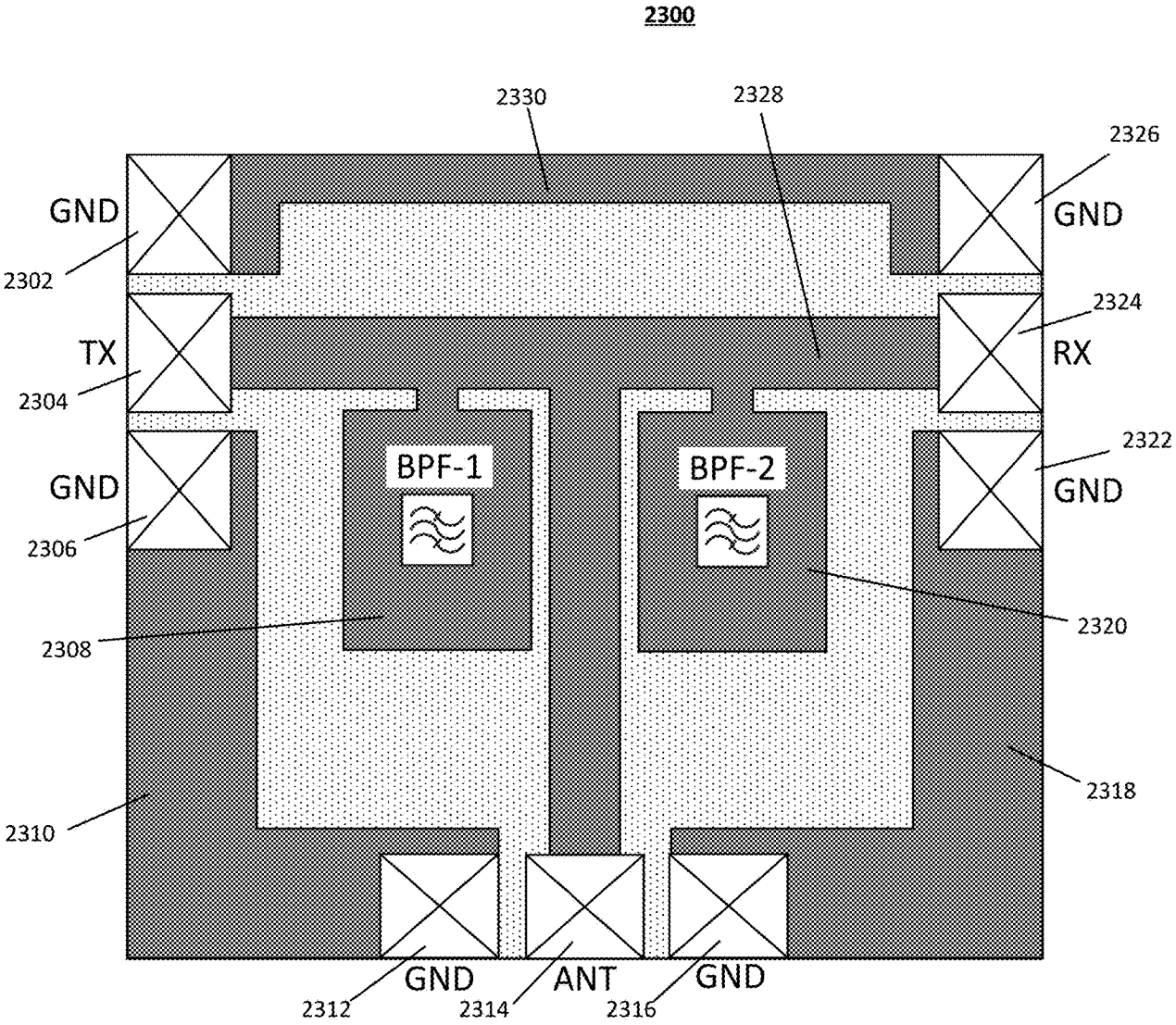
FIG. 23 is a functional diagram depicting a top view of the second metallic layer of an IC according to aspects of the invention.

The top views of an IC containing different on-chip antennas (square-shaped, T-shaped, and ring-shaped) are shown in FIGS. 22A to 22C. The Antenna on Chip (AoC) will be positioned at the top thick metal layer of the IC metal layer stack. The antennas could be patch, dipole, monopole, bowtie, slot or any other type. The square-shaped AoC 2202 will be fed by the port-3 (2204) of the duplexer (in case of the simple patch). An array of the multiple vias will connect the duplexer to the transmitter and receiver transistors built in the epitaxial layer of the silicon substrate of the chip. The second layer of the IC metal layer stack containing the duplexer is shown in FIG. 23. As seen in FIG. 23, the ground patches 2302, 2306, 2312, 2316, 2322, and 2326 help to improve the isolation and to reduce the substrate coupling and also the radiation losses from the edges of the microstrip.

Figure 24:
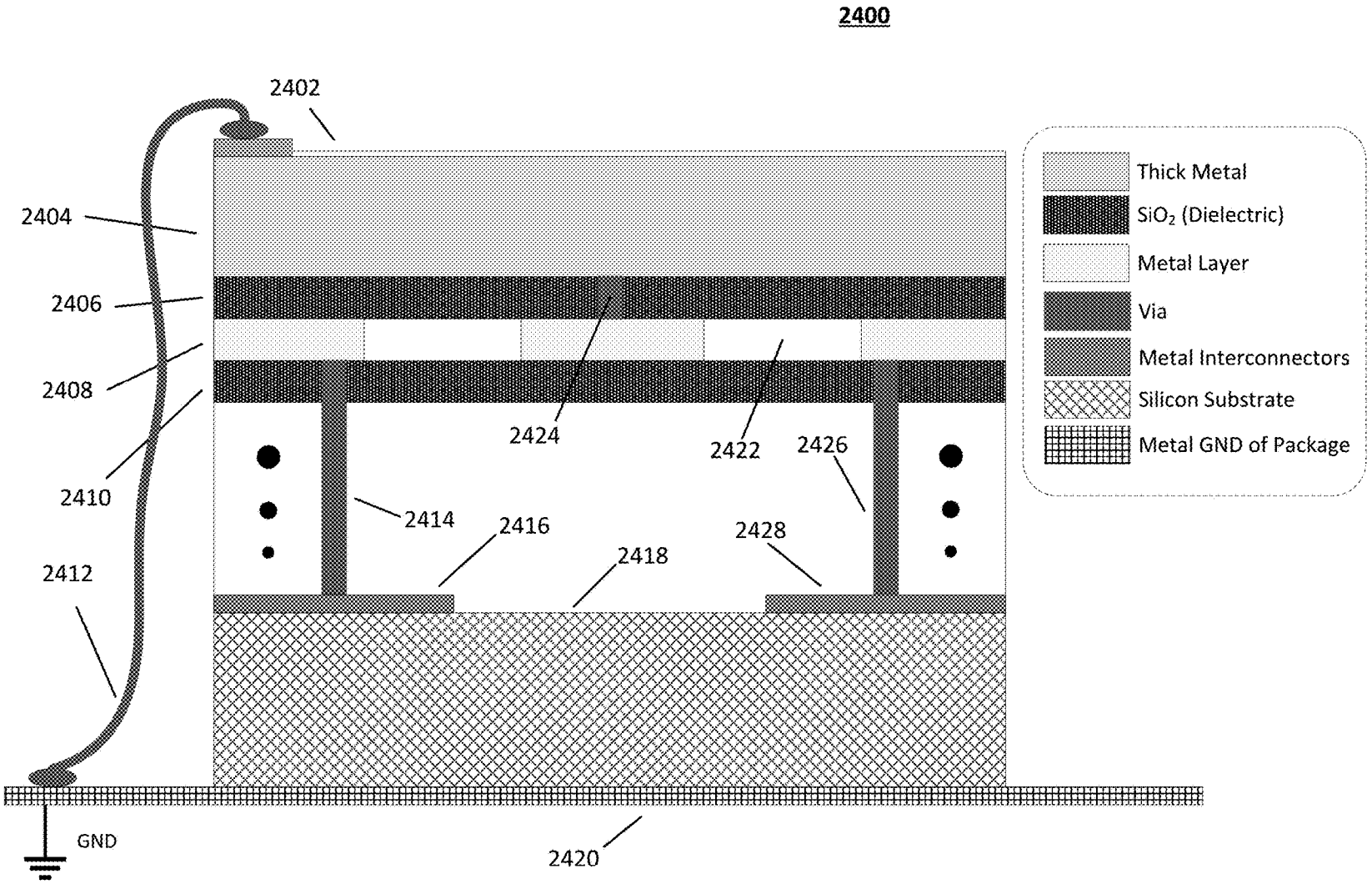
FIG. 24 is a functional diagram depicting a cross-sectional side view of an IC stack according to aspects of the invention.

One typical cross-sectional view of the chip (IC stack) is shown in FIG. 24 as an example to set the stage for the description of the placement of the duplexers in the IC metal layer stack. In case of bare die mounting, the package on which the belly of the IC may be placed is a ground plane layer 2420 of the package or the PCB. The ground layer 2420 is connected through the external bond wires 2412. The thick substrate 2418 is positioned at the bottom above the thin ground layer 2420 of the package or PCB. The conductor layers are connected through vias 2414, 2424 and 2426 to the transmitter and receiver at the bottom of the IC. The top thick metallic layer 2402 can be used for AoC. This type of IC stack can host a large number of single or even multilayered duplexer structures.

Figure 25:
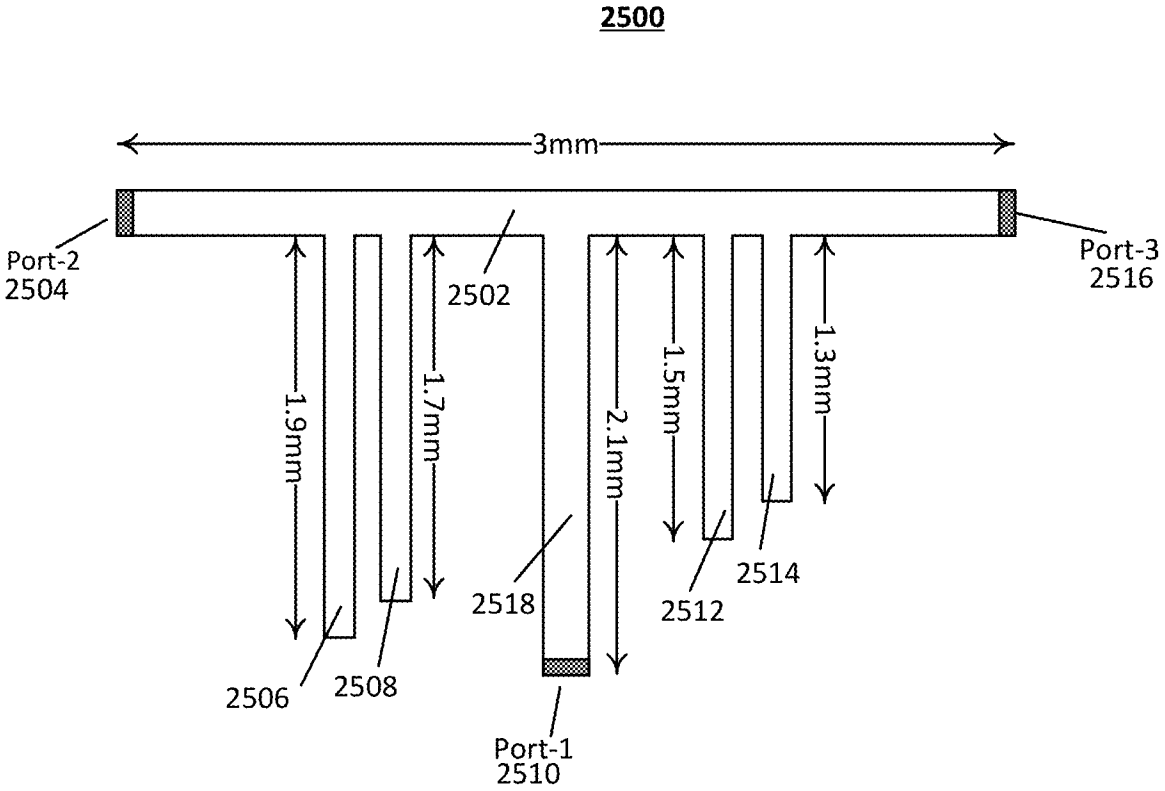
FIG. 25 is a functional diagram depicting an EIT filter based T-shaped duplexer having the exact dimensions for 28-32 GHz mm-wave band according to aspects of the invention.
Figure 26:
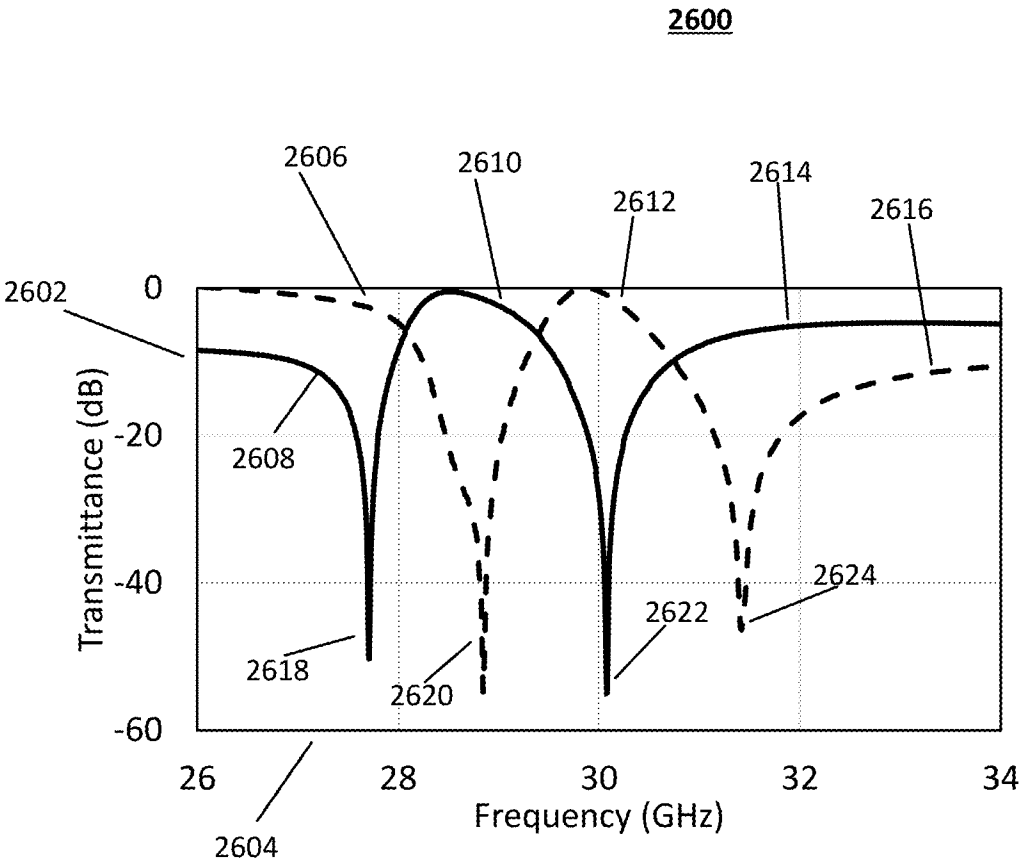
FIG. 26 is a graph depicting a frequency response of an EIT filter based T-shaped duplexer according to aspects of the invention.

A T-shaped EIT-based planar duplexer 2500 is shown in FIG. 25 according to aspects of the invention. The overall size may be 3×2.1 $mm^2$ at sub 6 GHz frequencies, for example. The duplexer 2500 consists of two EIT filters tuned at different frequencies: the first filter is comprised of stubs 2506 and 2508, and the second filter is comprised of stubs 2512 and 2514. The length of stub 2506 is 1.9 mm, stub 2508 is 1.7 mm, stub 2512 is 1.5 mm and stub 2514 is 1.3 mm. The width of stubs 2506, 2508 is 0.05 mm and the width of stubs 2512 and 2514 is 0.06 mm. The width of microstrip 2502 and 2518 is 0.12 mm. The filter with a larger length (2506, 2508) resonates at relatively lower frequency ranges, and the filter with a shorter length (2512, 2514) resonates at relatively higher frequency ranges. The duplexer action of duplexer 2500 is shown in the frequency response graph 2600 of FIG. 26 which shows passbands 2610 and 2612 and stopbands 2618, 2620, 2622, and 2624. As discussed before, a typical EIT-based filter generally offers inferior out of the band rejection. These EIT-based filter types of duplexers are feasible for the application where the selectivity and out-of-band rejection requirements are relaxed, such as in massive MIMO configurations requiring a large bandwidth.

Figure 27:
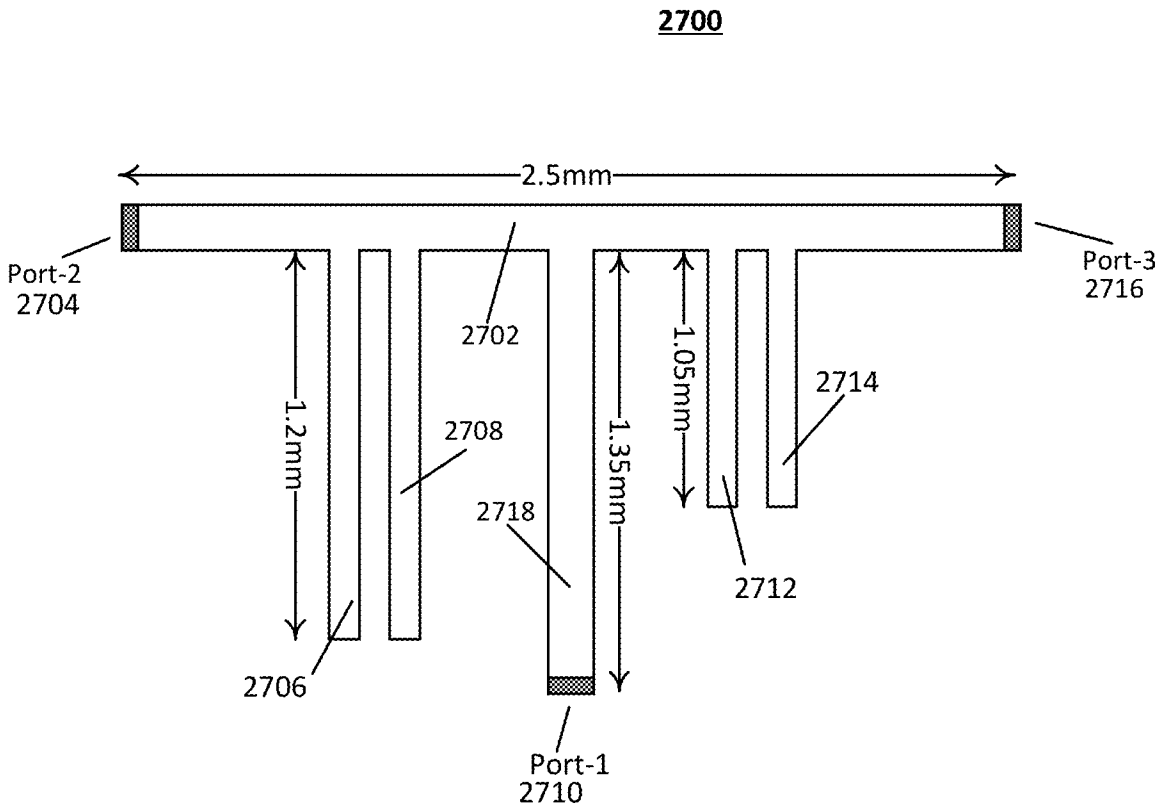
FIG. 27 is a functional diagram depicting a Fano filter based T-shaped duplexer according to aspects of the invention.
Figure 28:
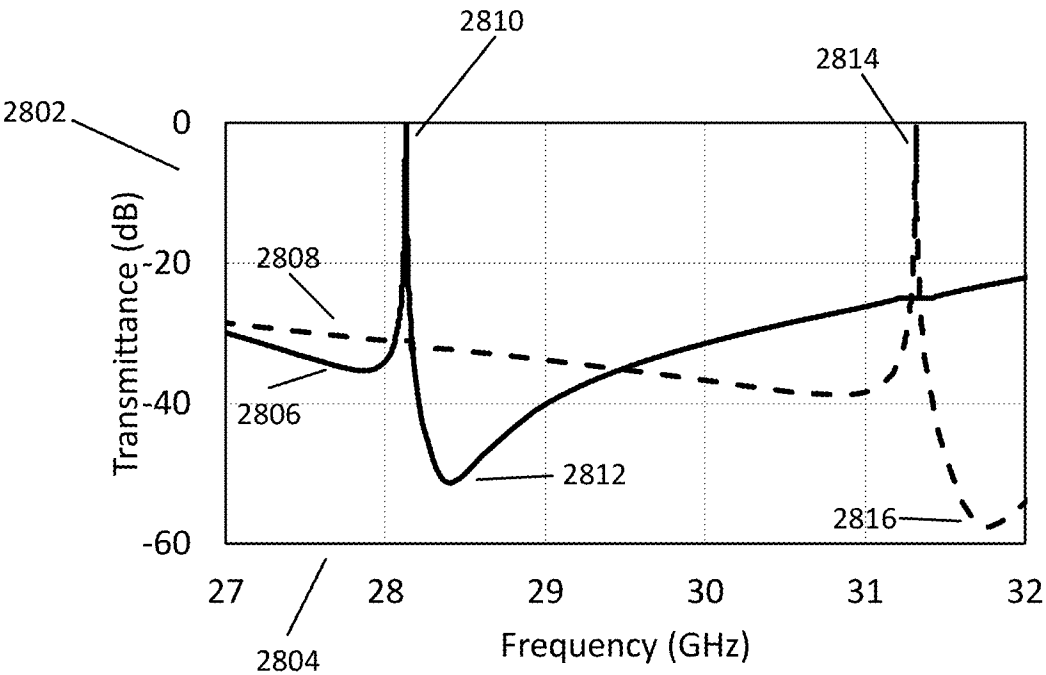
FIG. 28 is a graph depicting a frequency response of a Fano filter based T-shaped duplexer according to aspects of the invention.

For massive MIMO configurations with a small channel bandwidth, high selectivity is the primary requirement and hence Fano-based filters are one of the potential candidates in such a scenario. A Fano-based duplexer 2700 is shown in FIG. 27. In contrast to the EIT-based duplexer, both open stubs of the first filter (2706, 2708) and of the second filter (2712, 2714) of Fano-based duplexer 2700 are of the same length. The length of stubs 2706 and 2708 is 1.2 mm; while stubs 2712 and 2714 are of 1.05 mm in length. The width of all of the open stubs of Fano-based duplexer 2700 is 0.05 mm. The width of stubs 2702 and 2718 is 0.12 mm. The frequency response of the T-shaped Fano filters of Fano-based duplexer 2700 is shown in the frequency response graph 2800 of FIG. 28 which shows passbands 2810 and 2814 having a high-quality factor and also shows stopbands 2806, 2808, 2812, and 2816.

Figure 29A:
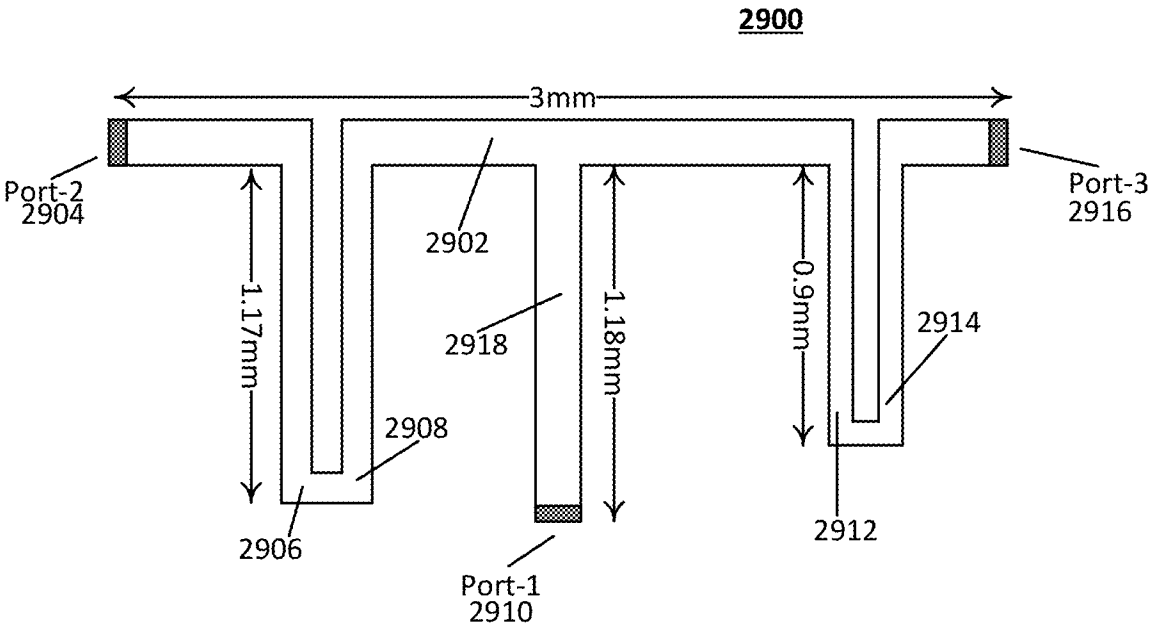
FIG. 29A is a functional diagram depicting a U-shaped Lorentzian filter-based duplexer according to aspects of the invention.
Figure 29B:
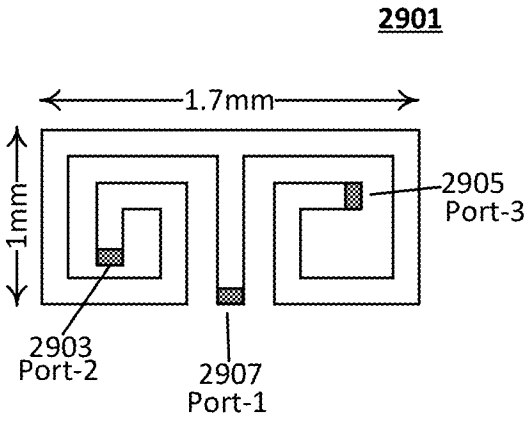
FIG. 29B is a functional diagram depicting a spiral-shaped Lorentzian filter-based duplexer according to aspects of the invention.
Figure 30:
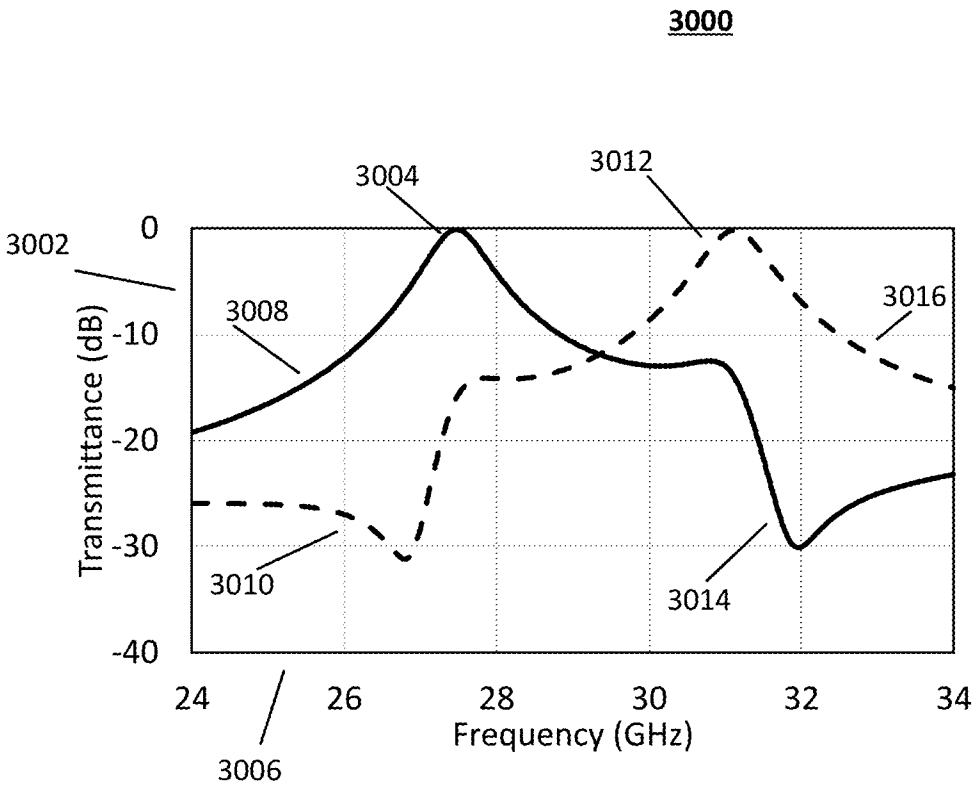
FIG. 30 is a graph depicting a frequency response of a U-shaped filter-based duplexer according to aspects of the invention.

Similarly, Lorentzian filters can also be deployed in a T-shaped duplexer as shown in duplexer 2900 of FIG. 29A. The pair of open stubs 2906 and 2908, and the pair of open stubs 2912 and 2914 are short-circuited in such a way that they each mimic a U-shape structure. The width of microstrip 2902 and 2918 is 0.21 mm and the width of stubs 2908 and 2914 is 0.1 mm. The overall length of microstrip 2902 is 3 mm. The frequency response of duplexer 2900 is shown in the frequency response graph 3000 of FIG. 30 which shows passbands 3004 and 3012 and stopbands 3010 and 3014. The Lorentzian-based duplexers offer significant advantages over the EIT and Fano based duplexers because the Lorentzian-based duplexers provide good isolation and the U-shaped duplexer can also be changed to a spiral shape to decrease the size of the duplexer as shown in FIG. 29B. Based on the above presented results, one can see the trade-off between different designs. For high selectivity, Fano-based filters are suitable; while for large bandwidth, EIT-based filters are recommended; and for high out-of-band rejection the Lorentzian-based filters appear to be the best choice.

Figure 31:
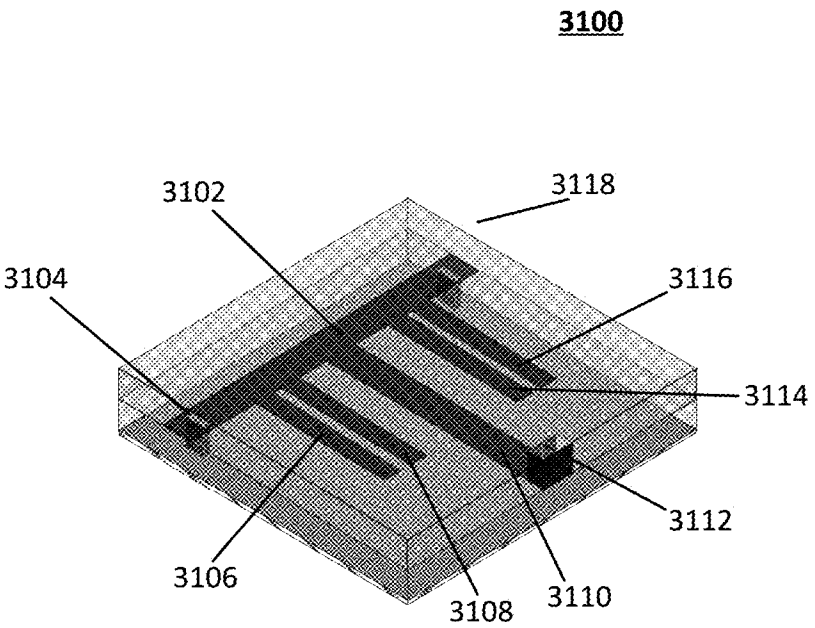
FIG. 31 is a functional diagram depicting a 3D view of a T-shaped duplexer showing the top thick metal layer of the IC stack according to aspects of the invention.

A 3D view of a T-shaped duplexer is shown in FIG. 31 in which vias 3104, 3118 connect the duplexer to the transmitter and the receiver that are fabricated in the epitaxial layer of the substrate. The array of the vias 3112 connects the port to the antenna at the top layer of the IC stack. In CMOS and other types of IC technologies vias are made up of tungsten (W) or other known materials that have a high resistivity. Therefore, multiple vias in parallel may be used to reduce the effective resistance.

As discussed above, the stub size is close to $\lambda/4$ in the stub-based T-type duplexers. In lower mm-wave band (28-32 GHz) the size of the stub is in the order of mm, which is large for the MMIMO system where one has to integrate a large number of the duplexers on a single chip. Such type of duplexers are therefore good candidates for the upper mm-wave frequencies (>50 GHz) or THz frequencies.

Aggressive CMOS scaling and development in both analog and digital domains have brought the implementation of massive MIMO systems close to the reality. A 5G/6G design typically has components like an antenna, a duplexer, a time switch, filters, a mixed-signal ADC/DAC and a baseband processor provided on the same chip. Using the available metal layers stack in a non-traditional sense to realize some of the above-mentioned components like the antenna, the duplexers, and the time switches can make the system efficient in power, speed and area.

The quality factor and width of the microstrips used to design the passive components depend on the thickness of the CMOS metal stack and resistivity of the substrate. It is recommended to use a high resistivity substrate to not only reduce the resistive losses in passive on-chip structures but also increase the radiation efficiency of the on-chip antennas. However, in the standard bulk CMOS process, the resistivity of the substrate is optimized to reduce the possibility of the latch-up in the CMOS transistors.

In mm-wave duplexers, resonators with a high-quality factor are preferred to reduce the insertion loss. Therefore, thin substrates are more suitable in mm-wave resonators. The thin substrate with a controlled resistivity makes it possible to design narrow microstrip structures with the same intrinsic impedances. As discussed earlier, a MMIMO chip might have 4 to 512 antennas, thus the same number of duplexers will be needed. Most commonly used on-chip antennas are planar monopole, patch, dipole, loop and Yagi-Uda antennas as shown in FIGS. 22A to 22C. For the on-chip antenna arrays, the microstrip patch antennas are most commonly used. The planar nature and compact size make patch antenna make them a suitable candidate for on-chip antenna arrays. Each antenna will have a dedicated duplexer for communication with a receiver and a transmitter.

Figure 32:
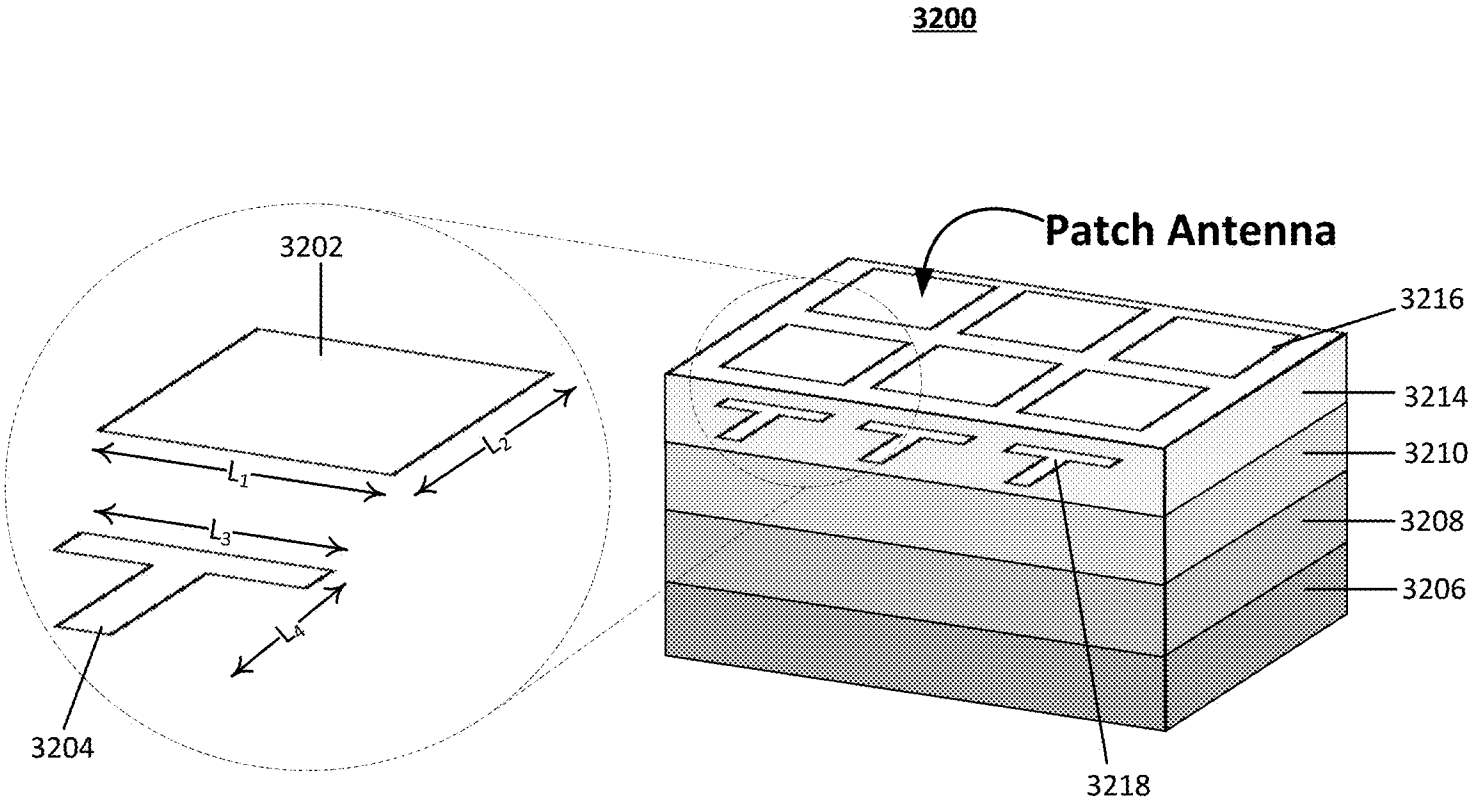
FIG. 32 is a functional diagram depicting an on-chip antenna connected with duplexers wherein the size of the duplexer is equal to or smaller than the size of the antenna according to aspects of the invention.

The dimension of a patch antenna at 28 GHz with a dielectric $SiO_2$ permittivity of 4 is approximately $3\times2$ $mm^2$. Ideally, the size of the duplexer should be equal to or less than the size of the antenna on the top metal layer of the chip as shown by the comparison of patch antenna 3202 to duplexer 3204 in the IC stack of FIG. 32.

Figure 33:
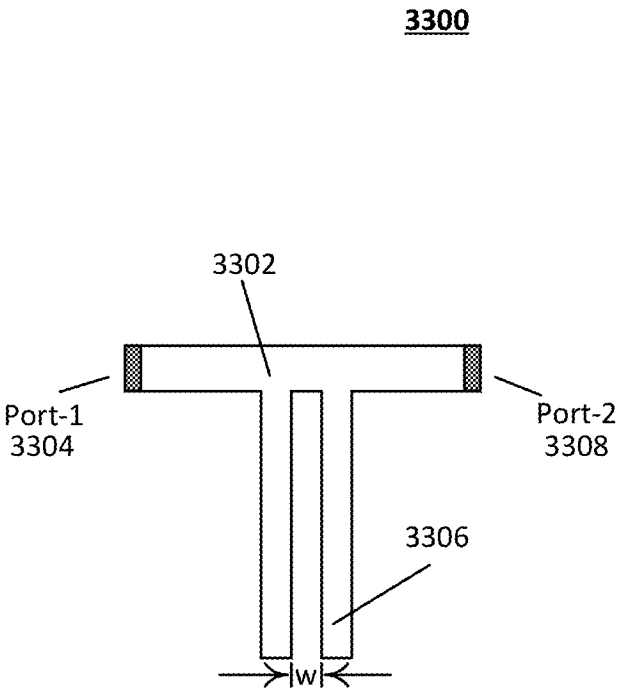
FIG. 33 is a functional diagram depicting a duplexer having a scalable size according to aspects of the invention.
Figure 34:
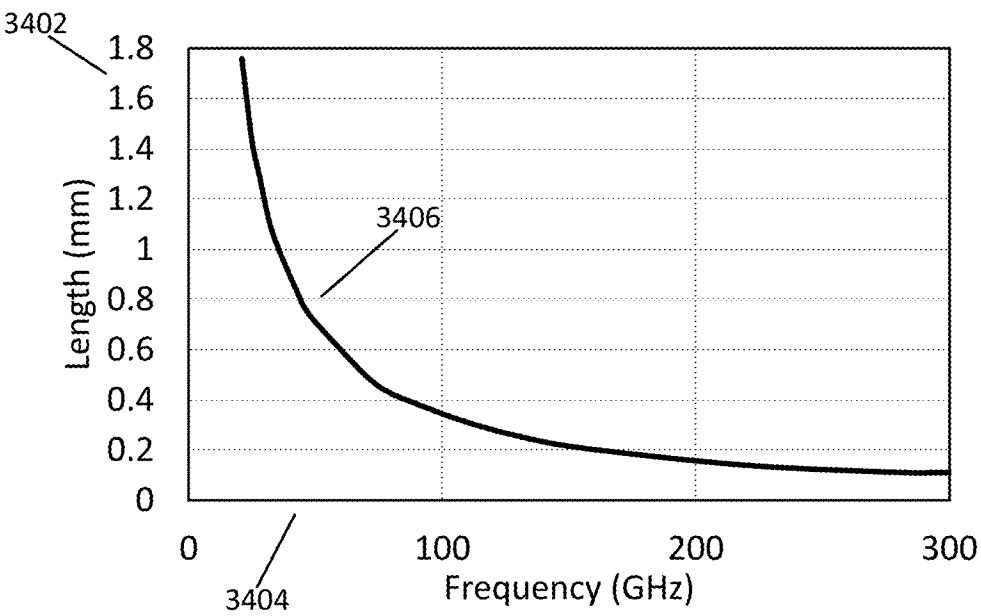
FIG. 34 is a graph depicting the frequency shifts from 20 GHz to 300 GHz by reducing the size of the duplexer structure according to aspects of the invention.

A scalability analysis was conducted to determine the size of proposed duplexer designs. The results of the study in the frequency band from 20 GHz to 300 GHz are plotted in the graph 3400 of FIG. 34 for the T-shaped filter 3300 presented in FIG. 33. The upper frequency bands beyond 50 GHz are relevant to automotive radars and to the next generation of 6G applications. From FIG. 34, we can easily infer that by changing the dimensions of a unit filter used in the above-described duplexers, the resonance at any frequency from 20 GHz to 300 GHz band can be achieved. For example, if the length is reduced from 1.76 mm to 0.11 mm (110 μm), the resonance frequency shifts from 20 GH to 283 GHz (such as for the duplexer of FIG. 20). It is a well-known fact in the field of electromagnetics that any microwave structure with relatively small dimensions resonates at higher frequencies; therefore, the scalability phenomena observed for Fano structures as presented in FIG. 34 is also applicable to EIT and Lorentz structures. One skilled in the art can understand that 300 GHz is not an upper limit; rather, the above-mentioned microstructures can resonate at higher frequencies even in the THz by reducing their dimensions in the appropriate range. It is important to note that the dimensions given in FIGS. 25 to 29 are scalable with frequency, but they are not linearly scalable. 3D electromagnetic optimization techniques are needed to attain the desired results at certain frequency bands. These dimensions are presented only as an example case and all the above-presented structures are scalable for mm-Wave and THz-frequencies.

Figure 35:
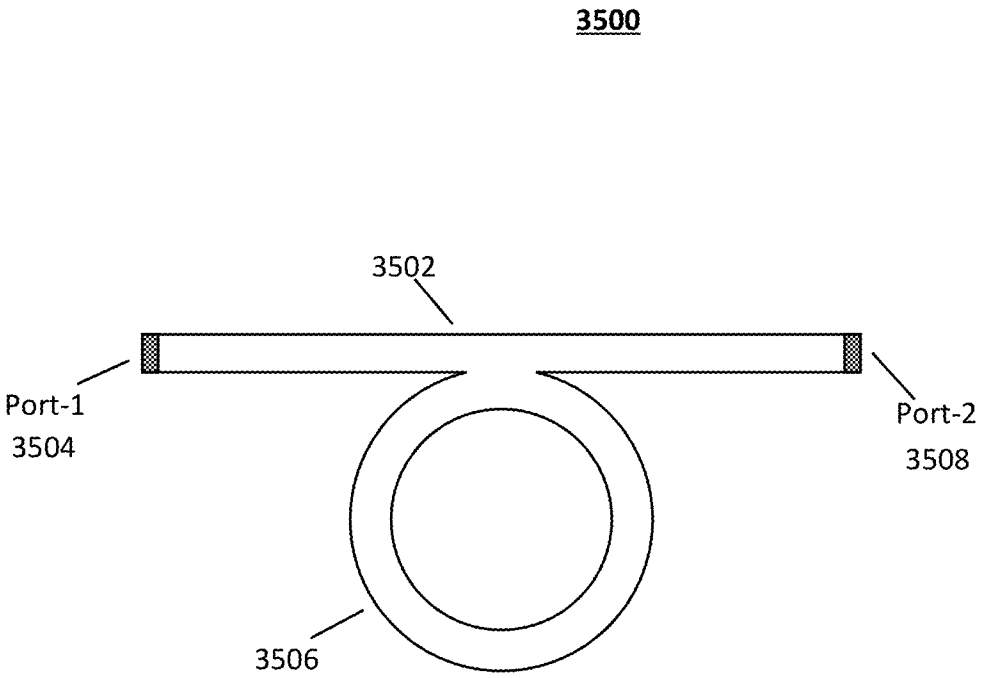
FIG. 35 is a functional diagram depicting a planar conducting ring feed connected with a microstrip line according to aspects of the invention.
Figure 36:
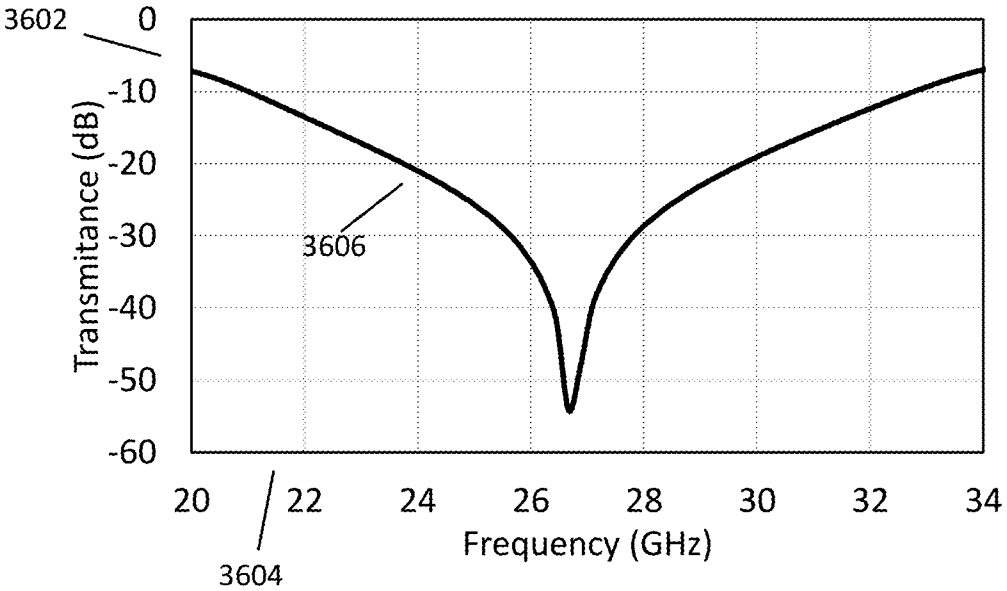
FIG. 36 is a graph depicting a frequency response of the ring that resonates at 27 GHz according to aspects of the invention.
Figure 37:
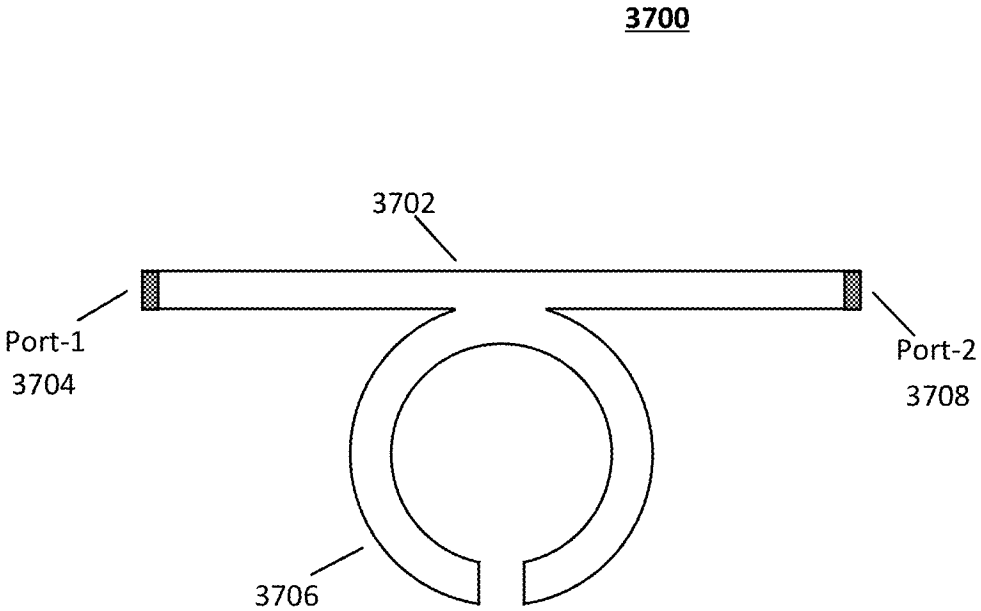
FIG. 37 is a functional diagram depicting a planar conducting ring feed connected with a microstrip line with a cut at the bottom of the ring to create a transparency window in Lorentz absorption spectra according to aspects of the invention.
Figure 40:
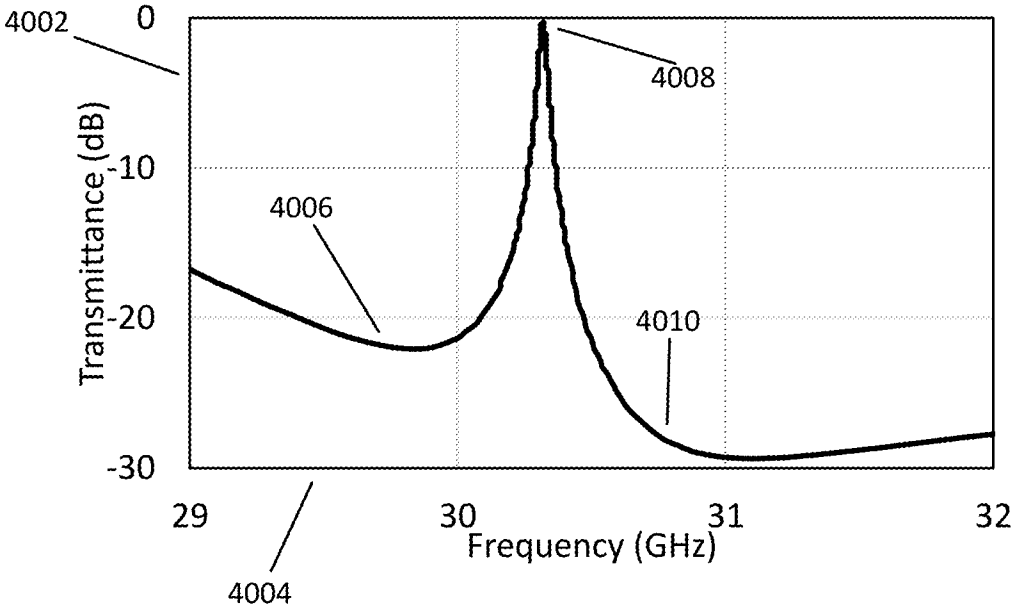
FIG. 40 is a graph depicting the frequency response of the planar conducting ring feed shown in FIG. 37 having a transparency window at 30.5 GHz according to aspects of the invention.
Figure 41:
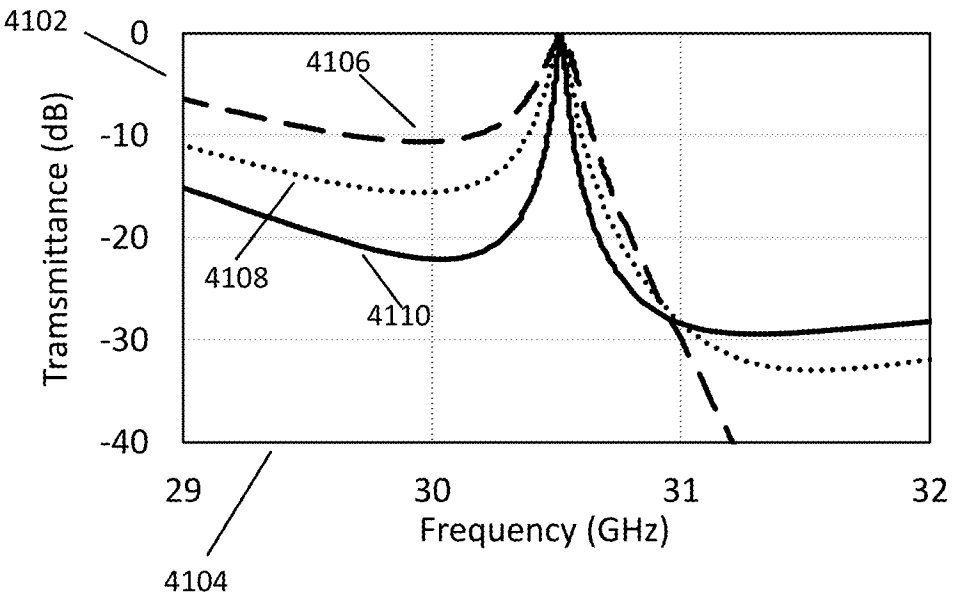
FIG. 41 is a graph depicting the frequency response of the planar conducting ring feed shown in FIG. 37 having a bandwidth increase by increasing the overlapping area according to aspects of the invention.
Figure 42:
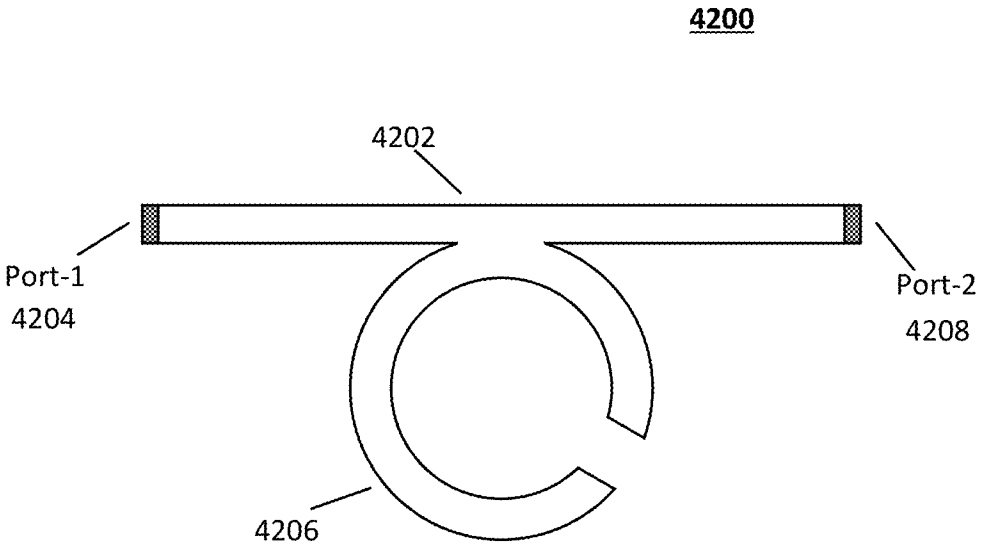
FIG. 42 is a functional diagram depicting a ring structure having a gap inserted at the side of the ring at a particular angle to achieve EIT according to aspects of the invention.

The design of a duplexer for mm-wave 5G/6G applications is challenging and requires innovations and improvements in existing design methodologies. If the complexity of the problem is well understood, then sometimes the simple geometries can also provide a convenient solution. A miniature proposed design using a simple ring resonator 3506 with a microstrip feed line 3502 is shown in FIG. 35 and its frequency response is shown in the frequency response graph 3600 of FIG. 36. One possible variation is the use of split-ring resonator 3706 instead of a ring resonator 3506 as shown in FIG. 37. The frequency response of the split-ring resonator 3706 design is shown in the frequency response graph 4000 of FIG. 40.

Lorentz absorption at microwave frequencies (K, Ka-band) can be achieved by using different methods like placing a resonating cavity near a microstrip as shown in FIG. 35. The size of resonators can be further decreased by increasing the dielectric permittivity of the substrate if possible.

EIT, Fano, and Lorentz profiles can also be attained using the different combinations of the partial split-ring resonator and partial reflecting area in the microstrip line as shown in FIGS. 37 to 45, respectively. The effectiveness of such type of passive solutions is that their size is equal to or even smaller than that of the size of the on-chip feeding antenna (as described above with regard to FIG. 32) which makes them suitable for lower band mm-wave (20 GH-50 GHz) applications as well as higher frequencies.

All these methods have one common goal of reducing the size of the DoC. The designs and partial simulation results of these innovative techniques are discussed below.

Figure 38:
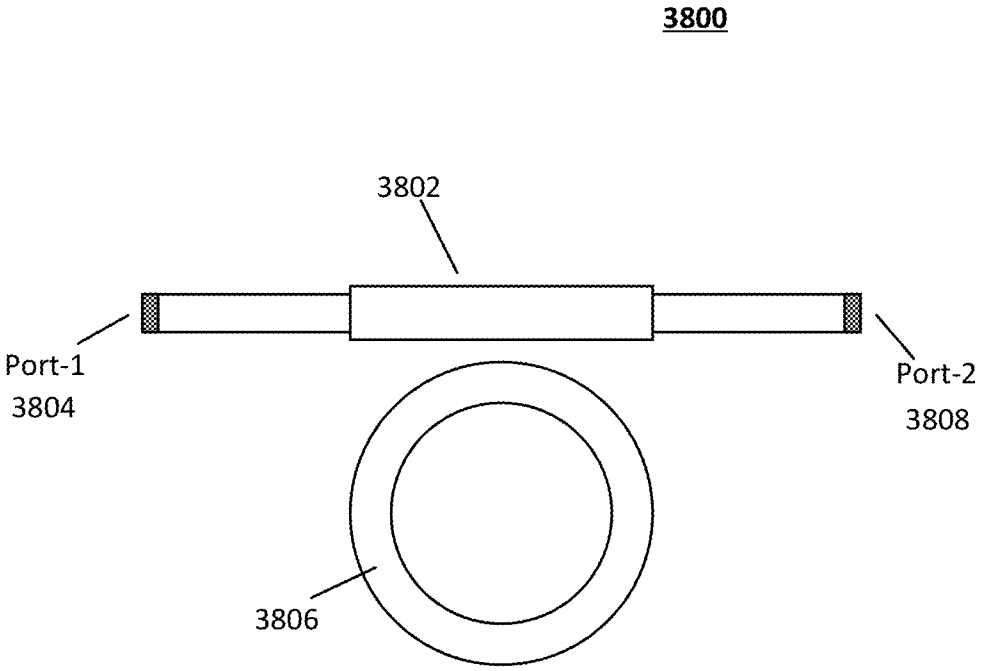
FIG. 38 is a functional diagram depicting a planar conducting ring feed connected with a microstrip line with a partially reflecting element provided in the main transmission line path to create a transparency window in Lorentz absorption spectra according to aspects of the invention.
Figure 39:
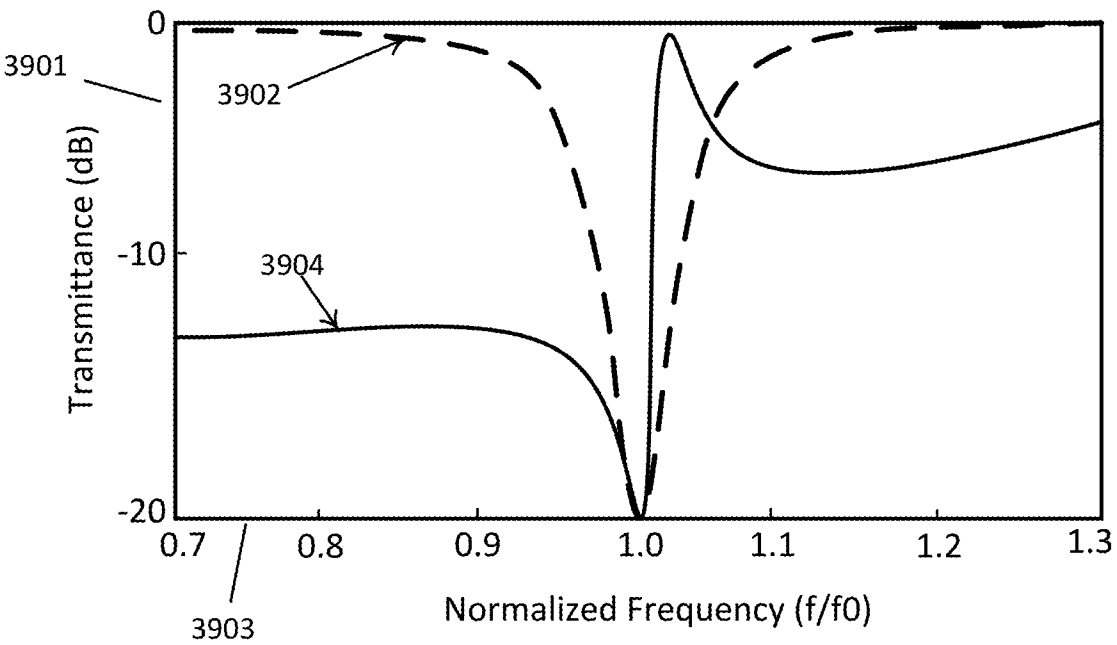
FIG. 39 is a graph depicting a frequency response of the ring having a transparency window in the Lorentzian absorption spectra according to aspects of the invention.

The Fano resonance can be achieved by making a precise cut at the bottom of ring 3706 as shown in FIG. 37 or making a partial reflection path 3802 in microstrip as shown in FIG. 38. The transparency window can be created in the absorption spectra as shown in the frequency response graph 3900 of FIG. 39. This high selectivity can provide the desired duplexing action at the channel or sub-band level in 5G/6G systems. The sizes of these filters are much smaller compared to the stub-based filter shown in FIG. 10. The frequency response is shown in the frequency response graph 4000 of FIG. 40 with a quality factor of more than 500. The quality factor has a direct tradeoff with the bandwidth and can be adjusted to a desired value as depicted in the frequency response graph 4100 of FIG. 41.

Figure 43:
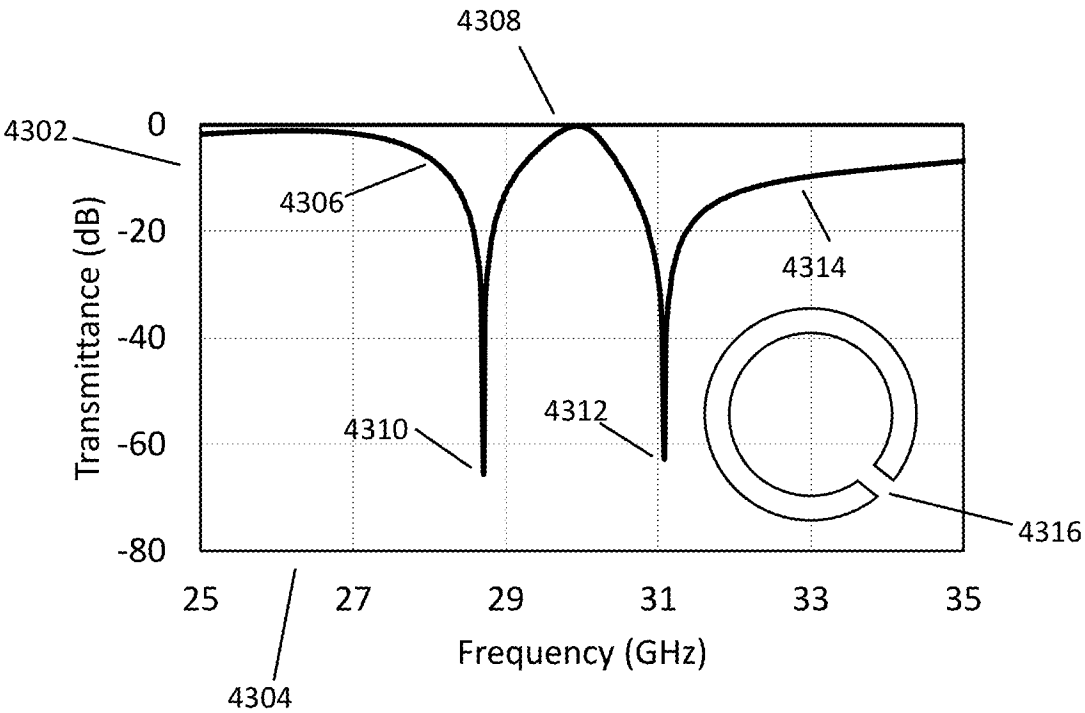
FIG. 43 is a graph depicting the frequency response of the ring structure of FIG. 42 showing a transparency window at 30 GHz according to aspects of the invention.
Figure 44:
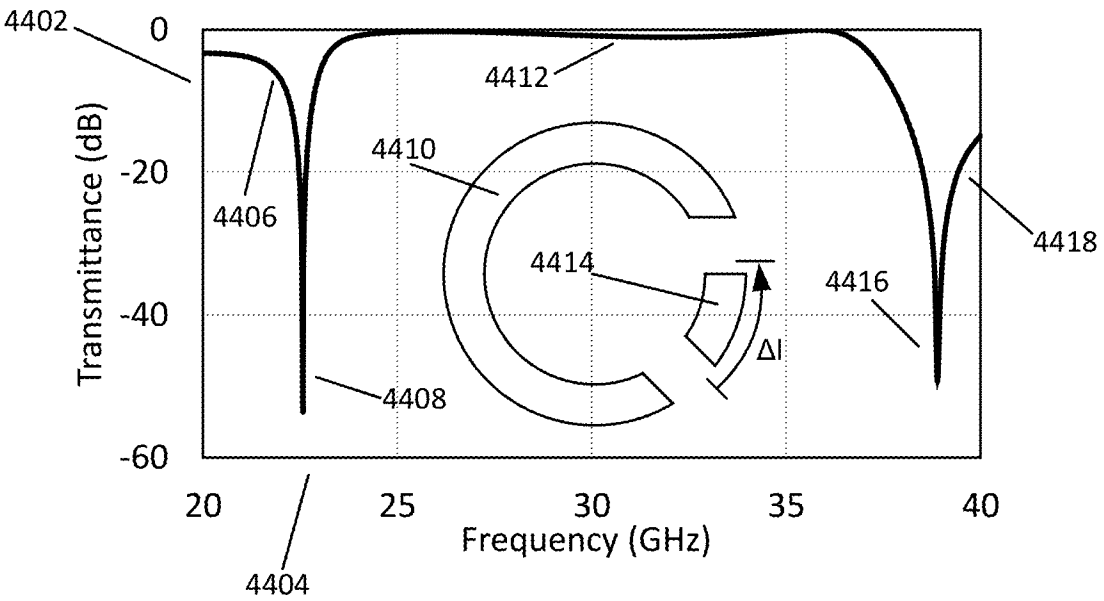
FIG. 44 is a graph depicting the frequency response of the ring structure of FIG. 42 wherein the bandwidth of EIT is controlled by changing the location of the cut in the ring structure according to aspects of the invention.

A large bandwidth can be achieved by using EIT instead of Fano resonance in the same split ring structure as shown in the FIG. 43 inset. The phenomenon is the same as that shown in FIG. 8 with an open stub. The EIT phenomenon is achieved by placing two resonators with slightly different resonance frequencies adjacent to each other. This can be accomplished by shifting the gap from bottom of the ring to the right of the ring as shown in ring 4206 of FIG. 42. The resulting frequency response for ring 4206 is shown in the frequency response graph 4300 of FIG. 43. The Q factor and bandwidth can be controlled by changing the location of the gap (Δ1) 4414 in ring 4410 as shown in FIG. 43. The drawback of using this type of EIT based filtering is that it has poor out-of-band rejection, which means that these types of designs are not suitable where high selectivity is desired like in the case of DoCs needed for the sub-band selection.

Figure 45:
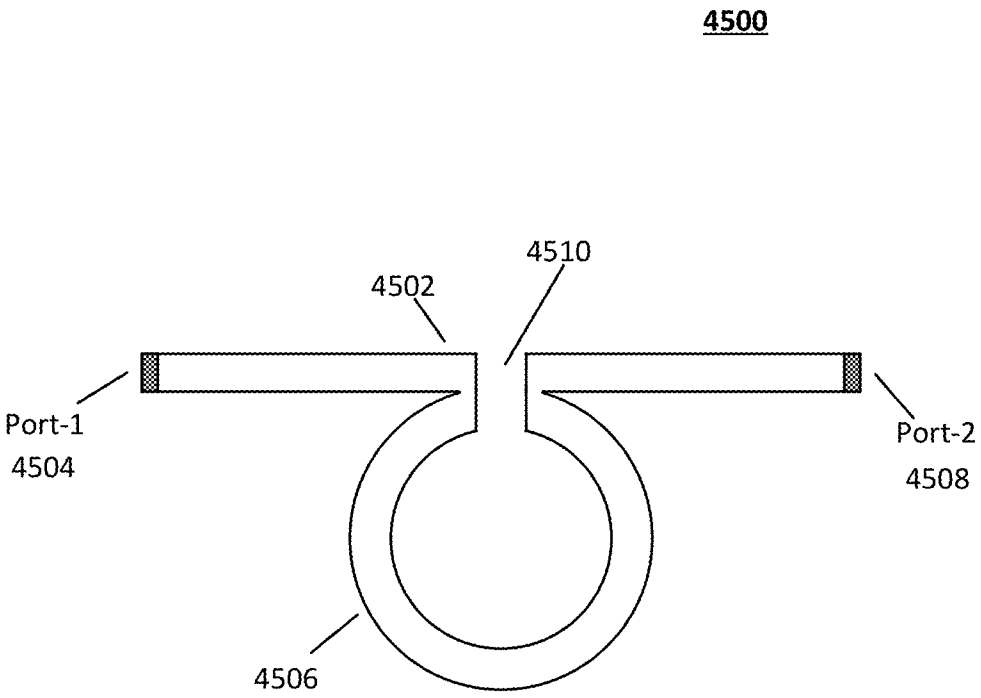
FIG. 45 is a functional diagram depicting a planar conducting ring feed connected with a microstrip line with a cut inserted in both the ring and the transmission line to produce Lorentz absorption according to aspects of the invention.
Figure 46:
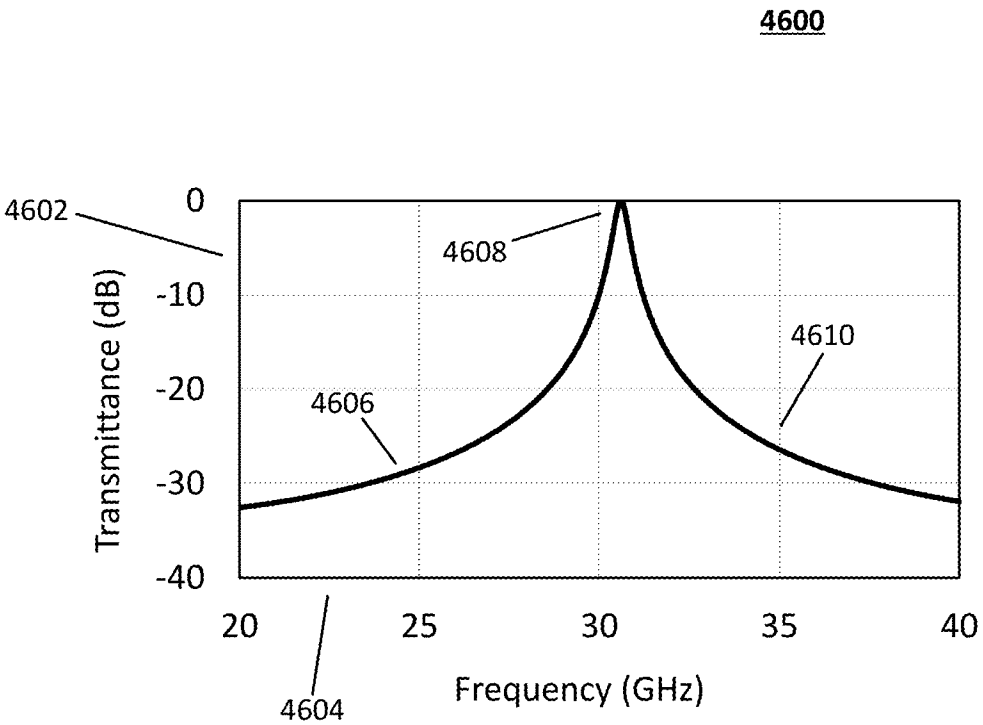
FIG. 46 is a graph depicting the frequency response of the ring structure of FIG. 45 wherein the transmittance curve shows the Lorentzian response of the ring structure according to aspects of the invention.
Figure 47:
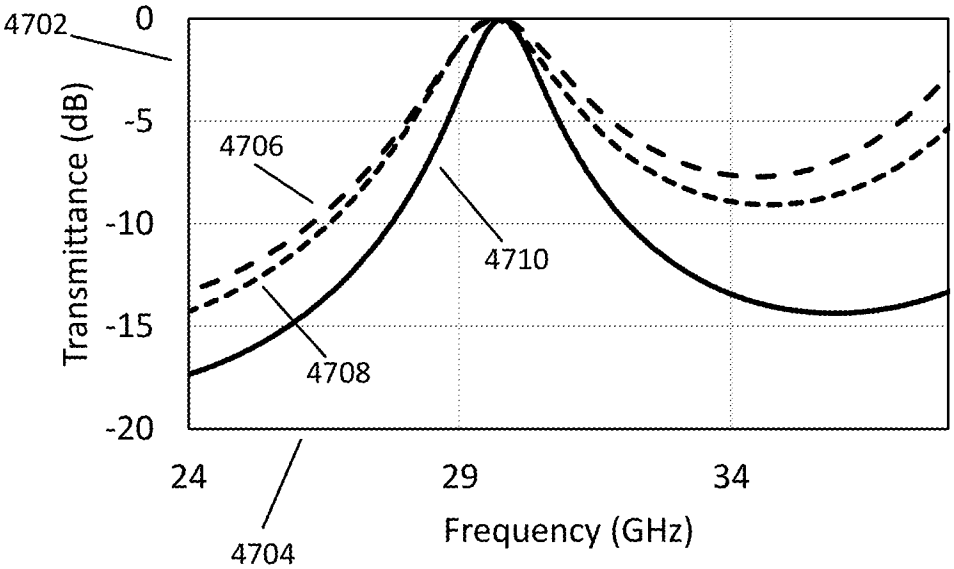
FIG. 47 is a graph depicting the frequency response of the ring structure of FIG. 45 wherein the bandwidth of the Lorentz structure can be controlled by changing the width of the microstrip and the overlapping area between the ring and microstrip according to aspects of the invention.

Moderate out-of-band rejection can be achieved by using traditional Lorentzian resonance which can be attained by inserting a cut both in the ring 4506 and in the transmission line 4502 as shown in FIG. 45. The frequency response of such a design is shown in the frequency response graph 4600 of FIG. 46. The Lorentzian filter out-of-band rejection and Q factor can be improved, as shown in the frequency response graph 4700 of FIG. 47, by changing the width of the microstrip and the overlapping area between the ring and microstrip.

Effect of Dielectric Losses

At mm-wave, one cannot neglect the adverse effect of the dielectric losses (tan δ) on the passband response of passive components. A series of electromagnetic simulations was performed at 28 GHz to quantify the effect of dielectric losses on the signal attenuation in passband. The summary of attenuation for all three types of filters (FIGS. 37, 42 and 45) is provided in Table 2 below. As seen from the data in Table 2, if the substrate has a high dielectric loss, EIT and Lorentz filters will have small passband attenuation compared to the Fano filters. Hence Fano filters are more sensitive to dielectric losses as compared to EIT and Lorentz filters.

TABLE 2

Effect of dielectric losses on the signal attenuation response of EIT, Fano, and Lorentz type filters structures

| Dielectric | Insertion Loss (dB) | | |
|---|---|---|---|
| Loss (tanδ) | Fano | Lorentzian | EIT |
| 0.000 (Ideal) | 0.0 | 0.0 | 0.0 |
| 0.0001 | −0.901 | −0.065 | −0.013 |
| 0.0003 | −2.5 | −0.195 | −0.0186 |
| 0.0005 | −3.859 | −0.314 | −0.086 |
| 0.0009 | −6.061 | −0.564 | −0.163 |
| 0.001 | −6.54 | −0.625 | −0.343 |
| 0.003 | −12.915 | −1.742 | −0.536 |
| 0.009 | −21.663 | −4.439 | −1.534 |

Figure 20:
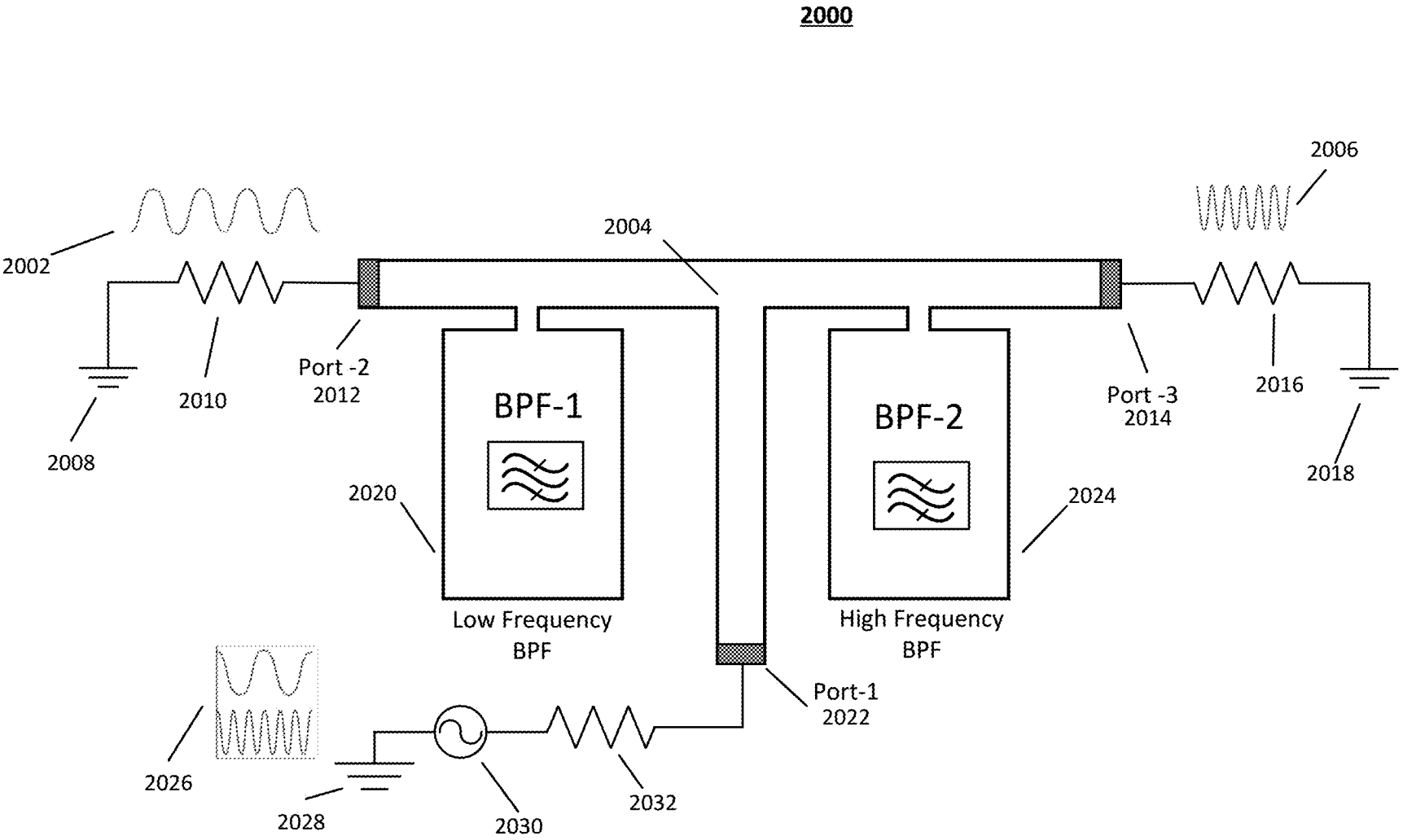
FIG. 20 is a functional diagram depicting the frequency division scheme and the ideal frequency response of a T-shaped duplexer according to aspects of the invention.
Figure 21:
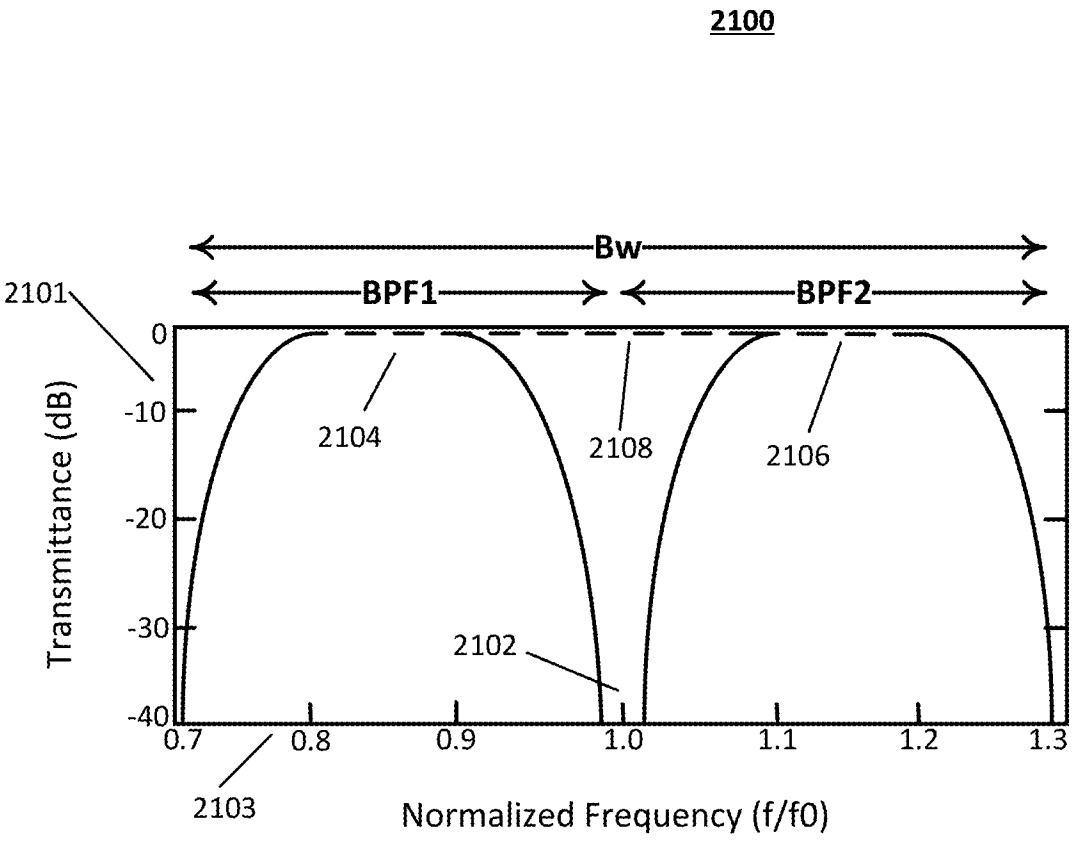
FIG. 21 is a graph depicting the ideal frequency response of a T-shaped duplexer according to aspects of the invention.

The ring resonator based EIT, Fano, and Lorentz type filters are applied in the T-Shaped duplexer shown in FIG. 20. The basic structure of the transmission line remains the same for all designs. It is important to note that just by changing the position of the cut in the split ring resonator, the Fano, EIT and Lorentz responses can be achieved.

Figure 48A:
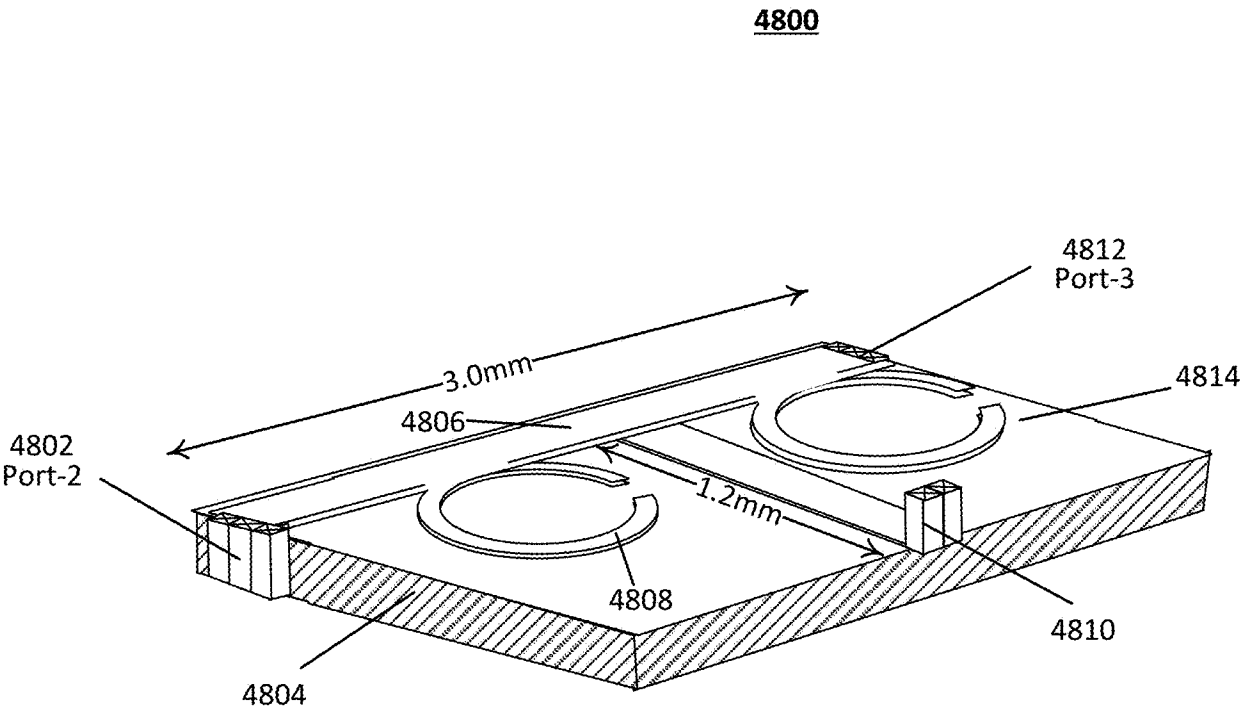
FIG. 48A is a functional diagram depicting a single-layer T-shaped SSR filter based duplexer according to aspects of the invention.

One method is to use the split ring resonators which mimic an LC tank. The planar geometrical structure using a split ring resonator design is shown in FIG. 48A. The design is similar to that of the one shown in FIG. 20, but with a different configuration that is smaller in size. The top view of such a design is shown in FIG. 48A which shows the duplexer size is only 3×1 $mm^2$.

Figure 49:
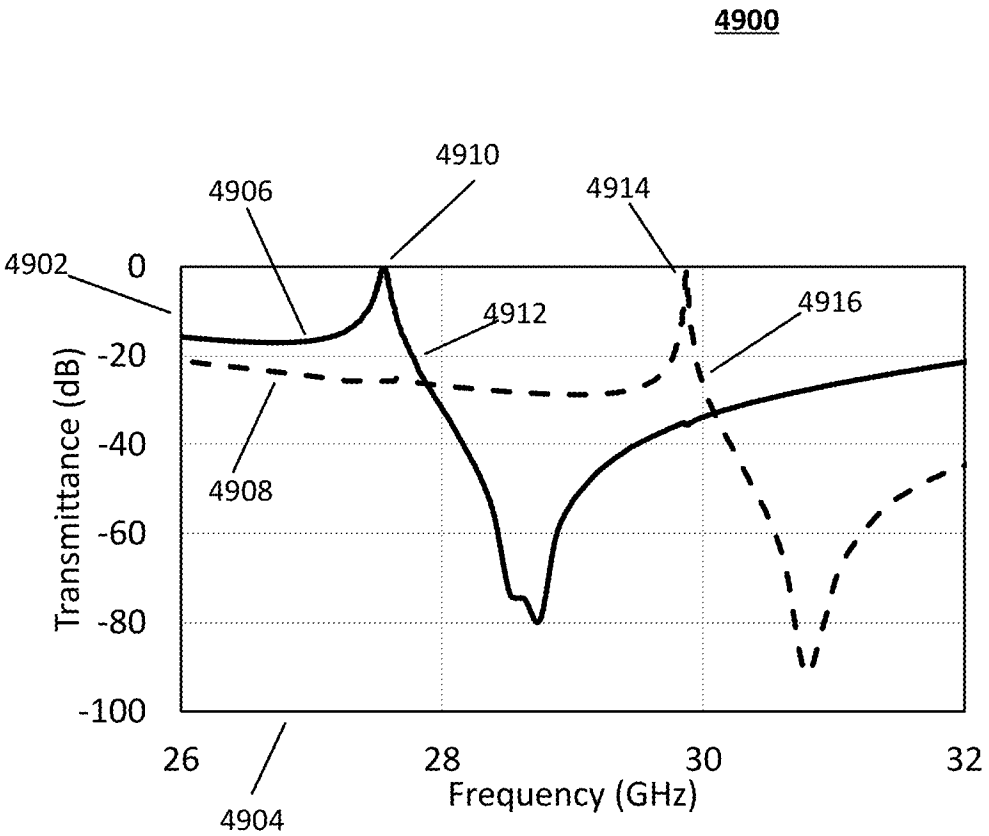
FIG. 49 is a graph depicting the frequency response of Fano SRR filters having duplexing action according to aspects of the invention.
Figure 50:
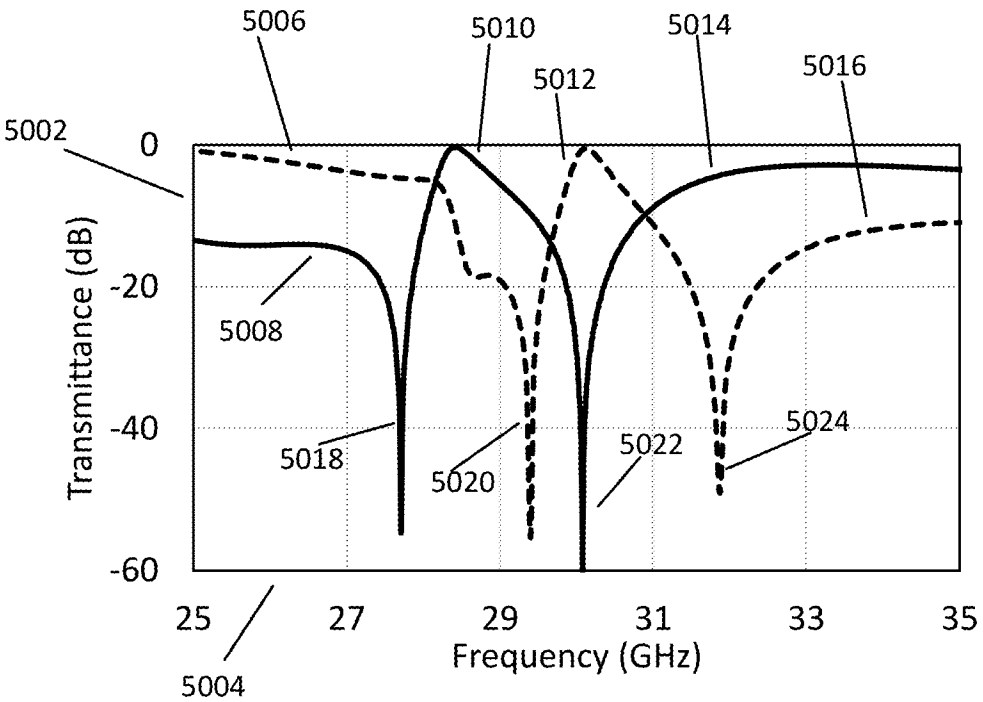
FIG. 50 is a graph depicting the frequency response of EIT SRR filters having duplexing action according to aspects of the invention.
Figure 51:
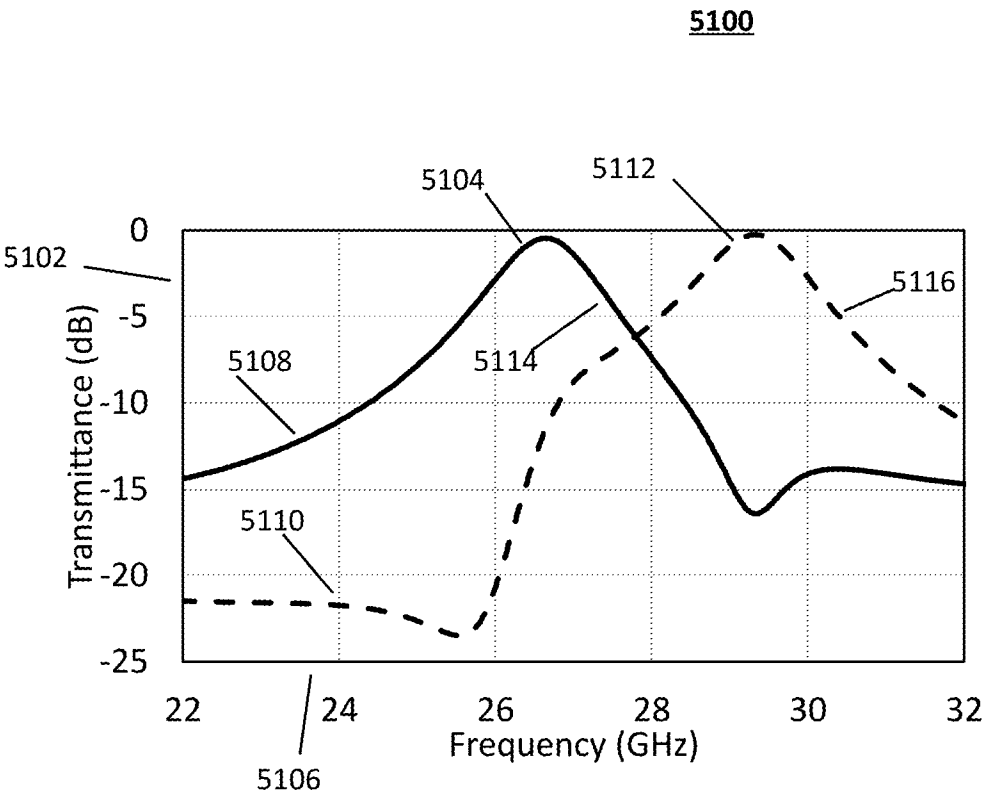
FIG. 51 is a graph depicting the frequency response of Lorentzian SRR filters having duplexing action according to aspects of the invention.

Three different types of resonance phenomenon (Fano, EIT, and Lorentzian) are used to achieve the duplexing action. The frequency response of Fano, EIT, and Lorentz DoCs are shown in the frequency response graphs of FIGS. 49, 50 and 51, respectively. The Fano-based duplexer offers selectivity and isolation of approximately 25-30 dB; while EIT-based duplexers offer a relatively large bandwidth with low out-of-band rejection. Lorentzian resonance-based duplexers provide excellent out-of-band rejection and their isolation is independent of the position of resonances. The quality factor of EIT and Lorentz based DoCs is low compared to Fano-based DoCs.

These three kinds of filters and associated duplexers have numerous applications at different locations in a 5G/6G front-end architecture. The EIT and Lorentzian based designs are useful at the front-end where large bandwidth is desired for the complete band. The Fano-based design is more suitable for the selection and duplexing of sub-bands. The aforementioned designs utilize simple and planar structures, and due to their small size they can fit under the AoC for the 28-32 GHz low band mm-wave applications. Maximum isolation of −30 dB with an insertion loss of up to 0.5 dB can be attained using the aforementioned structures. The aforementioned designs are flexible because both the selectivity and isolation can be controlled thereby adding another dimension to the novelty of the structure.

Figure 48B:
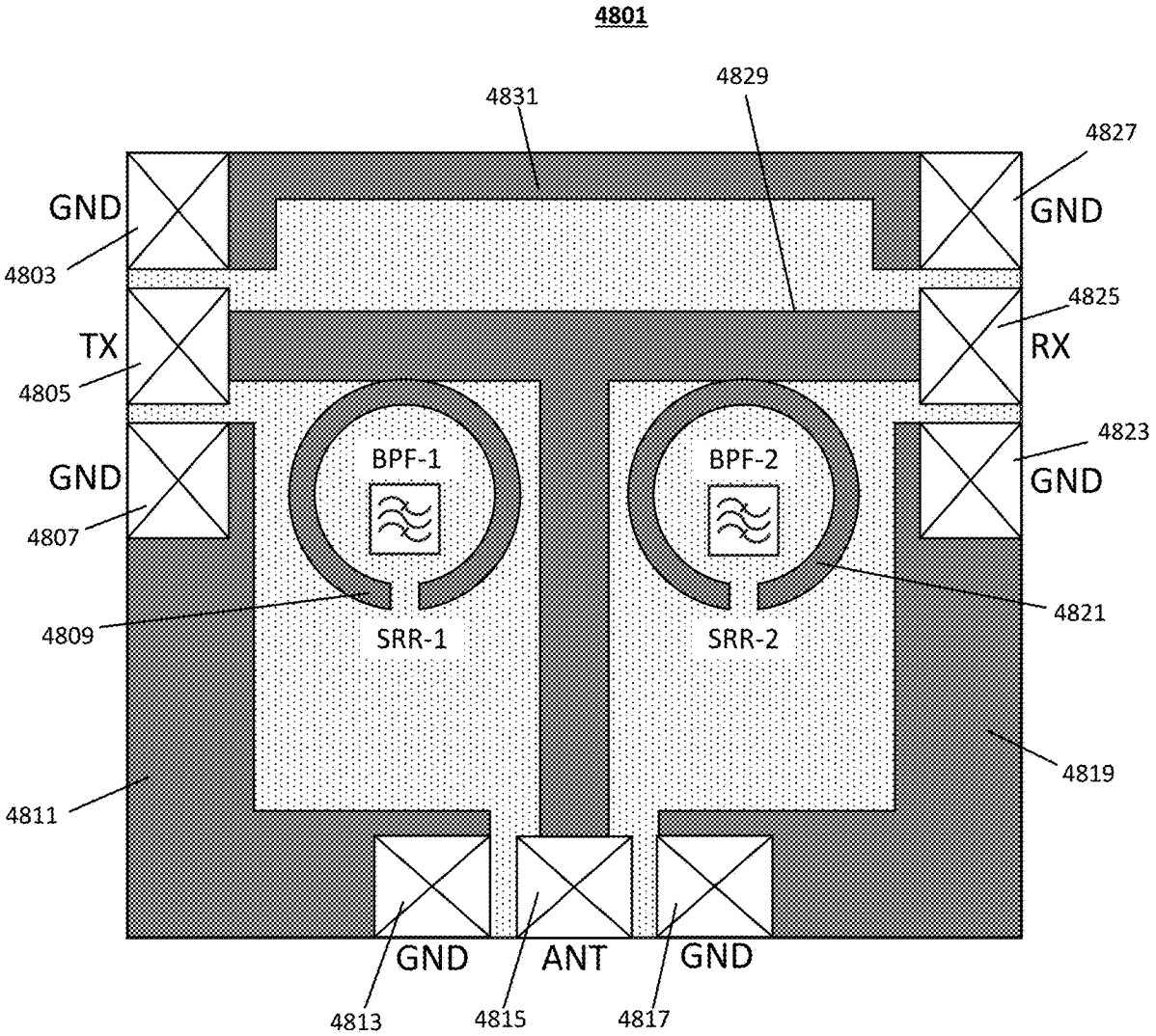
FIG. 48B is a functional diagram depicting a top view of the T-shaped SRR filter based duplexer according to aspects of the invention.
Figure 52A:
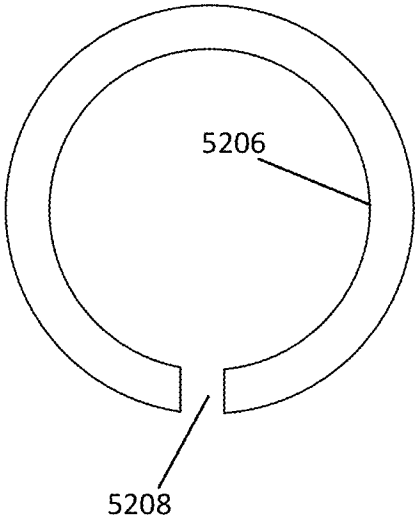
FIG. 52A is a functional diagram depicting a ring structure with a cut inserted in both the ring to produce Lorentz absorption according to aspects of the invention.
Figure 52B:
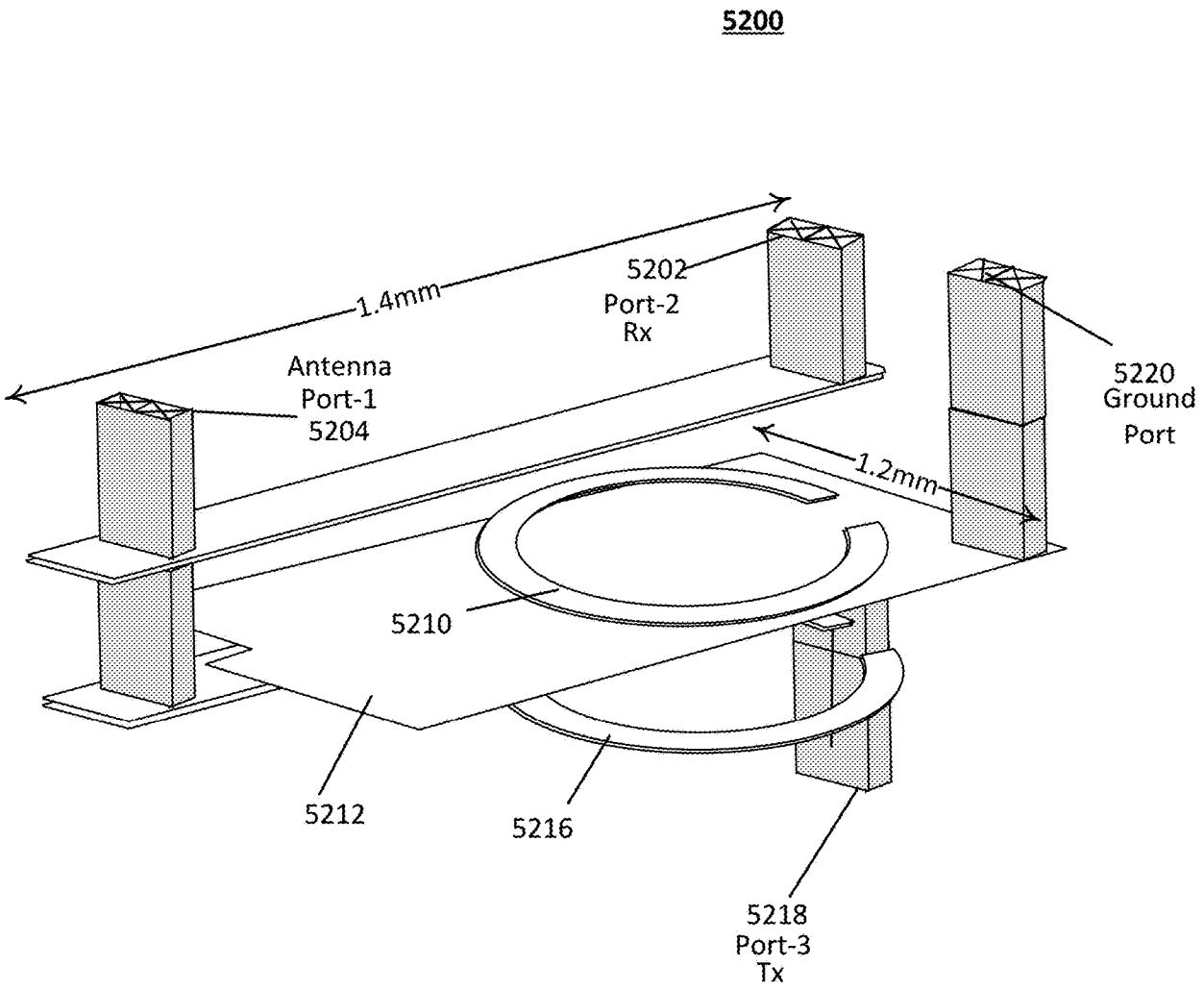
FIG. 52B is a functional diagram depicting a multilayer structured duplexer according to aspects of the invention.
Figure 53:
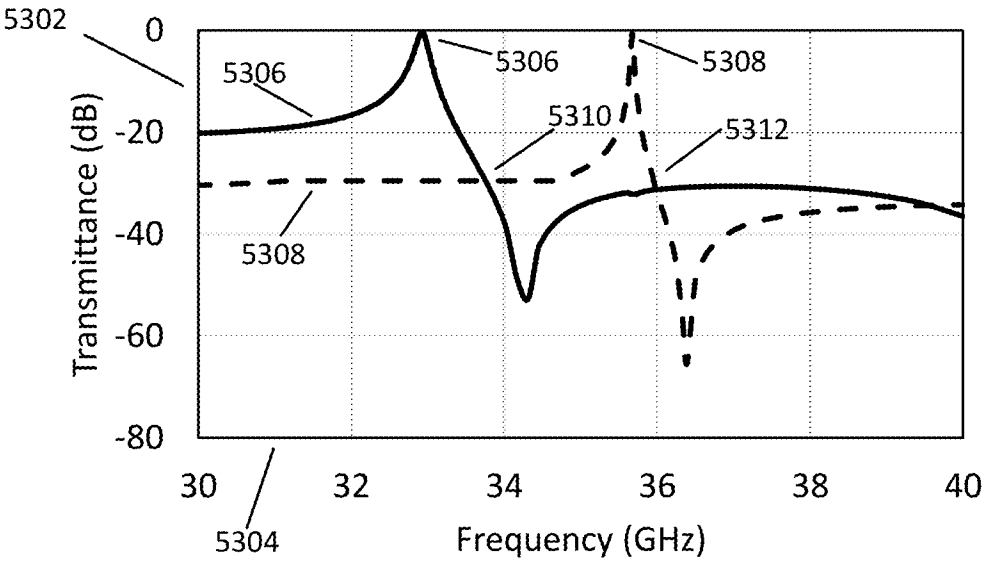
FIG. 53 is a graph depicting the frequency response of the multi-layered structure of FIGS. 52A and 52B having duplexing action according to aspects of the invention.

The designs provided in FIGS. 48A and 48B are planar and use the same metal layer of the CMOS metal stack. Using more than one metal layer, the design geometry can be reduced to realize even more compact structure. To demonstrate this aspect, a Fano based duplexer was designed with a ring resonator diameter of 1 mm. This type of duplexer with a ring resonator has a better potential to be integrated on chip due to its small size. The metal vias models were used to excite the resonators that were placed on the adjacent layers as shown in FIGS. 52A and 52B. In FIG. 52B, antenna port-1 5204 and common ground port 5220 are shown. The signal that is received at receive port-2 5202 and transmit port-3 5218 depends upon the resonance frequencies of relevant SRRs. The common ground plane 5212 between both resonators 5210 and 5216 is connected with the package ground through multiple vias. The thickness of the dielectric between two metal layers is taken to be 9 μm. The duplexer action is achieved by tuning each of the SRR filters to a different frequency as shown in the frequency response graph 5300 of FIG. 53. The simulation results validate the concept of a folded multilayer duplexer as described above. One skilled in the art will appreciate that the duplexer size can be further reduced which thereby makes the complete DoC of comparable dimension as that of SRR 5206 with a radius of 0.5 mm.

Figure 54:
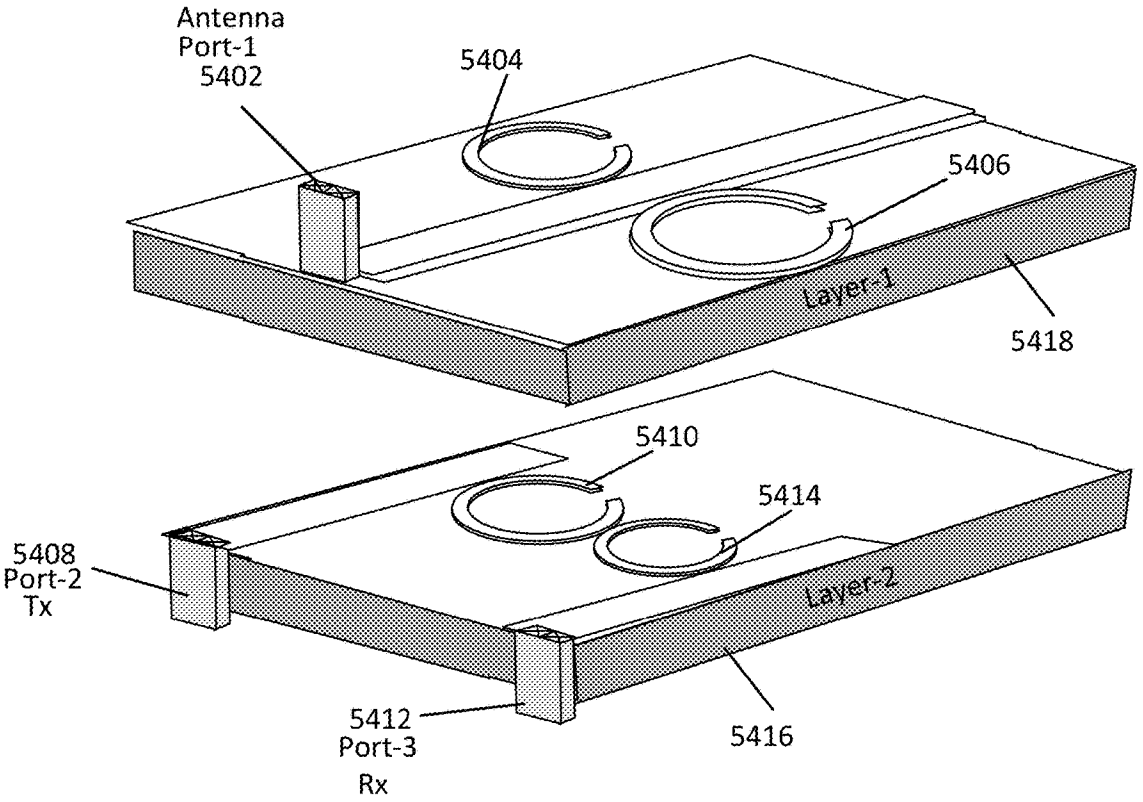
FIG. 54 is a functional diagram depicting a SRR filter based duplexer wherein the SRRs are used for coupling and wherein the position of the SRRs are swapped to avoid resonance cancellation according to aspects of the invention.
Figure 55:
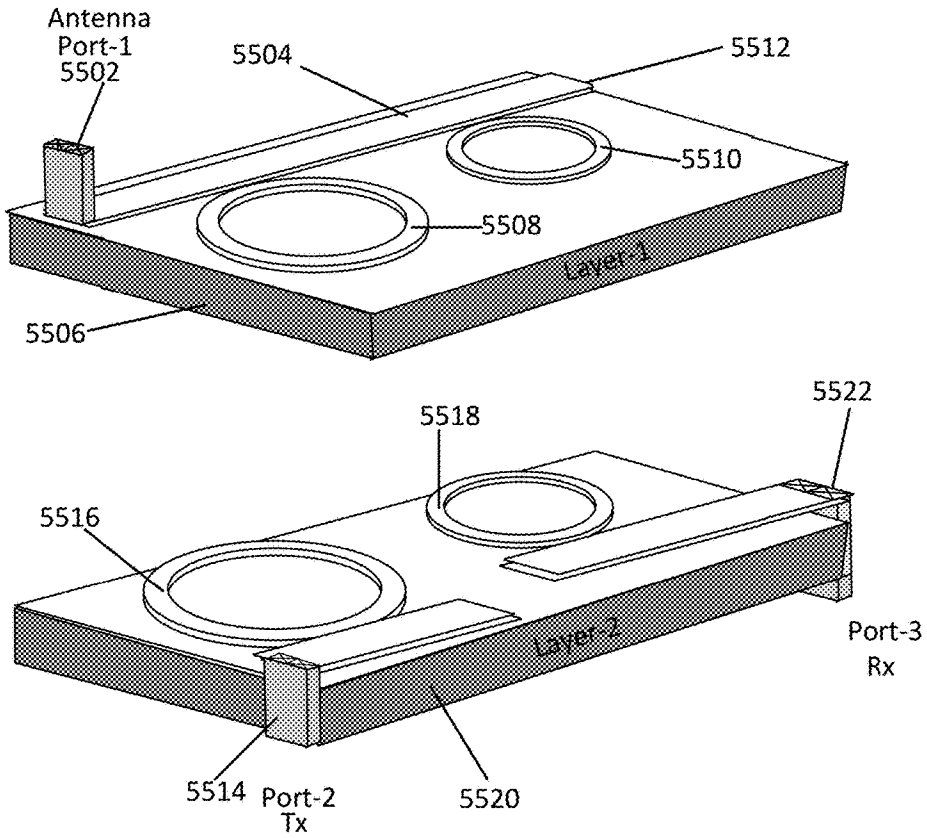
FIG. 55 is a functional diagram depicting a multilayered filter structure which exhibits coupling between the layers according to aspects of the invention.
Figure 56:
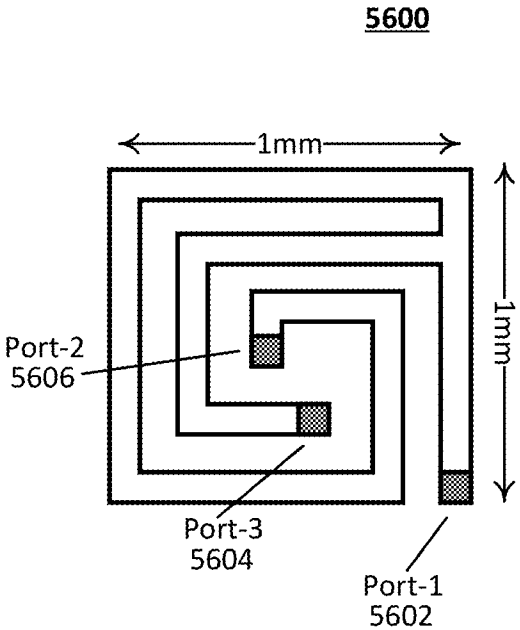
FIG. 56 is a functional diagram depicting a spiral duplexer having a 0.2×0.2 mm2 design according to aspects of the invention.

In FIGS. 54, 55 and 56, three multilayer DoC designs are shown. These designs utilize multiple spilt ring resonators (SRRs) at different frequencies to attain the near field coupling to attain the Fano, EIT and Lorentz resonance at the same time. These structures work on the same principle and provide a similar response as that of the planar DoC shown in FIG. 52B. These designs provide similar tradeoffs in bandwidth, loss, and out-of-band rejection as that of the planar SRR-based DoC.

Figure 57:
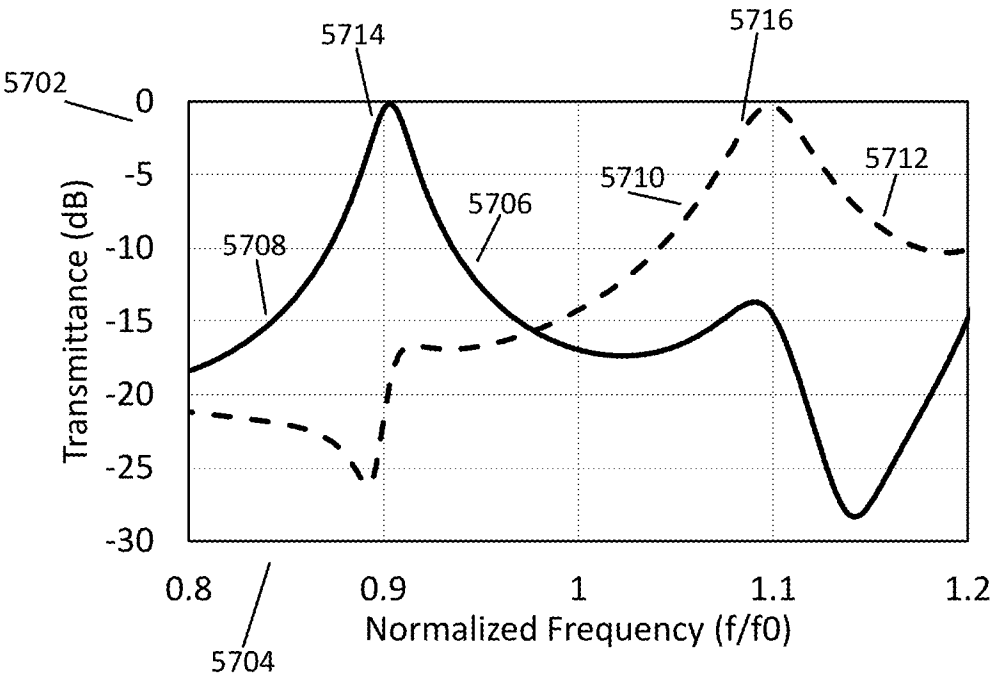
FIG. 57 is a graph depicting the frequency response of the spiral duplexer of FIG. 56 according to aspects of the invention.

A new class of the Lorentz-based, double-spiral type of duplexer suitable for a single or multilayer implementation is shown in FIG. 56. The design is unique in its compactness and is suitable for the designs where an extremely large number of the DOCs are desired on a single chip. The frequency response of this design is shown in the frequency response graph 5700 of FIG. 57 which shows the wide bandwidth and moderate selectivity which are typical characteristics of the Lorentz-based structures.

Application Scenarios 1. 5G/6G Applications and Beyond

Figure 58:
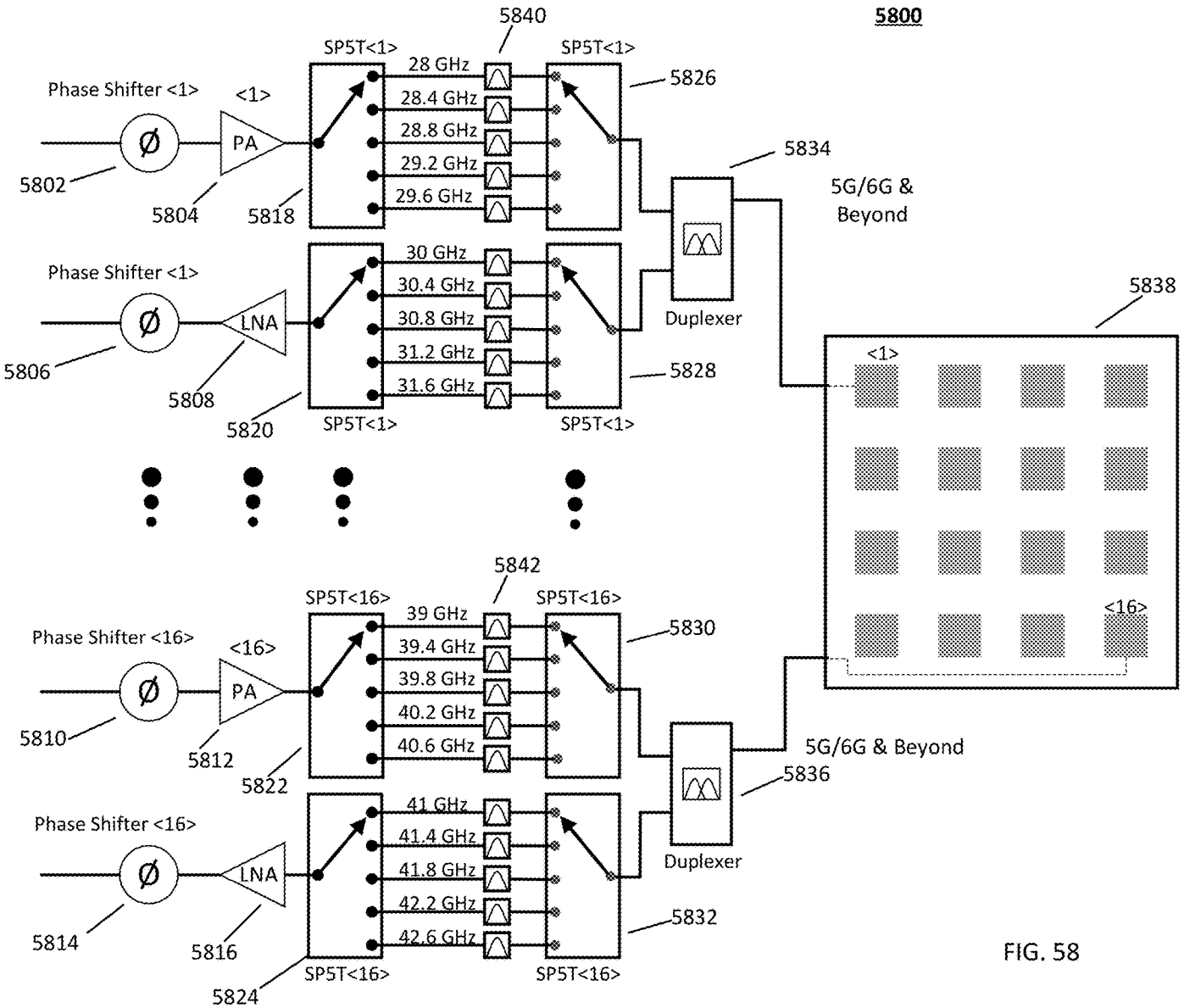
FIG. 58 is a functional diagram depicting a 5G/6G radio architecture according to aspects of the invention.

One possible application scenario of 5G/6G radio architecture addressing two mm-wave bands: 28-32 GHz and 39-43 GHz is shown in FIG. 58. The array antenna 5838 has 16 AoC antennas (but it should be appreciated that the number of these antennas could reach up to 1000) and each antenna is connected with a dedicated duplexer 5834 and 5836. The signal from the duplexer (5834 or 5836) passes through single pole multiple throw (SPMT) switches which are connected with the sets of BP filters 5840 and 5842. These SPMT switches are further connected to the power amplifier 5812 and LNA 5816. The BP filters 5840 and 5842 provide sub-band selection. These filters are important for the cognitive functionality inherent in the 5G/6G radios for the dynamic selection of an available frequency band for transmission and for reception. These BP filters can be EIT, Fano or the Lorentz type and can be realized using the open stubs or the SRR structures described above and in the accompanying figures.

2. Asymmetric Duplexers

In some communication networks (for example Satellite networks), the uplink and downlink can have different data rates and that translates to different bandwidth requirements in the associated cognitive radios. The cognitive radio allocates the software and hardware resources dynamically to optimally utilize the available resources in order to meet the user demands at the same time.

Figure 59:
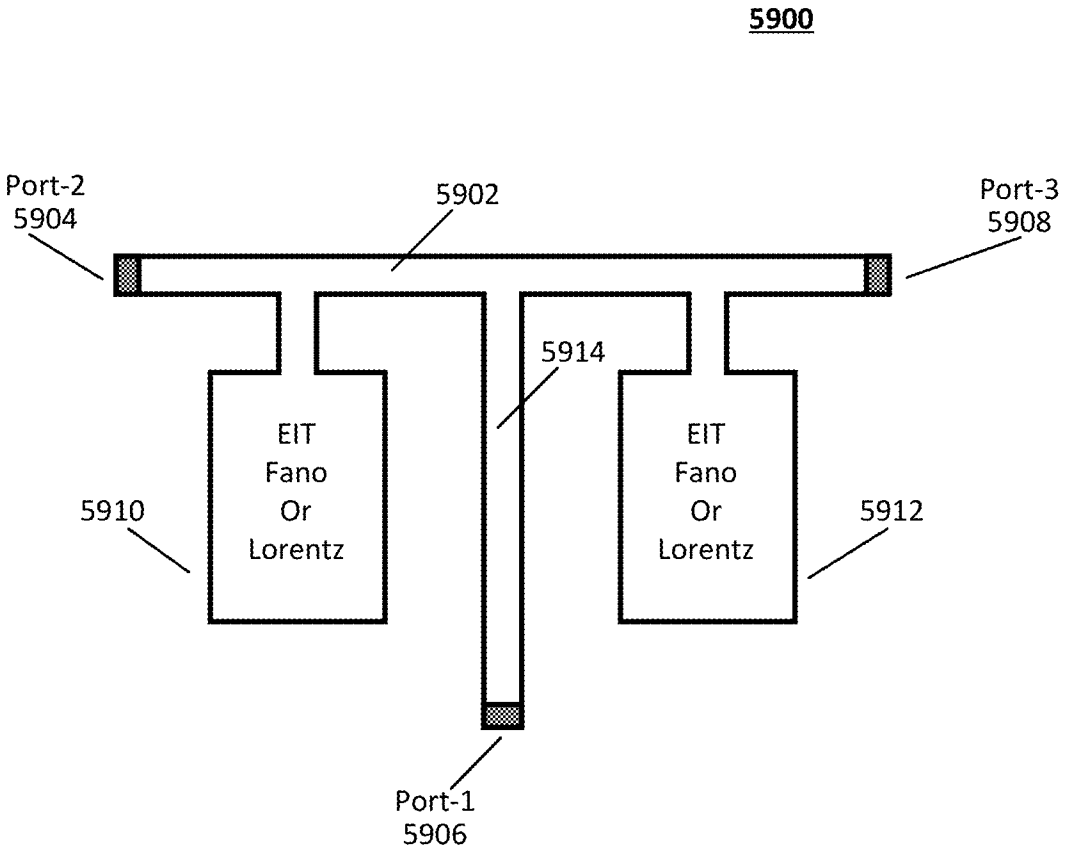
FIG. 59 is a functional diagram depicting a duplexer that has different types of filters to support uplink and downlink communication using different bandwidths according to aspects of the invention.

In such cases, we can apply different types of filters 5910 and 5912 for the uplink and the downlink as shown in FIG. 59 and thereby achieve the different bandwidths on the uplink and the downlink. The filters 5910 and 5912 can be of the EIT, Fano or Lorentzian type. These filters have different selectivity and out-of-band rejection and the appropriate filter can be chosen to meet the requirement for a given application.

Additionally, such asymmetric duplexers may be used in bands where part of the uplink band is intentionally left unused to avoid interference in adjacent bands, such as when using the C and D blocks of the WCS frequency band, for example. Such asymmetric duplexers may also be used when implementing channel aggregation, such as may occur in LTE Advanced systems, thereby causing the downlink to have a wider bandwidth than the uplink bandwidth.

Those of skill in the art will appreciate that the various examples, logical and functional blocks, devices, modules and units described in connection with the aspects disclosed herein can be implemented as hardware blocks inside the application specific integrated chip (ASIC) or discrete blocks in 3D integrated circuits or multichip modules or hybrids or reconfigurable modules of software defined radios (implemented in any technology). To clearly illustrate this interchangeability of hardware and functionality, various illustrative components, blocks, modules, and/or steps have been described above generally in terms of their functionality. Whether such functionality is implemented as hardware or software depends upon the particular constraints imposed on the overall system and devices. Skilled persons can implement the described functionality in varying ways for each particular system, but such implementation decisions should not be interpreted as causing a departure from the scope of the invention described herein. In addition, the grouping of functions within a unit, module, block, or step is for ease of description. Specific functions or steps can be moved from one unit, module, or block without departing from the invention.

The above description of the disclosed aspects, and that provided in the accompanying documents, is provided to enable any person skilled in the art to make or use the invention. Various modifications to these aspects will be readily apparent to those skilled in the art, and the generic principles described herein, and in the accompanying documents, can be applied to other aspects without departing from the spirit or scope of the invention. Thus, it is to be understood that the description and drawings presented herein, and presented in the accompanying documents, represent particular aspects of the invention and are therefore representative examples of the subject matter that is broadly contemplated by the present invention. It is further understood that the scope of the present invention fully encompasses other aspects that are, or may become, understood to those skilled in the art based on the descriptions presented herein and that the scope of the present invention is accordingly not limited by the descriptions presented herein, or by the descriptions presented in the accompanying documents.

What we claim is:

1. A ring resonator based T-shaped duplexer for use in communication systems, the T-shaped duplexer comprising:

a T-shaped microstrip duplexer body having a first rectangular-shaped body section and a second rectangular-shaped body section that extends from the first-rectangular shaped section in a perpendicular position relative to the first rectangular-shaped section;

three connection ports including a first connection port disposed at an open end of the second rectangular-shaped body section, a second connection port disposed at one end of the first rectangular-shaped body section, and a third connection port disposed at another end of the first rectangular-shaped body section; and two bandpass filters, each bandpass filter comprising a ring resonator structure having a circular shape, an outer edge of the ring resonator structure being connected to the first rectangular-shaped body section of the T-shaped microstrip duplexer body;

wherein each of the two bandpass filters creates an Electromagnetically Induced Transparency (EIT) window within a frequency absorption region of the bandpass filter to allow a signal to pass at a pre-tuned frequency band.

2. The ring resonator based T-shaped duplexer of claim 1 wherein in a first bandpass filter of the two bandpass filters the ring resonator structure has an off-center cut to create two unequal portions of the ring resonator structure and operates as an EIT-based filter, and wherein in a second bandpass filter of the two bandpass filters the ring resonator structure has a centered cut to create two equal portions of the ring resonator structure and operates as a Fano-based filter.

3. The ring resonator based T-shaped duplexer of claim 1 wherein a first bandpass filter of the two bandpass filters allows a signal to pass at a first pre-tuned frequency band and a second bandpass filter of the two bandpass filters allows a signal to pass at a second pre-tuned frequency band.

4. The ring resonator based T-shaped duplexer of claim 3 wherein a frequency isolation is provided between the first pre-tuned frequency band and the second pre-tuned frequency band.

5. The ring resonator based T-shaped duplexer of claim 3 wherein the first pre-tuned frequency band has a greater bandwidth than that of the second pre-tuned frequency band thereby enabling the T-shaped duplexer to operate as an asymmetric duplexer.

6. The ring resonator based T-shaped duplexer of claim 1 wherein the T-shaped duplexer has a thin depth compared to its overall length and width thereby providing the T-shaped duplexer with a planar shape.

7. The ring resonator based T-shaped duplexer of claim 6 wherein the T-shaped duplexer is disposed on a metal layer of an integrated circuit chip.

8. The ring resonator based T-shaped duplexer of claim 7 wherein the T-shaped duplexer has multiple ground patches disposed near the ends of the T-shaped microstrip duplexer body to improve isolation between the two bandpass filters.

9. The ring resonator based T-shaped duplexer of claim 7 wherein the T-shaped duplexer is formed on a lower metal layer of a metal layer stack of the integrated circuit chip using one of bulk CMOS fabrication technology, BiCMOS fabrication technology, and GaAs fabrication technology.

10. The ring resonator based T-shaped duplexer of claim 7 wherein the T-shaped duplexer is disposed on a lower metal layer of a metal layer stack of the integrated circuit chip, and an antenna-on-chip (AoC) is disposed on an upper first metal layer of the metal layer stack and is connected to the T-shaped duplexer by multiple through-vias between the upper metal layer and the lower metal layer.

11. The ring resonator based T-shaped duplexer of claim 10 wherein a transmitter and a receiver are disposed on a second lower metal layer below the T-shaped duplexer and are connected to the T-shaped duplexer by multiple through-vias between the lower metal layer and the second lower metal layer.

12. The ring resonator based T-shaped duplexer of claim 10 wherein the antenna-on-chip (AoC) is one of a patch antenna, a dipole antenna, a slot antenna, and a bowtie antenna.

13. The ring resonator based T-shaped duplexer of claim 7 wherein an area of the T-shaped duplexer disposed on the lower metal layer is equal to or less than an area of the Antenna on Chip (AoC) disposed on the upper metal layer.

14. A ring resonator based bandpass filter device for use in communication systems, the bandpass filter device comprising:

a microstrip structure having a rectangular shaped body and having a first port provided at one end of the rectangular shaped body and a second port provided at a second end of the rectangular shaped body; and a ring resonator structure having a circular shape, an outer edge of the ring resonator structure being connected to the rectangular shaped body of the microstrip structure;

wherein the ring resonator structure creates an Electromagnetically Induced Transparency (EIT) window within a frequency absorption region of the bandpass filter device to allow a signal to pass at a pre-tuned frequency band.

15. The ring resonator based bandpass filter device of claim 14 wherein the ring resonator structure has a cut positioned to create equal portions of the ring resonator structure thereby providing a Fano resonance with a high-quality factor for the bandpass filter device.

16. The ring resonator based bandpass filter device of claim 14 wherein a partial reflection path is provided in the rectangular shaped body of the microstrip structure to provide a Fano resonance with a high-quality factor for the bandpass filter device.

17. The ring resonator based bandpass filter device of claim 14 wherein a cut is provided in the ring resonator structure.

18. The ring resonator based bandpass filter device of claim 17 wherein the pre-tuned frequency band is determined by a size and location of the cut in the ring resonator structure.

19. The ring resonator based bandpass filter device of claim 17 wherein the pre-tuned frequency band is determined by an angle of the cut in the ring resonator structure.

20. The ring resonator based bandpass filter device of claim 17 wherein a gap distance made by the cut in the ring resonator structure determines the pre-tuned frequency band.

* * * * *